United States Patent [19]

Sakamoto et al.

[11] Patent Number: 4,741,990

[45] Date of Patent: May 3, 1988

[54] METHOD FOR PROCESSING SILVER HALIDE PHOTOGRAPHIC LIGHT-SENSITIVE MATERIALS

[75] Inventors: Eiichi Sakamoto, Hannou; Yutaka Kaneko, Sagamihara, both of Japan

[73] Assignee: Konishiroku Photo Industry Co., Ltd., Japan

[21] Appl. No.: 22,208

[22] Filed: Mar. 5, 1987

[30] Foreign Application Priority Data

Mar. 7, 1986 [JP] Japan ..... 61-50745
Jun. 13, 1986 [JP] Japan ..... 61-138870

[51] Int. Cl.[4] ..... G03C 5/24

[52] U.S. Cl. ..... 430/380; 430/434; 430/446; 430/464; 430/489; 430/551; 430/607; 430/611

[58] Field of Search ..... 430/434, 489, 464, 446, 430/380, 551, 607, 611

[56] References Cited

FOREIGN PATENT DOCUMENTS 1399450 7/1975 United Kingdom ..... 430/611

*Primary Examiner*—Paul R. Michl
*Assistant Examiner*—Patrick A. Doody
*Attorney, Agent, or Firm*—Finnegan, Henderson, Farabow, Garrett & Dunner

[57] ABSTRACT

A method for processing silver halide photographic materials is disclosed. In this method a silver halide photographic material is developed in the presence of at least one compound represented by the following Formula [Ia] or [Ib]:

Formula [Ia]

Formula [Ia]

wherein Ar is a benzene or naphthalene ring, F is a fluorine atom, Y and Y' are substituents, X is a bivalent atom or a bivalent linkage group. The compound may be contained in a processing solution or in the silver halide photographic light-sensitive material to be processed. A fog of the silver halide photographic material, especially a fog due to a storage of the materials at a high temperature can be considerably decreased.

21 Claims, No Drawings

METHOD FOR PROCESSING SILVER HALIDE PHOTOGRAPHIC LIGHT-SENSITIVE MATERIALS

FIELD OF THE INVENTION

The present invention relates to a method for processing silver halide photographic light-sensitive materials, and more particularly to a method for preventing silver halide photographic light-sensitive materials from producing a fog in the processing thereof.

BACKGROUND OF THE INVENTION

There have conventionally been known as stabilizers or fog restrainers to be used for the purpose of preventing silver halide photographic light-sensitive materials (hereinafter called light-sensitive materials) from producing a fog with the lapse of time a large number of compounds including, for example, hydroxypolyazaindenes such as 4-hydroxy-6-methyl-1,3,3a,7-tetrazaindene, mercapto-substituted heterocyclic compounds such as 1-phenyl-5-mercaptotetrazole, 2-mercaptobenzothiazole, and azole derivatives such as benzimidazole, benzotriazole, indazole, and the like.

Further, the combined use in a given ratio of these conventionally known fog restrainers is also extensively performed in this field.

However, the demand for increasing the speed of light-sensitive materials has been more and more strongly made in recent years. That is, there are, for example, light-sensitive materials for amateure use required to meet the need for the use of a high shutter speed for preventing the camera blur in photographing due to the miniaturization of the image frame size; color and black-and-white photographic papers required to meet the need for the rapid processing in the development process thereof; light-sensitive materials for graphic arts use required to be so high-sensitive as suitably usable in the electronically operated, simplified or automated plate-making and printing processes; light-senisitive materials for medical radiography use highly demanded to meet the need for use in a much reduced radiation-exposure dose to be highly safe to the human body; and the like.

Upon the fog to be produced during the storage over a long period of time in a light-sensitive material comprising a silver halide emulsion extremely sensitized or sensitized by a technique different from conventional ones or to be increased due to the rapid development process at a high temperature above 30° C. that is performed lately for the reduction of the access time, those conventional fog restrainers as mentioned above has no effect at all or on the contrary there are cases where they rather increase the fog.

Thus, there is a strong demand for developing a fog-restraining technique which is capable of adequately restraining high-speed light-sensitive materials from producing a fog during their storage over a long period or of preventing light-sensitive materials from producing a fog in their rapid processing at a high temperature, and which has no influence upon the photographic characteristics (gradation, sharpness, etc.).

SUMMARY OF THE INVENTION

It is a first object of the present invention to provide a method for processing photographic light-sensitive materials which is capable of keeping the photographic characteristics stable and of preventing the the light-sensitive material from producing a fog even where it is preserved over a long period.

It is a second object of the present invention to provide a processing method which is hardly apprehensive of inviting the deterioration of the sensitivity and gradation due to the development restraining.

It is a third object of the present invention to provide a processing method which is capable of extremely reducing the production of a fog when a light-sensitive material is developed at a high temperature, particularly at a temperature of not less than 30° C.

The above objects can be accomplished by a method for processing silver halide photographic light-sensitive materials which comprises a developing process in which a silver halide photographic light-sensitive material is developed in the presence of at least one compound having Formula [Ia] or [Ib]:

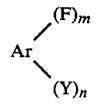

Formula [Ia]

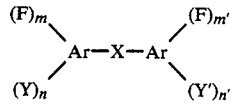

Formula [Ib]

wherein Ar is a benzene ring of a naphthalene ring, each of which rings may be in the quinone form, F is a fluorine atom, Y and Y' each is a substituent substitutable to the benzene ring or naphthalene ring, X is a divalent linkage group, m and m' each is an integer of from 1 to 5, and n and n' each is an integer of from 1 to 3.

DETAILED DESCRIPTION OF THE INVENTION

The present invention will be illustrated further in detail below:

Those compounds having Formulas [Ia] and [Ib] to be used in this invention are required to be of a benzene ring or a naphthalene ring (each of which rings may be in the quinone form) having thereon at least one fluorine atom and at least one substituent (represented by Y and Y') other than the fluorine atom.

Those groups substitutable to the benzene ring or naphthalene ring represented by Y or Y', although not particularly restricted, include preferably halogen atoms excluding fluorine, mercapto group, carboxyl group and salts thereof, sulfo group and salts thereof, amino group, acylamino groups, alkylamino groups, nitro group, cyano group, alkyl groups, alkenyl groups, cycloalkyl groups, aryl groups, alkoxy groups, aryloxy groups, alkyl-thio groups, aryl-thio groups, alkoxy-carbonyl groups, carbamoyl group, sulfamoyl group, alkoxyalkyl groups, aminoalkyl groups, acylaminoalkyl groups, hydroxyalkyl groups, carboxyalkyl groups, sulfoxalkyl groups, alkylsulfonamidoalkyl groups, and the like.

Those particularly preferred among these substituents, for balancing the oleophilicity of the fluorine atom, are the hydrophilic groups including, e.g., the hydroxyl group, mercapto group, carboxyl group and salts thereof, sulfo group and salts thereof, and the like.

In Formula [Ib], examples of the divalent linkage group represented by the X, although not restricted either, include, e.g., —O—, —S—, —S—S—, —$(CH_2)_l$— (l is an integer of from 1 to 8), and the like.
The following are examples of the compounds having Formulas [Ia] and [Ib] usable in this invention, but this invention is not limited to and by the examples.
Exemplified Compounds:
(I-1)
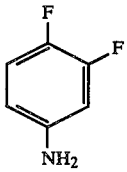
(I-2)
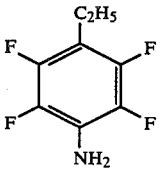
(I-3)
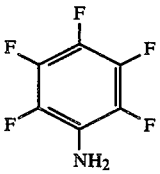
(I-4)
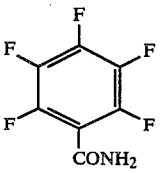
(I-5)
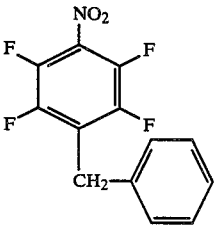
(I-6)
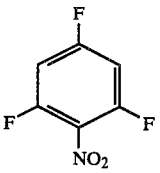
(I-7)
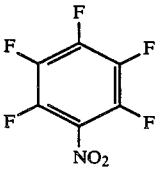
(I-8)
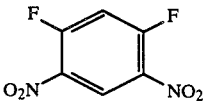
-continued
Exemplified Compounds:
(I-9)
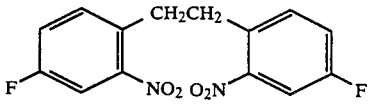
(I-10)
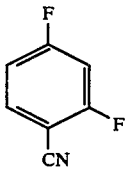
(I-11)
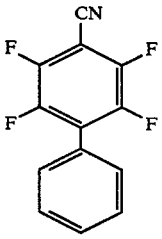
(I-12)
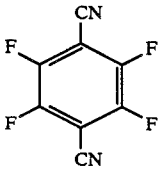
(I-13)
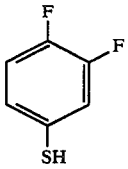
(I-14)
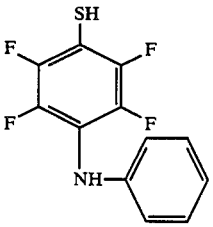
(I-15)
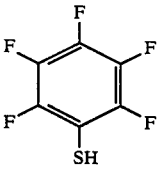
(I-16)
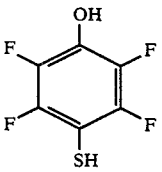

-continued
Exemplified Compounds:
(I-17)
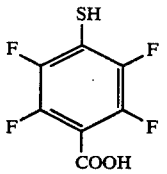
(I-18)
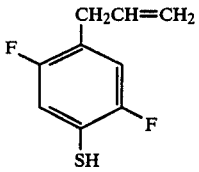
(I-19)
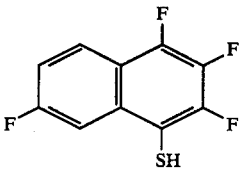
(I-20)
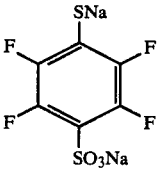
(I-21)
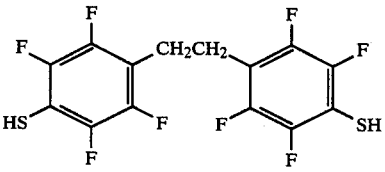
(I-22)
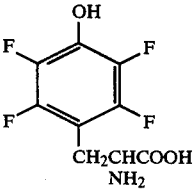
(I-23)
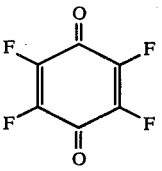
(I-24)
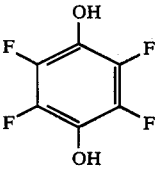
(I-25)
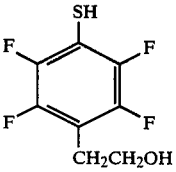
-continued
Exemplified Compounds:
(I-26)
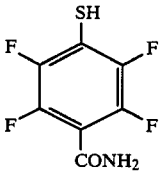
(I-27)
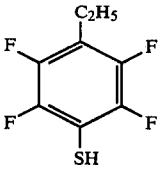
(I-28)
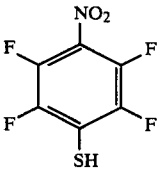
(I-29)
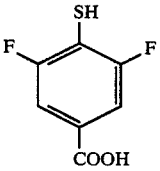
(I-30)
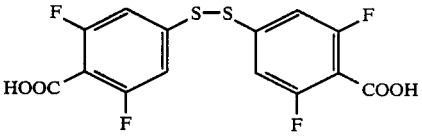
(I-31)
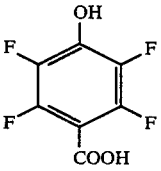
(I-32)
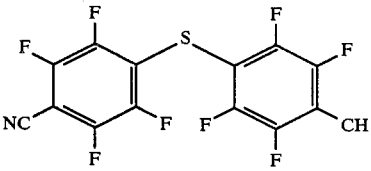
(I-33)
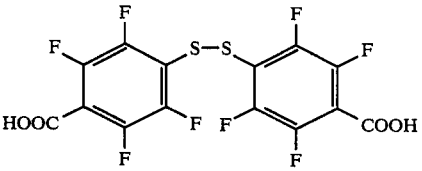
(I-34)
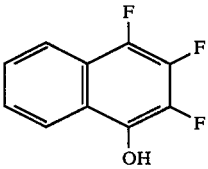

-continued

Exemplified Compounds:

(I-35)

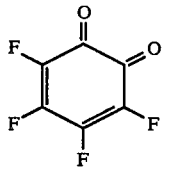

(I-36)

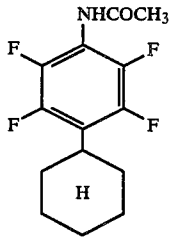

(I-37)

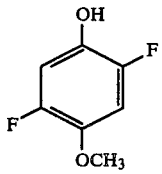

(I-38)

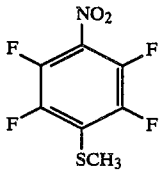

(I-39)

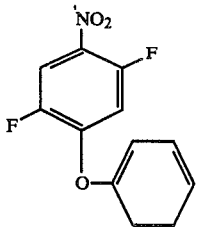

(I-40)

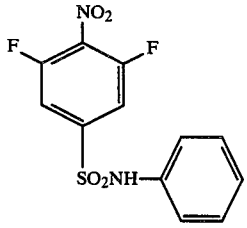

(I-41)

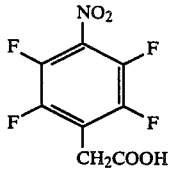

(I-42)

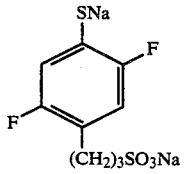

-continued

Exemplified Compounds:

(I-43)

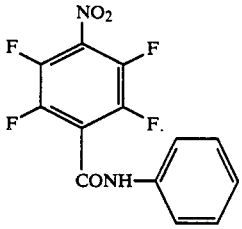

(I-44)

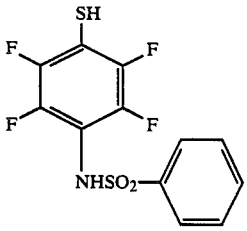

(I-45)

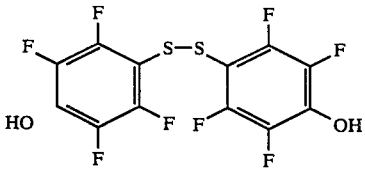

(I-46)

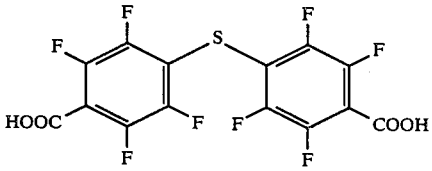

(I-47)

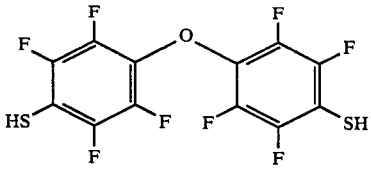

(I-48)

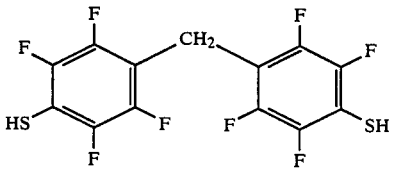

These compounds can be synthesized in accordance with those methods as described in the J. Chem. Soc. Sect. C, p. 626, 1965, p. 1347, 1971; J. Org. Chem., vol. 34, p. 534, 1969; and Japanese Patent Publication Open to Public Inspection (hereinafter referred to as Japanese Patent O.P.I. Publication) Nos. 184057/1985 and 204742/1985, and the like. Some part of these compounds can be commercially available as chemical reagents.

In the present invention, that the development of a light-sensitive material is made in the presence of a compound having Formula [Ia] or [Ib] (those having both Formulas will be hereinafter called the "compound of Formula [I]" or the "antifoggant of this invention") means more particularly either a method in which a light-sensitive material containing the compound of this invention in at least one of the component layers thereof such as the silver halide emulsion layer and/or a layer adjacent thereto, filter layer, antihalation layer, protective layer, subbing layer, etc., is developed, or a method in which the development of a light-sensitive material is carried out in a developer solution or a bath prior to the developing process into which is incorporated the compound of this invention. The particularly preferred one of these methods is the former; i.e., the method in which the compound of this invention is incorporated into the emulsion layer of a light-sensitive material.

The adding amount of the antifoggant of this invention, where added to the silver halide emulsion layer of a light-sensitive material, is desirable to be used in the range of from $1\times10^{-5}$ to $1\times10^{-1}$ mole per mole of the silver halide contained in the emulsion layer, and more preferably from $1\times10^{-5}$ to $1\times10^{-4}$ mole, and, where added to a non-light-sensitive layer, is desirable to be used in the range of from $1\times10^{-5}$ to $1\times10^{-1}$ mole per $m^2$. Where the compound is added to the processing bath, the adding amount is preferably in the range of from $10^{-5}$ to $10^{-1}$ mole, and more preferably from $10^{-4}$ to $10^{-2}$ mole.

The compound of this invention may be dissolved in a solvent miscible with water, such as methanol, ethanol, dimethylformamide, or in an aqueous alkaline solution, and the solution of the compound may be then incorporated into the foregoing component layer(s) of a light-sensitive material or into the foregoing developer solution.

For the processing method of this invention, any known method may be used except for the presence of the compound of this invention. The processing may be made at a temperature of from 18° C. to 50° C. According to purposes, any of the black-and-white photograph processing, lith-type developing process, or color photograph processing to form dye images may apply to the processing method.

Examples of the developing agent for the black-and-white photograph processing include dihydroxybenzenes (such as hydroquinone), 3-pyrazolidones (such as 1-phenyl-3-pyrazolidone), aminophenols (such as N-methyl-p-aminophenol), ascorbic acid, and the like. These compounds may be used alone or in combination.

The developer solution may contain other known preservative, alkaline agent, pH buffer, fog restrainer, etc., and further, if necessary, solvent, tone control agent, development accelerator, surfactant, defoaming agent, water softener, hardening agent, and the like.

In addition, the present invention may also apply to a light-sensitive material of the type of containing a developing agent and of being processed in an alkaline bath; i.e., the so-called agent-in-emulsion-type light-sensitive material.

In the case of forming a dye image, a color developing agent-containing aqueous alkaline solution may be used. As the color developing agent any of those known primary aromatic amine developers such as phenylenediamines may be used.

The color developer solution may, in addition to the above agent, also contain a pH buffer such as a sulfite, carbonate or borate of an alkali metal, a halogen salt or organic antifoggant, a water softener, a preservative, an organic solvent such as benzyl alcohol, ethylene glycol, etc., a development accelerator such as a quaternary salt or amine, and the like.

The color developing process is usually followed by the bleach-fix process. The bleaching process may take place either simultaneously with or sparately from the fixing process. The bleaching agent to be used in the bleaching or bleach-fix process includes those compounds of polyvalent metals such as iron (III), cobalt (III), chromium (IV), copper (II), etc,., and persulfates, and the like; for example, ferrocyanides, bichromates, organic complex salts of iron and cobalt, ethylenediaminetetraacetic acid, nitrilotriacetic acid, persulfates, permanganates, and the like, may be used.

The processing method of this invention may apply to various types of commercially available light-sensitive materials to prevent them from producing a fog.

For example, the method may apply to those light-sensitive materials for general black-and-white use, for X-ray recording use, for graphic arts use, for low-speed positive use, for color positive use, for color negative use, for color paper use, for reversal color use, for direct positive use, for the diffusion transfer process, for the thermal development process, and the like. The method is particularly effectively applicable to the rapid development process that is to take place at a high temperature of not less than 30° C.

In the processing method of this invention, any known antifoggants may be used in combination with the antifoggant of this invention.

The usable antifoggants include those compounds wellknown to those skilled in the art, such as, e.g., 5-nitrobenzimidazole, 6-nitroindazole, 5-methylbenzotriazole, 1-phenyl-5-mercaptotetrazole, 4-hydroxy-6-methyl-1,3,3a,7-tetrazaindene, 2-mercaptobenzothiazole, and the like.

In the processing method of this invention, where a compound having Formula [Ia] or [Ib] is incorporated into a light-sensitive material, a compound having the following Formula (II) (hereinafter called Compound II) is particularly desirable to be used in combination.

Formula [II]

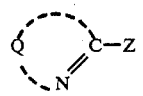

wherein Q is a group of atoms, including a carbon atom, a nitrogen atom, a sulfur atom or an oxygen atom, necessary to form a 5- or 6-member heterocyclic ring, and the ring formed by the Q is allowed to be condensed further with a hydrocarbon ring or another heterocyclic ring; and Z is an aromatic group or a heterocyclic group.

In Formula [II], the 5- or 6-member heterocyclic ring formed by the Q is a nitrogen-containing heterocyclic ring containing a carbon, nitrogen, sulfur or oxygen atom as the ring-consituting atom, and further the ring may be condensed with a hydrocarbon ring or with another heterocyclic ring; examples of the ring include imidazole, triazole, tetrazole, pyridine, pyrimidine, triazine, thiazole, oxazole, thiadiazole, oxadiazole, benzimidazole, benzothiazole, benzoxazole, purine, triazaindene, tetrazaindene, pentazaindene, and the like.

These heterocyclic rings each may have a substituent, such as, for example, a halogen atom, a hydroxyl, mercapto, amino, nitro, carboxyl, sulfo, alkyl, alkoxy, aryloxy, alkylthio, arylthio, carbamoyl, sulfamoyl, or the like group.

The aromatic group represented by the Z is preferably a phenyl group or a naphthyl group. These phenyl and naphthyl groups each may also have a substituent, such as, for example, a halogen atom, a hydroxyl, mercapto, amino, nitro, alkyl, alkoxy, or the like group. The heterocyclic group represented by the Z may also be condensed, examples of which include imidazolyl, thiazolyl, pyridyl, pyrimidinyl, piperidinyl, benzothiazolyl, quinolyl, and the like groups. These heterocyclic groups each may also have a substituent, such as, e.g., a halogen atom, a hydroxyl, amino, nitro, alkyl, alkoxy, or the like group.

The preferred ones among the compounds having Formula [II]are those of which the heterocyclic ring formed by the Q is imidazole, triazole, or tetrazole. The particularly preferred one is of tetrazole. The aromatic group represented by the Z is more preferably a phenyl, tolyl or m-nitrophenyl group, and the heterocyclic group is more preferably a 2-imidazolyl, 2-pyridyl or 2-benzothiazolyl group.

The following are examples of the compound having Formula [II] to be used in the present invention, but this invention is not limited thereto.

II-1

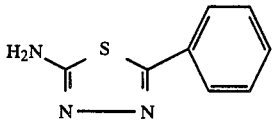

II-2

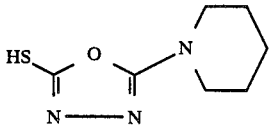

II-3

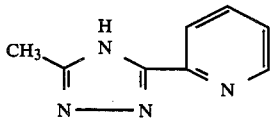

II-4

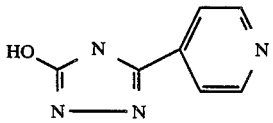

II-5

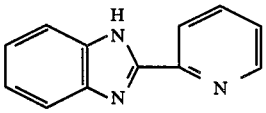

II-6

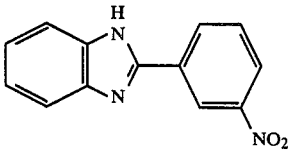

II-7

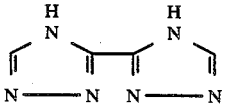

II-8

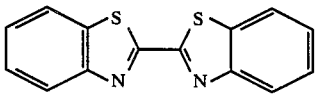

-continued

II-9

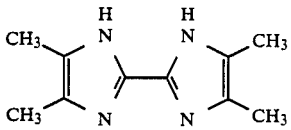

II-10

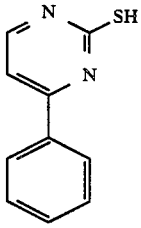

II-11

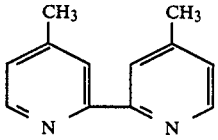

II-12

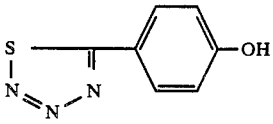

II-13

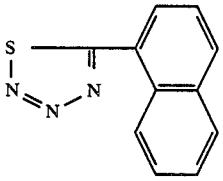

II-14

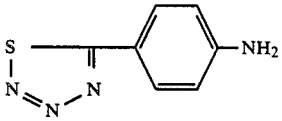

II-15

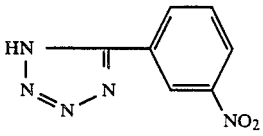

II-16

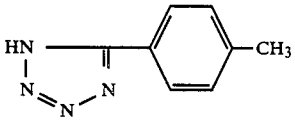

II-17

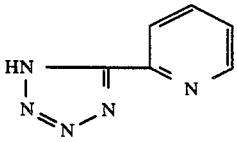

II-18

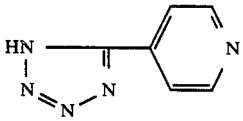

-continued

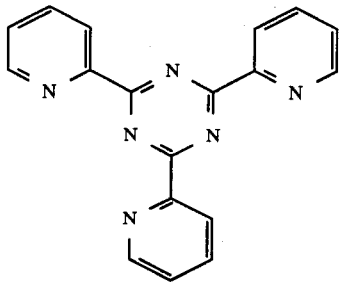

II-19

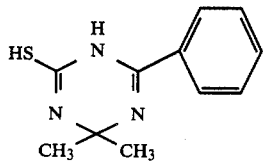

II-20

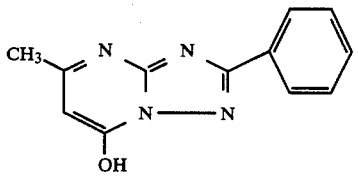

II-21

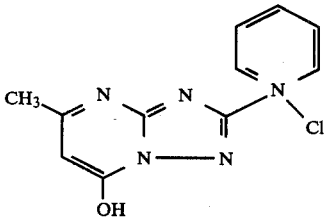

II-22

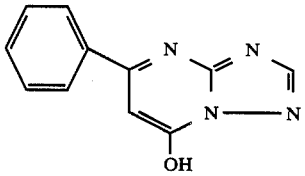

II-23

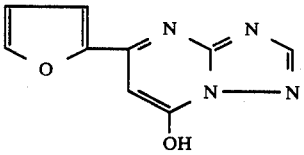

II-24

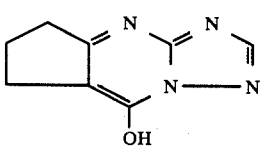

II-25

-continued

II-26

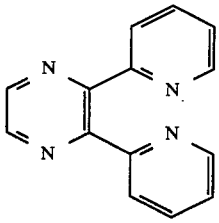

These compounds are numerously reported in abstracts and journals such as the Beilsteins Handbuch der Organischen Chemie, Chemical Abstracts, Journal of the American Society, and the like, and can be easily synthesized in accordance with those methods as described therein.

The compounds having the foregoing Formula [I] are especially excellent in their fog restrainability in the light-sensitive material's long-period preservation under a high temperature-high humidity condition (about 50°-60° C./60-90% RH) rather than merely under a high temperature condition (about 50°-60° C.).

On the other hand, the compounds having Formula [II], which were also proposed as antifoggants by us in Japanese Patent Application No. 14536/1986, were found out, as a result of our later investigation, to show an excellent fog restrainability in the preservation under a high-temperature condition rather than under a high temperature-high humidity condition in contrast to the above ones having Formula [I].

Where both compounds of Formula [I] and Formula [II] are used in combination, there can be obtained an unexpected synergistic effect that their individual single features can be further enhanced in smaller adding quantities than the quantity of each of them used alone.

Where a compound [II] is used in combination with the compound of this invention, the adding quantity of each of both compounds having Formula [I] and Formula [II], when added to a silver halide emulsion, is preferably in the range of from $10^{-6}$ to $10^{-1}$ mole per mole of the silver halide contained in the emulsion, and more preferably from $10^{-5}$ to $10^{-2}$ mole. When added to non-light-sensitive layers, the compounds having Formula [I] and Formula [II] each is in the quantity range of from $10^{-5}$ mole to 1 mole in the coating liquid on a support per $m^2$, and more preferably from $10^{-4}$ to $10^{-1}$ mole. Both compounds [I] and [II] may be used in a wide proportional range such as of from 1:0.01 to 1:100 by weight, but preferably from 1:0.1 to 1:50 by weight.

The silver halide light-sensitive material to which this invention is applied may use any arbitrary silver halides for usual use in ordinary silver halide emulsions, such as silver bromide, silver iodobromide, silver iodochloride, silver chlorobromide, silver chloride, and the like.

The silver halide grains usable in the silver halide emulsion may be ones obtained by any of the acid process, neutral process and ammoniacal process. These grains may be grown either at once or after the preparation of seed grains. The method of preparing seed grains and that of growing the grains may be either the same or different.

The silver halide emulsion may be prepared either by mixing halide and silver ions simultaneously or by mixing either one into a liquid in which the other is present. Also, the halide ion and silver ion may be poured sequentially simultaneously, taking into account the critical growth rate of silver halide grains, into a mixing pot with the pH and/or pAg thereinside being controlled. By this method, silver halide grains in the regular crystal form with their grain size nearly uniform can be obtained. After the growth the halogen composition of the obtained grains may be changed by use of the conversion method.

The silver halide emulsion may have the grain size, grain form, grain size distribution and grain growth rate thereof controlled, if necessary at the time of the manufacture thereof, by use of a silver halide solvent.

The silver halide grain may contain metallic elements in the inside and/or on the surface thereof by adding thereto metallic ions, in the course of forming and/or growing the grain, by using at least one salt selected from the group consisting of cadmium salts, zinc salts, lead salts, thalium salts, iridium salts (including complex salts), rhodium salts (including complex salts), and iron salts (including complex salts), and may be provided in the inside and/or on the surface thereof with a reduction sensitization nucleus by being place in an appropriate reductive atmosphere.

The silver halide emulsion, after completion of the growth of the silver halide grains therof, may have the useless water-soluble salt either removed therefrom or remain thereinside. If desired to remove the salt, the removal can be made in accordance with the method described in Research Disclosure (hereinafter abbreviated to RD) No. 17643 Item II.

The silver halide grain, although it may be one having a uniform silver halide composition distribution thereinside, but is particularly desirable to be a core/-shell type grain whose inside and surface stratusm are different in the silver halide composition.

The core/shell type silver halide emulsion is of a structure consisting of two or more strata different in the silver iodide content; the largest-amount silver iodide-containing stratum (called "core") is other than the surface stratum (called "shell").

The core/shell type emulsion suitably usable for the light-sensitive material to be used in this invention is one in which the silver iodide content of the largest-amount silver iodide-containing inside stratuem (core) is from 6 to 40 mole %, more preferably from 8 to 30 mole %, and most preferably from 10 to 20 mole %. The silver iodide content of the surface stratum is preferably less than 6 mole %, and more preferably from zero to 4.0 mole %.

The proportion of the shell portion to the core/shell type silver halide grain should account for preferably 10 to 80%, more preferably 15 to 70%, and most preferably 20 to 60%.

The core portion should account for preferably 10 to 80% of the whole grain, and more preferably 20 to 50%.

The difference in the silver iodide content between the large-amount silver iodide-containing core portion and the small-amount silver iodide-containing shell portion may either be sharply defined or not necessarily be clearly defined, continuously changing in the silver iodide content. In addition, one having a medium-amount silver iodide-containing intermediate stratum between the core and shell portions may also be suitably used.

In the case of the core/shell type silver halide grain having the above-mentioned intermediate stratum, the preferred volume of the intermediate stratum accounts for 5 to 60% of the whole grain, and more preferably 20 to 55%.

Each of the differences in the silver iodide content between the shell and the intermediate stratum and between the intermediate stratum and the core is preferably not less than 3 mole %, and the difference in the silver iodide content between the shell and the core is preferably not less then 6 mole %.

In the light-sensitive material to be used in this invention, the core/shell type silver halide emulsion is of silver iodobromide whose silver iodide content is preferably from 4 to 20 mole %, and more preferably from 5 to 15 mole %. The emulsion may also contain silver chloride as long as it does not hurt the effect of this invention.

The above-mentioned core/shell type emulsion may be prepared in accordance with those prior-art methods as disclosed in Japanese Patent O.P.I. Publication Nos. 177535/1984, 138538/1985, 52238/1984, 14331/1985, 35726/1985, 258536/1985, and the like.

Where the core/shell type silver halide grain is grown starting from a seed grain as in the method described in Japanese Patent O.P.I. Publication 138538/1985, the grain can have in its center a silver halide composition region different from the core. In such an instance, the halide composition of the seed grain, although it may be any arbitrary composition such as silver bromide, silver iodobromide, silver chloroiodobromide, silver chlorobromide, silver chloride or the like, should preferably be of silver iodobromide whose silver iodide content is not more than 10 mole % or silver bromide.

The seed silver halide grains should account for preferably not more than 50% of the whole silver halide, and most preferably not more than 10%.

The distribution condition of the silver iodide in the foregoing core/shell type silver halide grains can be detected in accordance with various measuring methods, and can be investigated by the luminescence measurement at a low temperature or the X-ray diffraction method as described in the substance book of the annual lecture meeting 1981 of the Society of Photographic Science and Technology of Japan.

The core/shell type silver halide grain may be of either a regular crystal such as a cubic, tetradecahedral or octahedral crystal, or a twin. And the grain may also be a mixture of these crystals, but is desirable to be a regular crystal.

The silver halide grain may be grown in the presence of a know silver halide solvent such as ammonia, thioether, thiourea, or the like.

The silver halide grain, including the core/shell type grain, contained in the light-sensitive material to be used in the method of this invention may contain metallic elements in the inside and/or on the surface thereof by adding thereto, in the course of forming and/or growing the grain, metallic ions, using at least one salt selected from the group consisting of cadmium salts, zinc salts, lead salts, thalium salts, iridium salts (including complex salts), rhodium salts (including complex salts), and iron salts (including complex salts), and also may be provided in the inside and/or on the surface thereof with a reduction sensitization nucleus.

The silver halide emulsion, after completion of the growth of the silver halide grains thereof may have the useless water-soluble salt either removed therefrom or remain thereinside. In the case of removing the salt, the removal may be made in accordance with the method described in RD 17643, Item II.

The silver halide grain may be either one that a latent image is mainly formed on the surface thereof or one that a latent image is mainly formed thereinside. The usable silver halide grain size should be from 0.05 to 30μ, and preferably from 0.1 to 20μ.

The silver halide emulsion used may be of any grain size distribution. A wide grain size distribution-having emulsion (called polydisperse emulsion) may be used, and differently narrower grain size distribution-having emulsions may also be used alone or in a mixture thereof. A polydisperse emulsion and a monodisperse emulsion may be used in a mixture thereof, but the emulsion used herein is desirable to be a monodisperse emulsion.

In this invention, the monodisperse emulsion is desirable to be one in which the weight of the silver halide thereof whose grain sizes are within the size range of the average grain size $\bar{r}\pm20\%$ accounts for not less than 60% of the weight of the whole silver halide, more preferably not less than 70%, and most preferably not less than 80%.

The average grain size $\bar{r}$ is defined as the grain size ri when the $ni\times ri^3$, the product of the frequency ni of the grain having a grain diameter ri with $ri^3$, becomes maxium. (Effective number of three figures, the minimum figure is rounded to the nearest whole number).

The grain size herein, in the case of a spherical silver halide grain, is defined as the diameter thereof and, where the grain is in the non-spherical form, is the diameter of a circular image into which is converted the projection image of the grain image of the same area.

The grain diameter can be obtained, for example, in the manner that the grain's image is magnified by an electron microscope to a 10,000 to 50,000 times-enlarged photo and the diameter or the projected area of the grain's image of the obtained print is actually measured. (The number of the grains to be measured should be not less than 1000 taken at random.)

The particularly preferred highly monodisperse emulsion in this invention, when the width of the grain size distribution thereof is defined by $$\frac{\text{Standard deviation}}{\text{Average grain diameter}}\times 100 = \text{Width of distribution (\%)},$$

is one whose distribution width is not more than 20%, and more preferably not more than 15%, wherein the average grain size and the standard deviation are found from the ri as defined previously.

The monodisperse emulsion can be obtained by adding an aqueous silver salt solution and an aqueous halide solution to a gelatin solution containing seed grains by the double-jet method under the control of pAg and pH. Reference can be made to Japanese Patent O.P.I. Publication Nos. 48521/1979 and 49938/1983 for determining the adding speed of the above solutions.

In order to obtain a further highly monodisperse emulsion, the growing method in the presence of tetrazaindene as disclosed in Japanese Patent O.P.I. Publication No. 122935/1985 may be used.

The silver halide emulsion may be used in a mixture of two or more separately formed silver halide emulsions.

The siler halide emulsion may be chemically sensitized in usual manner; i.e., by using alone or in combination the sulfur sensitization method, selenium sensitization method, reduction sensitization method, noble-metal sensitization method which uses gold or other noble-metallic compounds, and the like.

The silver halide emulsion may be optically sensitized to desired wavelength regions by using dyes known as sensitizing dyes to the photographic field. Those sensitizing dyes may be used either alone or in combination of two or more of them. A supersensitizer, a dye which itself has no spectrally sensitizing function or a compound which does substantially not absorb visible rays but enhances the sensitization function of sensitizing dyes, may be incorporated along with such sensitizing dyes into the silver halide emulsion.

Those usable as the sensitizing dye for the emulsion include cyanine dyes, merocyanine dyes, complex cyanine dyes, complex merocyanine dyes, holopolar cyanine dyes, hemicyanine dyes, styryl dyes and hemioxanol dyes. The particularly useful dyes are cyanine dyes, merocyanine dyes, and complex merocyanine dyes.

To these dyes may be applied any of those nuclei usually utilized as the basic heterocyclic nucleus in cyanine dyes, the said nuclei including pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, and nuclei formed by fusing alicyclic hydrocarbon rings to these nuclei, and nuclei formed by fusing aromatic hydrocarbon rings to these nuclei; i.e., indolenine nucleus, benzindolenine nucleus, indole nucleus, benzoxazole nucleus, naphthoxazole nucleus, benzothiazole nucleus, benzoselenazole nucleus, benzimidazole nucleus, quinoline nucleus, and the like. These nuclei each may have a substituent on the carbon thereof.

To the merocyanine dye or complex cyanine dye may be applied a 5- or 6-member heterocyclic nucleus, as one having a ketomethylene structure, such as pyrazoline-5-one nucleus, thiohydantoin nucleus, 2-thiooxazolidine-2,4-dione nucleus, thiazolidine-2,4-dione nucleus, rhodanine nucleus, thiobarbituric acid nucleus, or the like.

Useful sensitizing dyes for a blue-sensitive silver halide emulsion layer are those as described in, e.g., West German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, Japanese Patent Examined Publication No. 14030/1969 and 24844/1977, and the like. Useful sensitizing dyes for a green-sensitive silver halide emulsion are those typical cyanine dyes, merocyanine dyes or complex cyanine dyes as described in, e.g., U.S. Pat. Nos. 1,939,201, 2,072,908, 2,739,149, 2,945,763, and the like. And useful sensitizing dyes for a red-sensitive silver halide emulsion are those typical cyanine dyes, merocyanine dyes or complex cyanine dyes as described in, e.g., U.S. Pat. Nos. 2,269,234, 2,270,378, 2,442,710, 2,454,629, 2,776,280, and the like. Further, those cyanine dyes, merocyanine dyes or complex cyanine dyes as described in U.S. Pat. Nos. 2,213,995, 2,493,748 and 2,519,001, and West German Pat. No. 929,080, and the like, may be advantageously used for a green-sensitive or red-sensitive silver halide emulsion.

These sensitizing dyes may be used either alone or in combination. The combination of these sensitizing dyes is often used particularly for the purpose of supersensitization. Examples representative of it are described in Japanese Patent Examined Publication Nos. 4932/1968, 4933/1968, 4936/1968, 32753/1969, 25831/1970, 26474/1970, 11627/1971, 18107/1971, 8741/1972, 11114/1972, 25379/1972, 37443/1972, 28293/1973, 38406/1973, 38407/1973, 38408/1973, 41203/1973, 41204/1973, 6207/1974, 40662/1975, 12375/1978, 34535/1979 and 1569/1980, Japanese Patent O.P.I. Publication Nos. 33220/1975, 33828/1975, 38526/1975, 107127/1975, 115820/1976, 135528/1976, 151527/1976, 23931/1977, 51932/1977, 104916/1977, 104917/1977, 109925/1977, 110618/1977, 80118/1979, 25728/1981, 1438/1982, 10753/1983, 91445/1983, 153926/1983, 114533/1984, 116645/1984 and 116647/1984, and U.S. Pat. Nos. 2,688,545, 2,977,229, 3,397,060, 3,506,443, 3,578,447, 3,672,898, 3,679,428, 3,769,301, 3,814,609 and 3,837,862.

Those dyes which in themselves have no spectral sensitization function or materials which do substantially not absorb visible rays but show supersensitization effects and which are usable along with the above sensitizing dyes are, for example, those aromatic organic acid-formaldehyde condensates (as described in, e.g., U.S. Pat. No. 3,473,510), those cadmium salts, azaindene compounds, nitrogen-containing heterocyclic group-substituted aminostilbene compounds (as described in, e.g., U.S. Pat. Nos. 2,933,390 and 3,635,721), and the like. The combined use described in U.S. Pat. Nos. 3,615,613, 3,615,641, 3,617,295 and 3,635,721 are particularly useful.

In the silver halide emulsion, for the purpose of preventing the production of a fog or of keeping the photographic characteristics stable during the manufacture, storage or photographic processing of the light-sensitive material, any of those compounds known as antifoggants or stabilizers to those skilled in the art may be used along with the foregoing compound [I] or [II] during, upon completion of and/or after completion of the chemical ripening prior to the coating of the silver halide emulsion.

Examples of the usable antifoggant or stabilizer include azoles such as benzothiazole, nitroindazole, benzotriazole, nitrobenzimidazole, etc., mercapto-substituted heterocyclic compounds such as mercaptobenzothiazole, mercaptobenzimidazole, mercaptobenzoxazole, mercaptooxadiazole, mercaptothiadiazole, mercaptotriazole, mercaptotriazine, mercaptotetrazoles (such as 1-phenyl-5-mercaptotetrazole), those wherein sulfonic acid group or carboxy group is introduced to the above mercaptoheterocyclic compouns, and further azaindenes such as 4-hydroxy-1,3,3a,7-tetrazaindene; those thiazolium salts as described in U.S. Pat. Nos. 2,131,038, 3,342,569, 3,954,478, those pyrilium salts as described in U.S. Pat. No. 3,148,067, and those quaternary onium salts as described in Japanese Patent Examined Publication No. 40665/1975; those catechols as described in U.S. Pat. No. 3,236,652 and Japanese Patent Examined Publication No. 10256/1968, those resorcinols as described in Japanese Patent Examined Publication No. 44413/1981, and those polyhydroxybenzenes such as gallic acid esters as described in Japanese Patent Examined Publication No. 4133/1968; those tetrazoles as described in West German Pat. No. 1,189,380, those triazoles as described in U.S. Pat. No. 3,157,509, those benzotriazoles as described in U.S. Pat. No. 2,704,721, those urazoles as described in U.S. Pat. No. 3,287,135, those pyrazoles as described in U.S. Pat. No. 3,106,467, those indazoles as described in U.S. Pat. No. 2,271,229, and those azoles such as polymerized benzotriazoles as described in Japanese Patent O.P.I. Publication No. 90844/1984, those pyrimidines as described in U.S. Pat. No. 3,161,515, those 3-pyrazolidones as described in U.S. Pat. No. 2,751,297, and those polymerized pyrrolidones, i.e., heterocyclic compounds such as polyvinyl-pyrrolidones as described in U.S. Pat. No. 3,021,213; those various inhibitor precursors as described in Japanese Patent O.P.I. Publication Nos. 130929/1979, 137945/1984, 140445/1984, British Pat. No. 1,356,124, U.S. Pat. Nos. 3,575,699 and 3,649,267, and the like; those sulfinic acid and sulfonic acid derivatives as described in U.S. Pat. No. 3,047,393; and those inorganic salts as described in U.S. Pat. Nos. 2,556,263, 2,839,405, 2,488,709 and 2,728,663; and the like.

Gelatin is advantageously usable as the binder (or protective colloid) for the silver halide emulsion, and gelatin derivatives, graft polymers of gelatin with other high-molecular materials, other proteins, sugar derivatives, cellulose derivatives, hydrophilic colloid materials such as synthetic hydrophilic high-molecular homo- or co-polymer materials may also be used.

Photographic emulsion layers and other hydrophilic colloid layers of the light-sensitive material of this invention may be hardened by using alone or in combination hardening agents that cross-link the binder (or protective colloid) molecular to enhance the strength thereof. The hardening agent may be added in a quantity so enough to harden the light-sensitive material that the hardening agent need not be added to the processing solution, but the hardening agent is also allowed to be added to the processing solution.

To silver halide emulsion layers and/or other hydrophilic colloid layers of the light-sensitive material may be added a plasticizer for the purpose of increasing the elasticity. The preferred plasticizers are those compounds described in RD 17643 XII A.

Into photographic emulsion layers and other hydrophilic colloid layers of the light-sensitive material may be incorporated water-insoluble or less-soluble synthetic polymer-dispersed product (latex) for the purpose of improving the dimensional stabilization thereof.

The emulsion layer of the light-sensitive material may contain a dye-forming coupler which, in the color developing process, forms a dye by the coupling reaction thereof with the oxidized product of an aromatic primary amine developing agent (such as a p-phenylenediamine drivative, aminophenol derivative, etc.). The dye-forming coupler is usually selected so as to form a dye to absorb an appropriate spectral light which each individual emulsion is sensitive to; an yellow dye-forming coupler is used for the blue-sensitive emulsion layer, a magenta dye-forming coupler is used for the green-sensitive emulsion layer, and a cyan dye-forming coupler is used for the red-sensitive emulsion layer. However, a silver halide color photographic light-sensitive material is allowed to be prepared otherwise, using a different combination than the above according to purposes.

These dye-forming couplers are desirable to have in the molecule thereof a group called 'ballasting group' having not less than 8 carbon atoms to make them non-diffusible. These dye-forming couplers each may be either of the four-equivalent type, which requires 4 molecules of silver ions to be reduced for the formation of one molecule of the dye, or of the two-equivalent type, which requires only two molecules of silver ions to be reduced. These dye-forming couplers include those compounds which, as a result of coupling with the oxidized product of a developing agent, release photographically useful fragments such as development inhibitors, development accelerators, bleaching accelerators, developing agents, silver halide solvents, color control agents, hardening agents, fogging agents, antifoggants, chemical sensitizers, spectral sensitizers and desensitizing agents.

Of these, the coupler which, in the development process, releases a development accelerator to improve the sharpness and graininess of images are called "DIR coupler". In place of the DIR coupler, a DIR compound may be used which effects a coupling reaction with the oxidized product of a developing agent to produce a colorless compound and at the same time releases a development inhibitor.

These DIR couplers and DIR compounds to be used include those with which an inhibitor is directly combined in the coupling position thereof and those with which an inhibitor is combined through a divalent group in the coupling position thereof, the said inhibitor being combined so as to be released as a result of the intramolecular nucleophilic reaction or intramolecular electron-transfer reaction inside the molecule that has been split off by the coupling reaction (these are called "timing DIR couplers" and "timing DIR compounds"). Such inhibitors include those well-diffusible after the split-off and those relatively less-diffusible, which may be used alone or in combination.

Known acylacetanilide-type couplers may be suitably used as the yellow dye-forming couplers. Of these couplers benzoylacetanilide-type and pivaloylactanilide-type compounds are advantageous.

Phenol or naphthol-type couplers are generally used as the cyan dye-forming coupler.

Those usable as the magenta coupler include 5-pyrazone-type couplers, pyrazolobenzimidazole-type couplers, open-chain acylacetanilide-type couplers, indazolone-type couplers, and the like, but the processing method of this invention is particularly effective when the light-sensitive material contains a pyrazoloazole-type magenta coupler having the following Formula [M-I]. Pyrazoloazole-type couplers, although excellent in the color reproducibility as compared to those conventional pyrazolone-type couplers, have been considered disadvantageous in respect of increasing fog due to its high color-forming efficiency. The application of this invention can remarkably improve this disadvantage.

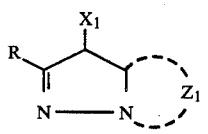

Formula [M-I]

wherein $Z_1$ is a group of nonmetallic atoms necessary to form a nitrogen-containing heterocyclic ring, the ring formed by the $Z_1$ being allowed to have a substituent; $X_1$ is a hydrogen atom or a group splittable in the reaction with the oxidized product of a color developing agent; and R is a hydrogen atom or a substituent.

Examples representative of the substituent represented by the R, although not particularly restricted, include alkyl, aryl, anilino, acylamino, sulfonamido, alkylthio, arylthio, alkenyl, cycloalkyl, and the like groups, and in addition, halogen atoms, cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic thio groups, and spiro compound residues, bridged hydrocarbon compound residues, and the like.

The preferred alkyl groups represented by the R are those having from 1 to 32 carbon atoms, which may be either straight-chain or branched-chain.

The preferred aryl group represented by the R is a phenyl group.

The acylamino groups represent by the R include alkyl carbonylamino groups, arylcarbonylamino groups, and the like.

The sulfonamido groups represented by the R include alkylsulfonylamino groups, arylsulfonylamino groups, and the like.

The alkyl and aryl components in the alkylthio and arylthio groups represented by the R include those alkyl groups and aryl groups as mentioned above.

The preferred alkenyl groups represented by the R are those having from 2 to 32 carbon atoms, and the cycloalkyl groups are those having from 3 to 12 carbon atoms, and preferably from 5 to 7 carbon atoms. The alkenyl groups may be either straight-chain or branched-chain.

The preferred cycloalkenyl groups represented by the R are those having from 3 to 12 carbon atoms, and particularly preferably from 5 to 7 carbon atoms.

The sulfonyl groups represented by the R include alkylsulfonyl groups and arylsulfonyl groups, and the like.

The sulfinyl groups include alkylsulfinyl groups, arylsulfinyl groups and the like.

The phosphonyl groups include alkylphosphonyl groups, alkoxyphosphonyl groups, aryloxyphosphonyl groups, arylphosphonyl groups, and the like.

The acyl groups include alkylcarbonyl groups, arylcarbonyl groups, and the like.

The carbamoyl groups include alkylcarbamoyl groups, arylcarbamoyl groups, and the like.

The sulfamoyl groups include alkylsulfamoyl groups, arylsulfamoyl groups, and the like.

The acyloxy groups include alkylcarbonyloxy groups, arylcarbonyloxy groups, and the like.

The carbamoyloxy groups include alkylcarbamoyloxy groups, arylcarbamoyloxy groups, and the like.

The ureido groups include alkylureido groups, arylureido groups, and the like.

The sulfamoylamino groups include alkylsulfamoylamino groups, arylsulfamoylamino groups, and the like.

The preferred heterocyclic groups are those 5 to 7-member groups, whch include, e.g., 2-thienyl group, 2-pyrimidinyl group, 2-benzothiazolyl group and the like.

The preferred heterocyclic oxy groups are those having a 5 to 7-member heterocyclic ring, which include, e.g., 3,4,5,6-tetrahydropyranyl-2-oxy group, 1-phenyl-tetrazole-5-oxy group, and the like.

The preferred heterocyclic thio groups are those 5 to 7-member heterocyclic thio groups, which include, e.g., 2-pyridylthio group, 2-benzothiazolylthio group, 2,4-diphenoxy-1,3,5-triazole-6-thio group, and the like.

The siloxy groups include trimethylsiloxy group, triethylsiloxy group, dimethylbutylsiloxy group, and the like.

The imido groups include succinic acid imido group, 3-heptadecyl-succinic acid imido group, phthalimido group, glutarimido group, and the like.

The spiro compound residues include spiro[3,3]heptane-1-yl, and the like.

The cross-linked hydrocarbon compound residues include bicyclo[2.2.1]heptane-1-yl, tricyclo[3.3.1.1$^{37}$]-decane-1-yl, 7,7-dimethyl-bicyclo[2.2.1]heptane-1-yl, and the like.

Examples of the group represented by the $X_1$ that can be split off by the reaction with the oxidized product of a color developing agent include halogen atoms (such as chlorine atom, bromine atom, fluorine atom) and alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythiocarbonylthio, acylamino, sulfonamido, nitrogen-containing heterocyclic ring to be combined through a nitrogen atom, alkyloxycarbonylamino, aryloxycarbonylamino, carboxyl, and

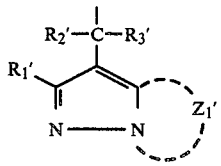

(wherein $R_1'$ is as defined in the foregoing R; $Z_1'$ is as defined in the foregoing Z; and $R_2'$ and $R_3'$ each is a hydrogen atom, an aryl, alkyl or heterocyclic group) and the like groups. The preferred one among these groups is a halogen atom, particularly a chlorine atom.

The foregoing nitrogen-containing heterocyclic ring represented by the $Z_1$ or $Z_1'$ is a pyrazole ring, imidazole ring, triazole ring or tetrazole ring, or the like, and the substituent which the above ring may have includes those as defined in the foregoing R.

These couplers having the foregoing Formula [M-I] are more particularly represented by the following Formulas [M-II] through [M-VII]:

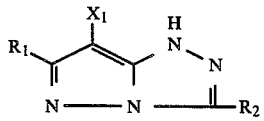

Formula [M-II]

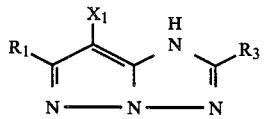

Formula [M-III]

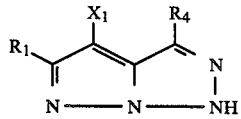

Formula [M-IV]

-continued

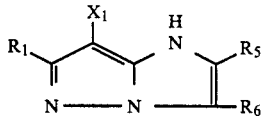

Formula [M-V]

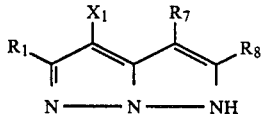

Formula [M-VI]

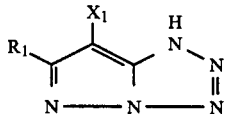

Formula [M-VII]

In Formulas [M-II] through [M-VII], $R_1$ through $R_8$ and $X_1$ are as defined in the previously mentioned R and X, respectively.

The preferred ones among the couplers having Formula [M-I] are those represented by the following Formula [M-VIII]:

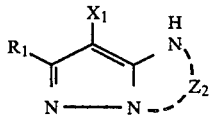

Formula [M-VIII]

wherein $R_1$, $X_1$ and $Z_2$ are as defined in the R, $X_1$ and $Z_1$ of the foregoing Formula [M-I], respectively.

The particularly preferred ones among the magenta couplers having Formulas [M-II] through [M-VII] are those represented by the Formula [M-II].

The most preferred ones as the substituents R and $R_1$ to the foregoing heterocyclic ring are those represented by the following Formula [M-IX]:

Formula [M-IX] $R_9$—$CH_2$— wherein $R_9$ is as defined in the foregoing R.

The preferred one as $R_9$ is a hydrogen atom or an alkyl group.

The substituent which may be introduced to the ring formed by the Z of Formula [M-I] and to the ring formed by the $Z_1$ of Formula [M-VIII] and the $R_2$ through $R_8$ of Formulas [M-II] through [M-VI] are preferably those represented by the following Formula [M-X]:

Formula [M-X] —$R^1$—$SO_2$—$R^2$ wherein $R^1$ is an alkylene group, and $R^2$ is an alkyl, cycloalkyl or aryl group.

The alkylene group represented by the $R^1$ is one whose straight-chain portion has preferably not less than 2 carbon atoms, and more preferably 3 to 6 carbon atoms, and which may be either straight-chain or branched-chain.

The cycloalkyl group represented by the $R^2$ is preferably 5- to 6-member one.

The following are examples representative of the compounds of the present invention:

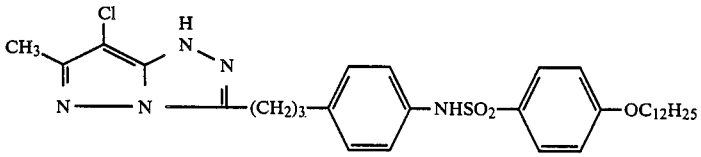

1

-continued
2
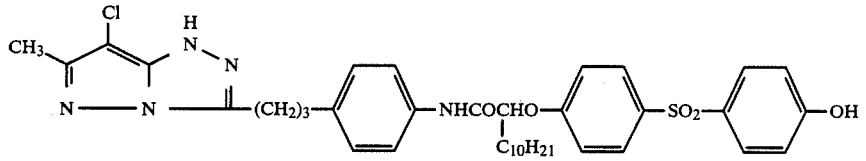
3
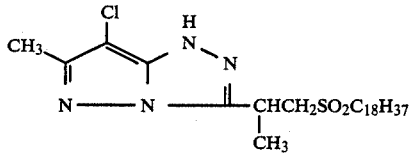
4
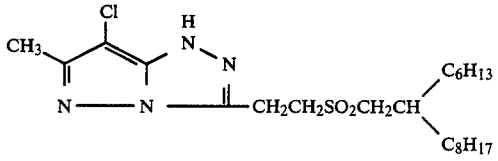
5
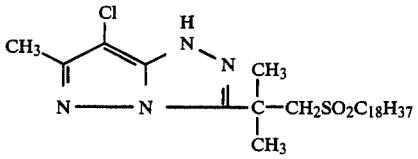
6
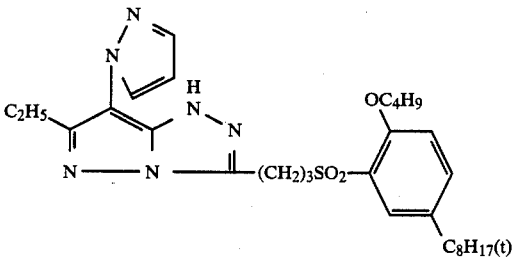
7
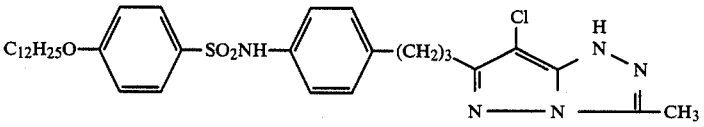
8
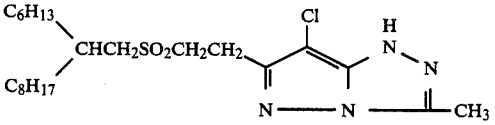
9
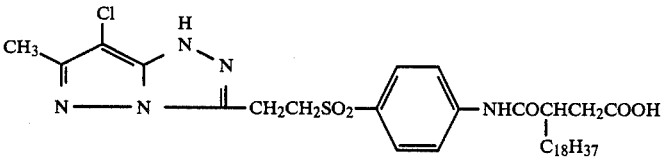
10
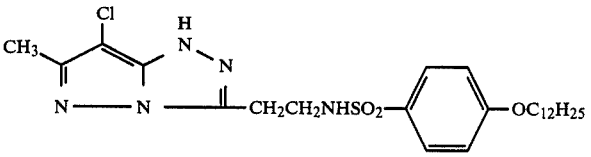

-continued
11
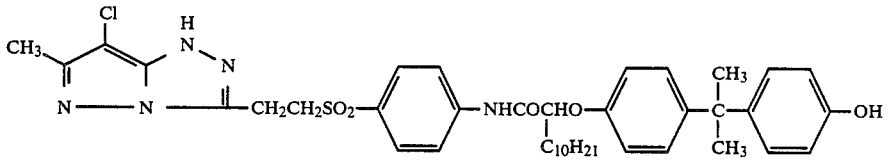
12
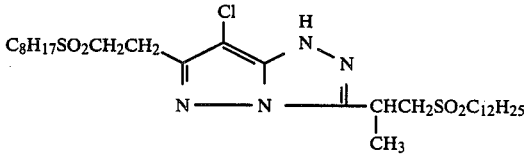
13
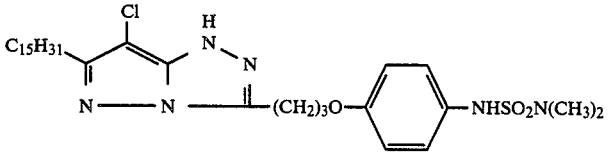
14
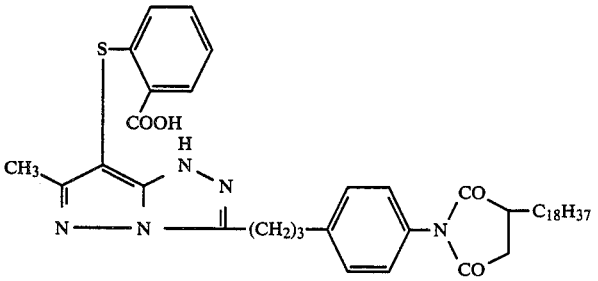
15
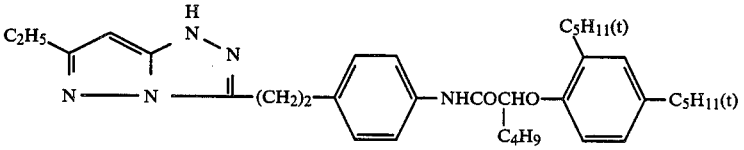
16
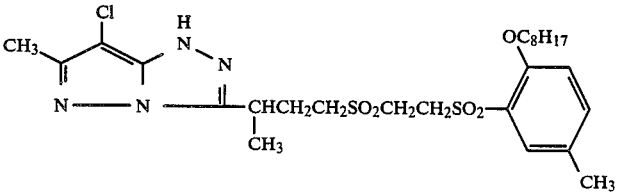
17
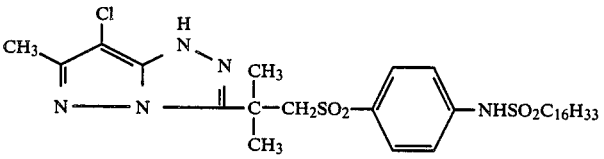
18
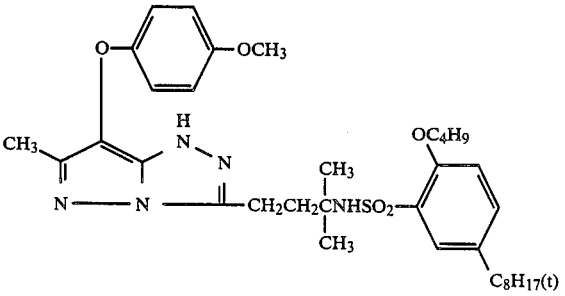

-continued
19
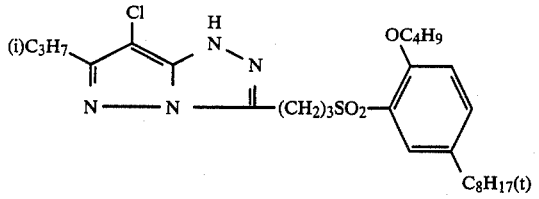
20
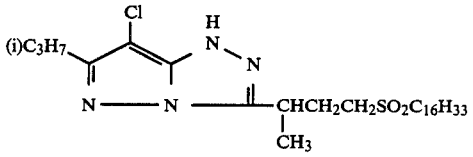
21
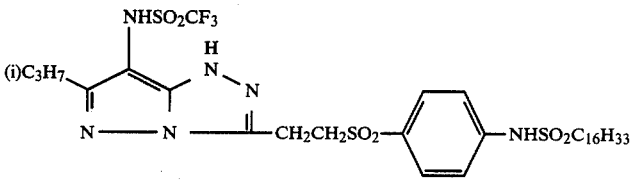
22
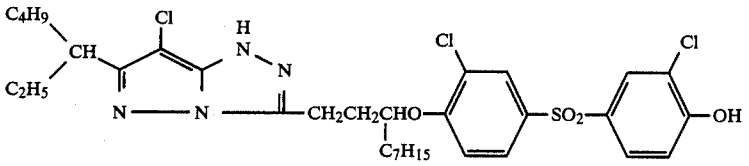
23
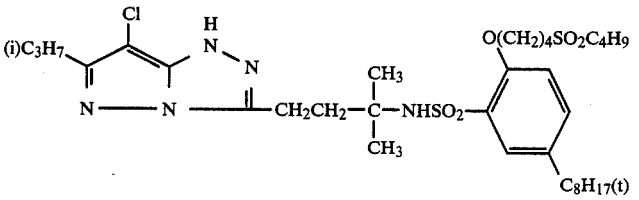
24
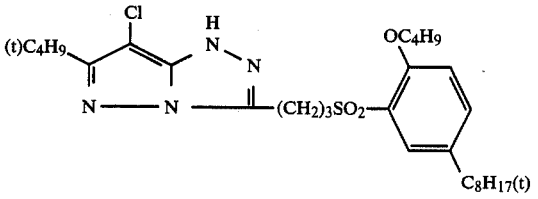
25
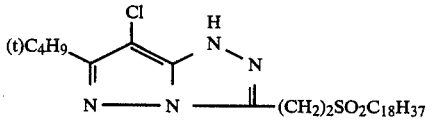
26
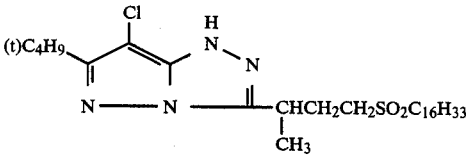
27
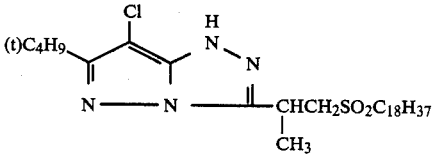

-continued
28
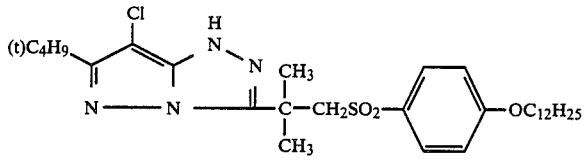
29
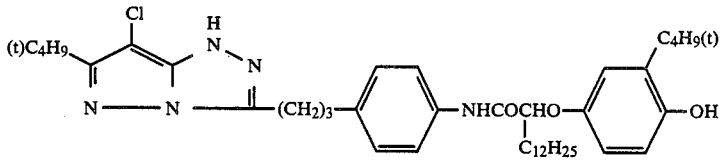
30
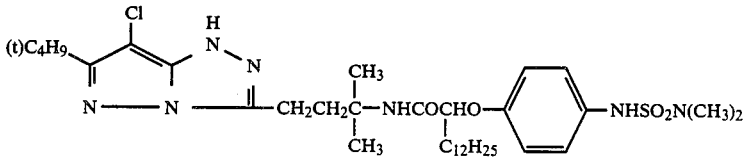
31
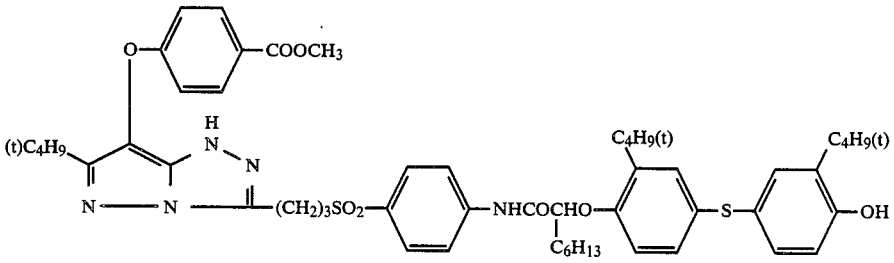
32
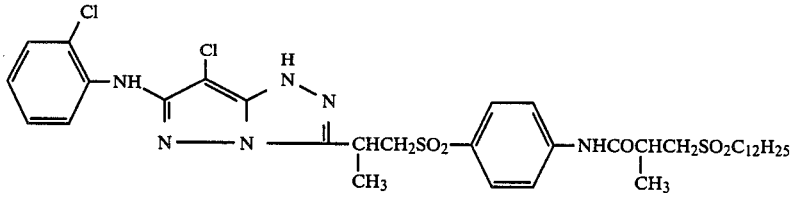
33
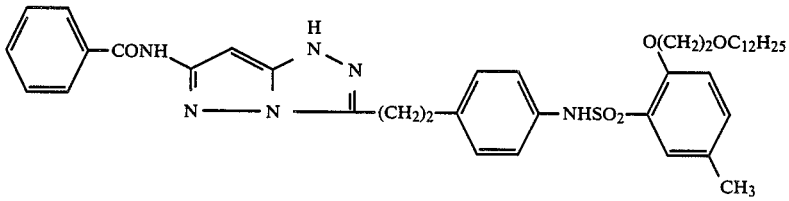
34
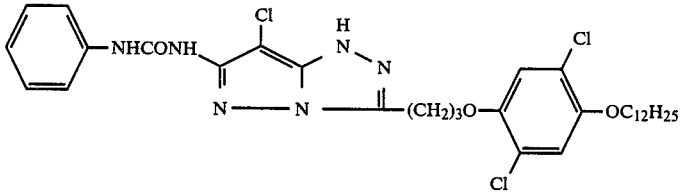
35
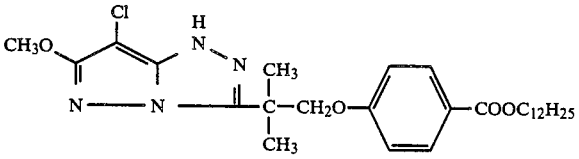

-continued
36
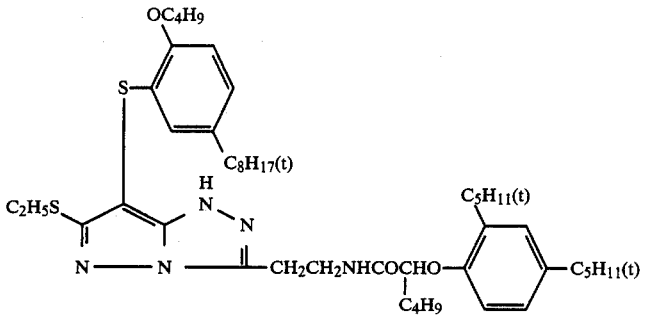
37
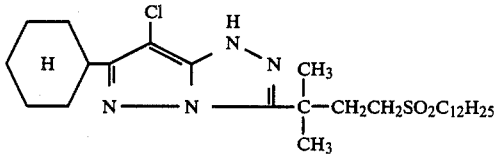
38
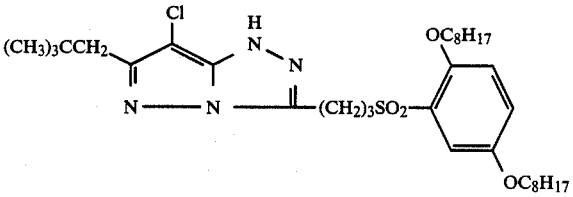
39
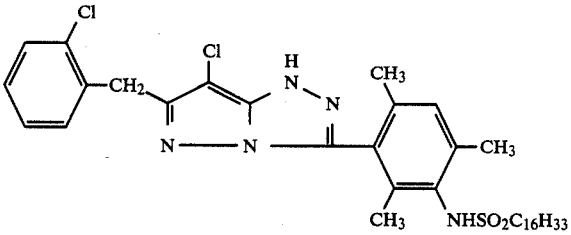
40
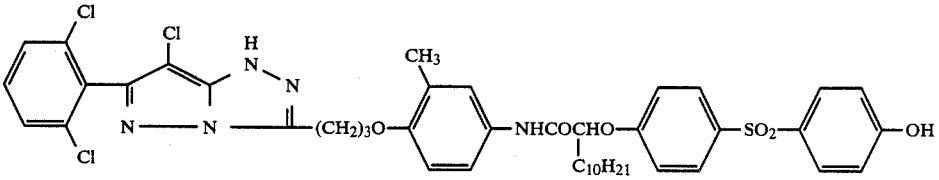
41
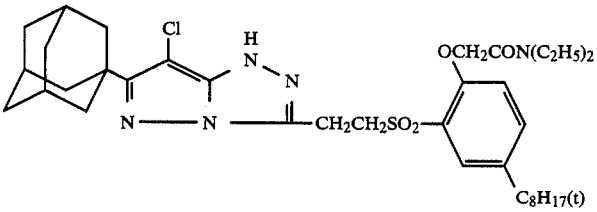
42
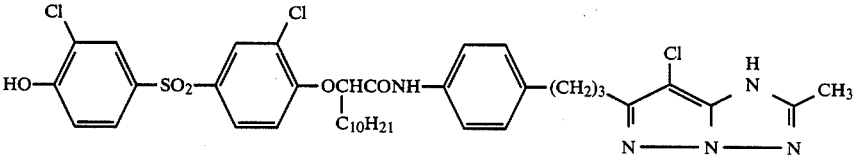

-continued
43
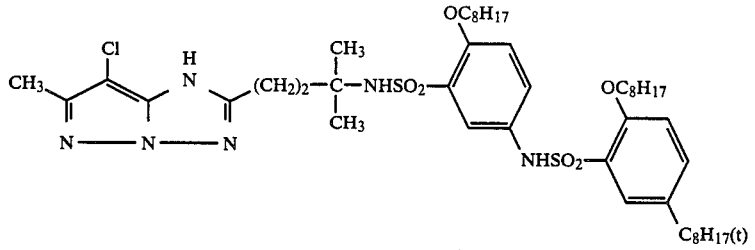
44
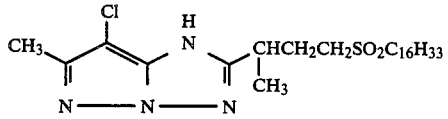
45
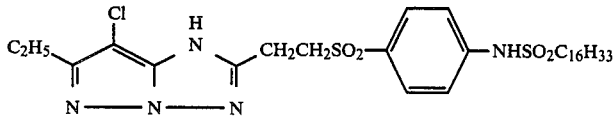
46
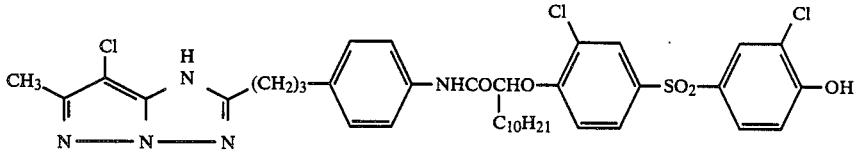
47
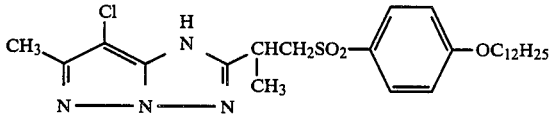
48
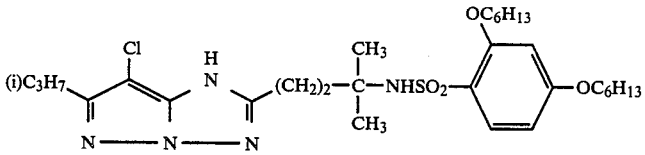
49
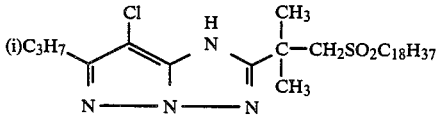
50
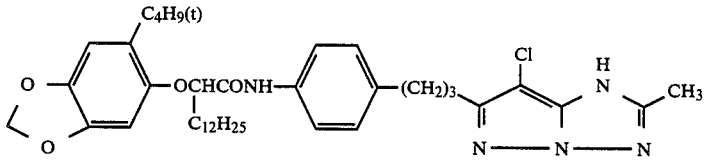
51
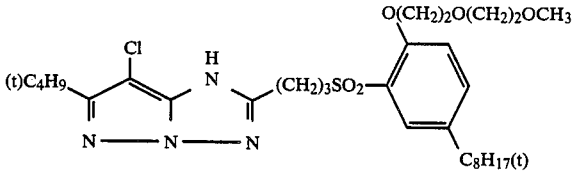
52
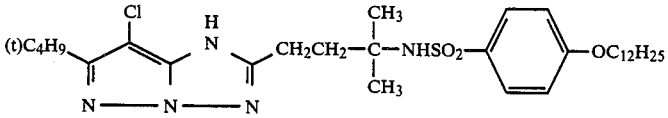

-continued

53

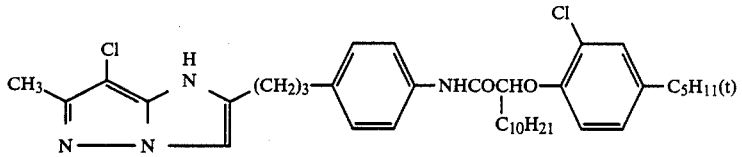

54

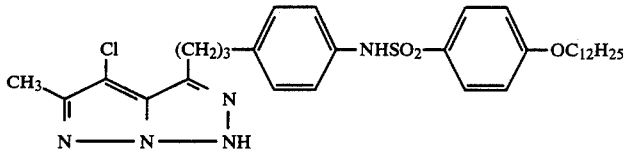

55

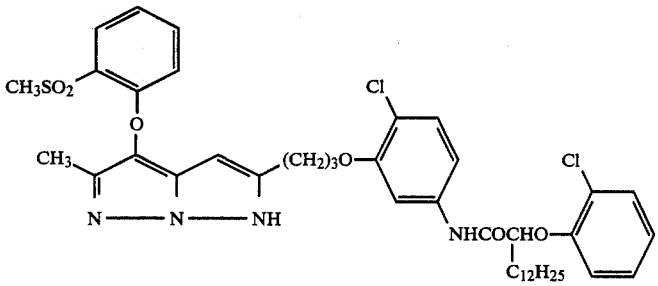

56

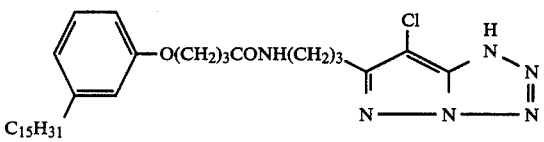

57

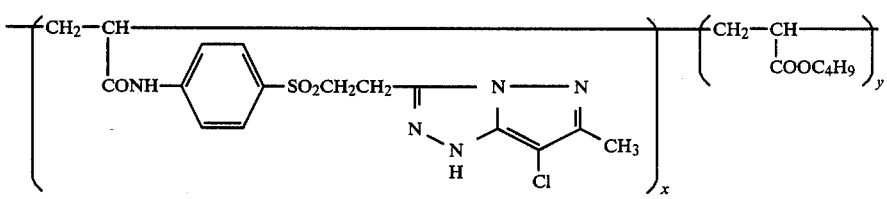

x:y = 50:50

58

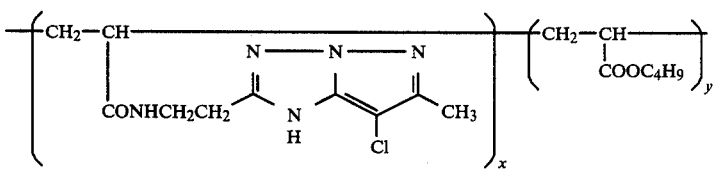

x:y = 50:50

Aside from the above typical examples, other examples of the compounds represented by Formula [M-I] suitably usable in this invention include those compounds Nos. 1 through 4, 6, 8 through 17, 19 through 43, 45 through 59, 61 through 104, 106 through 121, 123 through 162, and 164 through 223 described in p.p. 66 to 122 of Japanese Patent Application No. 9791/1986.

The above couplers may be synthesized by making reference to the Journal of the Chemical Society, Perkin I (1977), 2047-2052, U.S. Pat. No. 3,725,067, Japanese Patent O.P.I. Publication Nos. 42045/1983, 162548/1984, 171956/1984, 33552/1985, 43659/1985, 172982/1985, 190779/1985, and the like.

Any of the above couplers of Formula [M-I] may be used in the quantity range of from $1\times10^{-3}$ to 1 mole per mole of the silver halide which is present in the emulsion containing the coupler, and more preferably from $1\times10^{-2}$ to $8\times10^{-1}$ mole.

These couplers may be used along with other different magenta couplers.

In the photographic material relating the invention a compound which reacts with the oxidized product of a color developing agent but provides no image density; i.e., DP' scavenger can be used. Examples of the compound are those hydroquinone derivatives (Formula (H)), pyrogallol derivatives, catechol derivatives and resorcinol derivatives (Formula (P)), sulfonylamino derivatives (Formula (S)), and coupling-type compounds (Formula (Cs)):

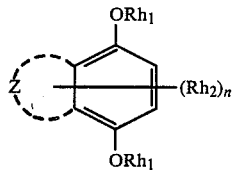

Formula (H)

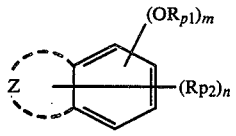

Formula (P)

wherein $Rh_1$ and $Rp_1$ each is a hydrogen atom, an aliphatic or acyl group, provided that the $Rh_1$ and $Rp_1$ may be either the same or different; m of Formula (P) is 2 or 3, provided, where m is equal to 2, one of the two $ORp_1$ is in the o-position and the other is in the m-position and, where m is 3, the three $ORp_1$s are combined with the benzen ring in positions adjacent to one another; $Rh_2$ and $Rp_2$ each is a monovalent group, provided that the $Rh_2$ and $Rp_2$ may be either the same or different; n is an integer of zero to 6; and —Z— implies that it, along with the benzen ring, may form a naphthalene ring.

The aliphatic group represented by the $Rh_1$ or $Rp_1$ includes those having a substituent, such as an alkyl group or alkenyl group, or the like.

The acyl group represented by the $Rh_1$ or $Rp_1$ is, for example, an alkylcarbonyl group or arylcarbonyl group. The monovalent group is, for example, a halogen atom, an aliphatic group, cycloalkyl group, aromatic group, alkylthio group, carbamoyl group, cyano group, formyl group, aryloxy group, acyloxy group, carboxyl group or a salt thereof, sulfo group or a salt thereof, alkoxycarbonyl group, cycloalkoxycarbonyl group, aryloxycarbonyl group, $CORh_3$, $CORp_3$, $SO2Rh_4$, $SO2Rp_4$, $CONHRh_5$, $CONHRp_5$, or $NHCORh_6$, $NHCORp_6$, wherein $Rh_3$, $Rp_3$, $Rh_4$, $Rp_4$, $Rh_5$, $Rp_5$, and $Rh_6$, $Rp_6$ represent aliphatic groups, aromatic groups and heterocyclic group, respectively.

The following are examples representative of the compound represented by Formula (H):

H-1

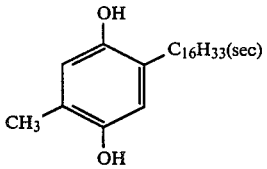

H-2

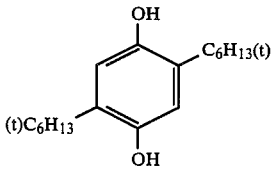

-continued

H-3

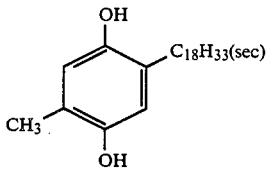

H-4

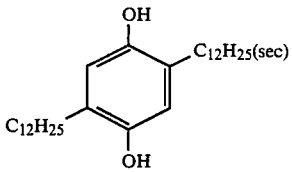

H-5

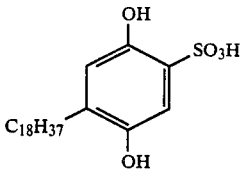

H-6

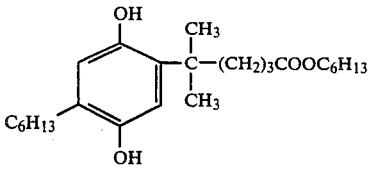

H-7

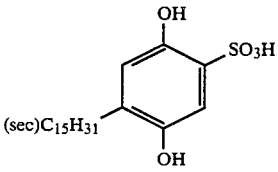

H-8

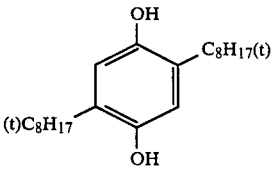

H-9

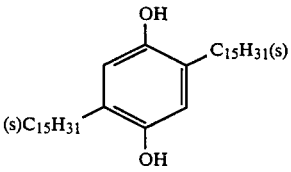

And the following are examples representative of the compound represented by Formula (P).

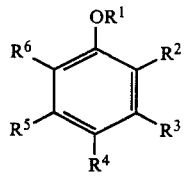

| Cpd. | $R^1$ | $R^2$ | $R^3$ | $R^4$ | $R^5$ | $R^6$ |
|---|---|---|---|---|---|---|
| P-1 | H | —OH | H | $-C_4H_9(t)$ | H | H |
| P-2 | H | —OH | H | 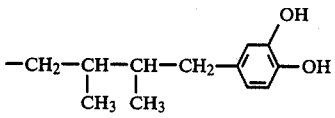 | H | H |
| P-3 | H | —OH | H | H | $C_8H_{17}(t)$ | H |
| P-4 | H | H | —OH | $-SO_3NH_4$ | H | H |
| P-5 | H | H | —OH | $C_8H_{17}$ | H | H |
| P-6 | H | OH | H | $COOC_{12}H_{25}$ | H | OH |
| P-7 | H | OH | H | $COOC_3H_7(iso)$ | H | OH |
| P-8 | H | OH | H | $CONHC_{12}H_{25}$ | H | OH |
| P-9 | H | OH | H | $CONH(CH_2)_3OC_{18}H_{37}$ | H | OH |
| P-10 | H | $OCH_3$ | H | COOH | H | $OCH_3$ |
| P-11 | H | $OCH_3$ | H | $COOC_{12}H_{25}$ | H | $OCH_3$ |

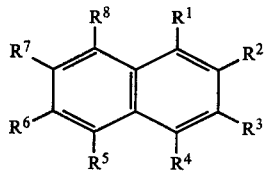

| Cpd. | $R^1$ | $R^2$ | $R^3$ | $R^4$ | $R^5$ | $R^6$ | $R^7$ | $R^8$ |
|---|---|---|---|---|---|---|---|---|
| P-12 | OH | OH | $C_2H_5$ | H | H | H | H | H |
| P-13 | OH | OH | H | $C_4H_9(t)$ | H | H | H | H |
| P-14 | OH | OH | H | H | H | $CH_3$ | H | H |
| P-15 | OH | OH | H | H | H | H | $C_{12}H_{25}$ | H |
| P-16 | OH | OH | H | H | H | H | H | $C_2H_5$ |
| P-17 | $C_4H_9(t)$ | OH | OH | H | H | H | H | H |
| P-18 | H | OH | OH | H | $CH_3$ | H | H | H |
| P-19 | H | OH | OH | H | H | H | $C_8H_{17}$ | H |
| P-20 | OH | $C_5H_{11}$ | OH | H | H | H | H | H |
| P-21 | OH | H | OH | $CH_3$ | H | H | H | H |
| P-22 | OH | H | OH | $C_4H_9(t)$ | H | H | H | H |

Formula (S)

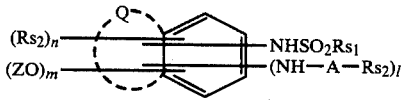

wherein A represents —CO— or —$SO_2$—; $Rs_1$ and $Rs_2$ each is an alkyl, aryl, heterocyclic or amino group; Z is a hydrogen atom or a group which is decomposed by an alkali to split off; is 1 or 2, provided that, when is 2, each NH—A—$Rs_2$ may be either the same or different; m is zero or 1; at least one of the —NH—A—$Rs_2$ and —OZ is combined in the ortho or para position with respect to the —$NHSO_2Rs_1$, wherein $Rs_2$ is a substituent; n is zero to 6, provided that, when n is from 2 to 6, each $Rs_2$ may be either the same or different; —Q— implies that it, along with the benzene ring, may form a naphthalene ring.

In Formula (S), the alkyl group represented by the $Rs_1$ or $Rs_2$ may be either straight-chain or branched-chain, and is preferably one having from 1 to 30 carbon atoms.

The aryl group represented by the $Rs_1$ or $Rs_2$ is preferably one having from 6 to 30 carbon atoms.

The heterocyclic group represented by the $Rs_1$ or $Rs_2$ is preferably one having at leas one of O and N as hetero atoms and having from 5 to 30 carbon atoms.

The amino group represented by the $Rs_1$ or $Rs_2$ includes those substituted by an alkyl or aryl group.

In the group splittable by alkali-decomposition represented by the Z, the hydrogen atom of the hydroxyl group is substituted by a blocking group that is to be removed when coming into contact with an alkali. A typical blocking group is a group removable by hydrolysis or by intramolecular nucleophilic reaction. Typical groups removable by hydrolysis are acyl groups such as, e.g., aliphatic and aromatic carbonyl and sulfonyl groups. Typical examples of the group removable by intramolecular nucleophilic reaction are described in U.S. Pat. No. 4,310,612. The group represented by the $Rs_2$ includes those having a substituent.

Those compounds having Formula (S) can be synthesized in accordance with methods of the prior art. For the synthesis reference can be made to Japanese Patent O.P.I. Publication Nos. 5247/1984, 192247/1984, 195239/1984, 204040/1984, 108843/1985 and 118836/1985.
The following are exemplified compounds of the sulfonylamino-type DP' scavenger:
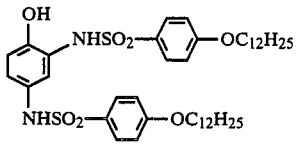
S-1
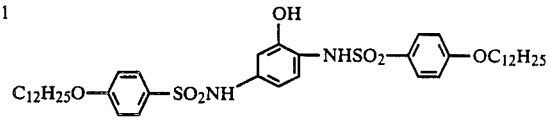
S-2
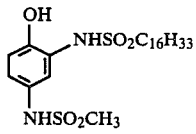
S-3
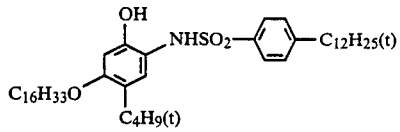
S-4
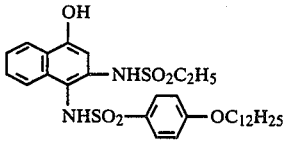
S-5
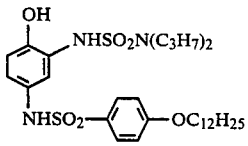
S-6
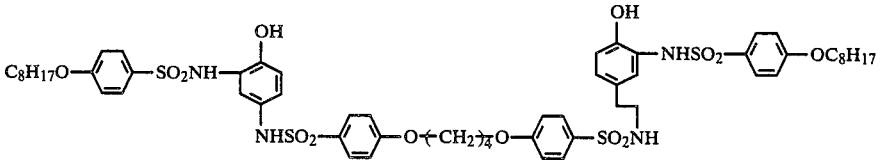
S-7
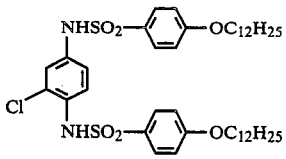
S-8
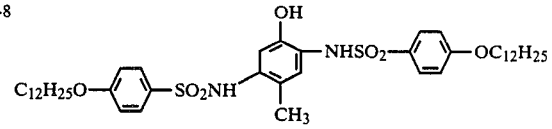
S-9
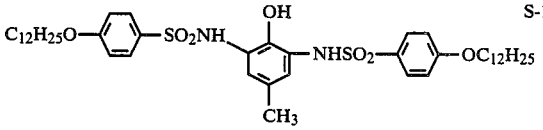
S-10
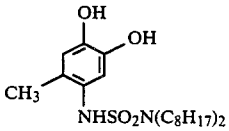
S-11
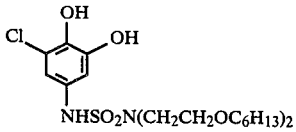
S-12
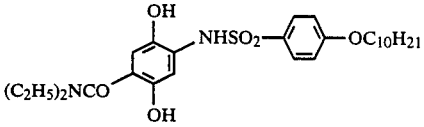
S-13
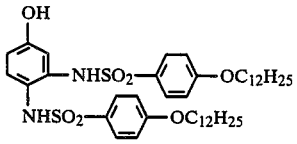
S-14
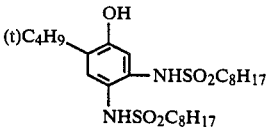
S-15
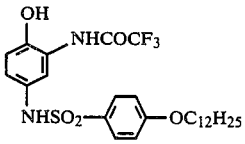
S-16
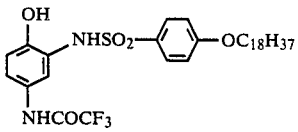
S-17

-continued

S-18

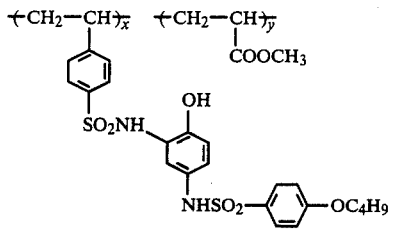

x:y = 53:47

S-19

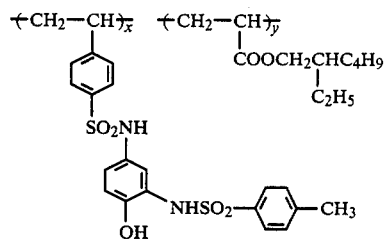

x:y = 65:35

The coupling-type DP' scavenger compounds represented by Formula (Cs) include those of the following types:

(1) Couplers wherein the dye formed by the coupling reaction with the oxidized product of a color developing agent is dissolved out into the processing solution.

(2) Couplers which effect the coupling reaction thereof with the oxidized product of a color developing agent but remain in the leuco form.

(3) Couplers wherein the dye formed by the coupling reaction with the oxidized product of a color developing agent shows no significant visible ray absorption and provides a substantially colorless product.

Accordingly, the compounds having Formula (Cs) are further subdivided into those represented by the following Formulas (Cs-I) through (Cs-XIII).

Also, those represented by Formulas (Cs-I) through (Cs-XIII) are a group of particularly preferred DP' scavengers in this invention.

Those compounds belonging to the above (1) may be represented by, for example, the following Formula (Cs-I):

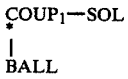

Formula (Cs-I)

wherein $COUP_1$ is a coupler mother nucleus having a coupling position (marked with *); BALL is a group which is combined with the $COUP_1$ in the coupling position thereof and splittable from the $COUP_1$ by the reaction with the oxidized product of a color developing agent and which is also a stabilization group having such a magnitude and form as to make the compound of Formula (Cs-I) nondiffusible; and SOL is a solubilization group which is combined with the $COUP_1$ in the coupling position thereof and which, during or after the color development, provides transferability to the coupling product produced by the coupling reaction with the oxidized product of a color developing agent so as to dissolve out of the light-sensitive material system.

The coupler mother nucleus represented by the $COUP_1$ includes any of these coupler mother nuclei known to or used by those skilled in the art for use in the formation of colored or colorless reaction products by the coupling reaction with the oxidized product of a color developing agent.

BALL is a stabilization group having such a magnitude and form as to make the compound having Formula (Cs-I) nondiffusible, and useful examples thereof, although not restricted as long as it provides nondiffusibility to the compound of Formula (Cs-I), include those alkyl, aryl and heterocyclic groups having from 8 to 32 carbon atoms.

These groups include those having a substituent that increases the nondiffusibility of, changes the reactability of, or causes the coupling reaction of the compound of Formula (Cs-I), and, after splitting off, increases the diffusibility of the BALL. Further, as the BALL such one is also preferred that is combined through a linkage group with the $COUP_1$ in the coupling position thereof.

The solubilization group represented by the SOL is a group that makes the coupling product produced by the coupling reaction with the oxidized product of a color developing agent so transferable as to dissolve out of the light-sensitive materials system, and examples of the group includ ionizable hydroxyl, carboxyl, sulfo and aminosulfonyl groups and ionizable salts and esters and ethers thereof, and the like.

Those compounds wherein one or two or more of these groups are combined with the $COUP_1$ in the noncoupling position thereof are also preferred, or wherein a solubilization group in which, for example, an alkyl group having from 1 to 10 carbon atoms or an aryl group having from 6 to 12 carbon atoms, having one or two or more of the above ionizable groups, is combined with the $COUP_1$ in the noncoupling position thereof may also be advantageously used.

Also, those in which such groups are combined through a linkage group with the foregoing $COUP_1$ in the noncoupling position thereof are preferred.

The particularly preferred solubilization groups include those alkyl groups having from 1 to 10 carbon atoms or aryl groups having from 6 to 12 carbon atoms containing a carboxyl, sulfo or ionizable salts thereof directly combined to the noncoupling position of $COUP_1$ or one or two or more carboxyl or sulfo groups or ionizable salts thereof combined directly or through an amino or carbonyl group to the noncoupling position of $COUP_1$.

Further, the suitably usable soluble yellow, magenta and cyan dye-formable DP' scavengers may be represented by the following Formulas (Cs-II) through (Cs-VII):

[Soluble Yellow Dye-Formable Compounds]

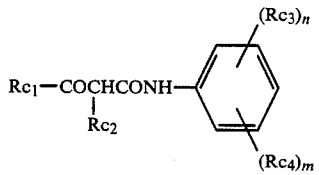

Formula (Cs-II)

wherein $Rc_1$ is an aryl or alkyl group (particularly tertiary alkyl group); $Rc_2$ is the foregoing stabilization group (BALL); $Rc_3$ is the foregoing solubilization group (SOL); $Rc_4$ is a hydrogen atom or a halogen atom, an alkyl or alkoxy group; and n+m is equal to or less than 5 (provided that $n \neq 0$, $m \neq 0$, and, when n and m each is not less than 2, they may be either the same or different).

[Soluble Magenta Dye-Formable Compounds]

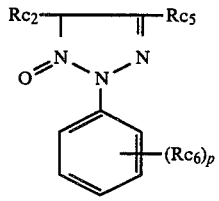

Formula (Cs-III)

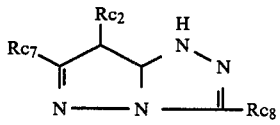

Formula (Cs-IV)

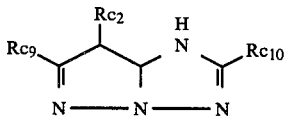

Formula (Cs-V)

In Formulas (Cs-III), (Cs-IV) and (Cs-V), $Rc_2$ is as defined in the $Rc_2$ of the foregoing Formula (Cs-II); $Rc_5$ is a solubilization group (SOL); $Rc_6$ is a hydrogen atom, a halogen atom, an alkyl, alkoxy or amino group; p is equal to or less than 5 (provided $p \neq 0$, and when p is not less than 2; the $Rc_6$s may be either the same or different); either one of $Rc_7$ and $Rc_8$ is a solubilization group (SOL) and the other is a hydrogen atom, an alkyl, alkoxy, aryl or amino group; and $Rc_9$ and $Rc_{10}$ are as defined in the $Rc_7$ and $Rc_8$, respectively, of Formula (Cs-IV).

[Soluble Cyan Dye-Formable Compounds]

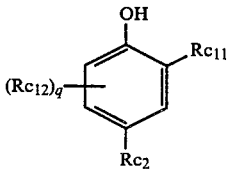

Formula (Cs-VI)

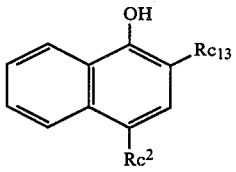

Formula (Cs-VII)

In Formulas (Cs-VI) and (Cs-VII), $Rc^2$ is as defined in the $Rc_2$ of Formula (Cs-II); at least one of $Rc_{11}$ and $Rc_{12}$ is the foregoing solubilization group (SOL) and the other is a hydrogen atom or a halogen atom, an alkyl, alkoxy or alkylamido group; q is equal to or less than 3 (provided $q \neq 0$); and $Rc_{13}$ is the foregoing solubilization group (SOL).

Unless otherwise stated in above, these alkyl, alkoxy and alkylamido groups each has from 1 to 8 carbon atoms, and aryl groups each has from 6 to 10 carbon atoms, and amino groups include primary, secondary and tertiary amino groups.

These substituents and stabilization groups (BALL) include those further substituted by such a substituent as a halogen atom, a hydroxyl, carboxyl, amino, amido, carbamoyl, sulfamoyl, sulfonamido, alkyl, alkoxy or aryl group.

Examples of the compound that belongs to the foregoing (2) include those having the following Formula (Cs-VIII):

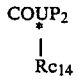

Formula (Cs-VIII)

wherein $COUP_2$ is as defined in the $COUP_1$ of Formula (Cs-I); $Rc_{14}$ is a group that is combined with the $COUP_2$ in the coupling position thereof and is unable to split off by the reaction of the coupler of Formula (Cs-VIII) with the oxidized product of a color developing agent.

The mother nucleus of the coupler represented by the $COUP_2$ includes those coupler mother nuclei mentioned in Formula (Cs-I).

Examples of the group represented by the $Rc_{14}$ include alkyl, substitued alkyl, aryl, substitued aryl, alkenyl, cyano and the like groups.

The preferred compounds having Formula (Cs-VIII) are those made nondiffusible by an alkyl, aryl or heterocyclic group having from 8 to 32 carbon atoms which is combined with the coupler mother nucleus represented by the $COUP_2$ in the noncoupling position thereof.

Examples of the compound which belongs to the foregoing (3) include those having the following Formula (Cs-IX):

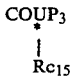

Formula (Cs-IX)

wherein $COUP_3$ is a coupler mother nucleus which produces a substantially colorless product by the coupling reaction thereof with the oxidized product of a color developing agent; and $Rc_{15}$ is a group which is combined with the $COUP_3$ in the coupling position thereof and splittable from the $COUP_3$ as a result of the coupling reaction with the oxidized product of a color developing agent.

The more preferred among those compounds having Formula (Cs-IX) are those represented by the following Formulas (Cs-X) through (Cs-XIII):

Formula (Cs-X)

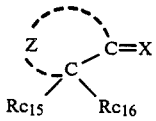

wherein $Rc_{15}$ is as defined in the $Rc_{15}$ of Formula (Cs-IX); $Rc_{16}$ is a hydrogen atom, a halogen atom, an alkyl, aryl, alkoxy, acyloxy or heterocyclic group; X is a oxygen atom or $=N-Rc_{17}$, wherein $Rc_{17}$ is an alkyl, aryl, hydroxyl, alkoxy or sulfonyl group; and Z is a group of nonmetallic atoms necessary to form a 5- to 7-member carbocyclic ring (such as indanone, cyclopentanone, cyclohexanone, etc.) or a heterocyclic ring (such as piperidone, pyrrolidone, hydrocarbostyryl, etc.).

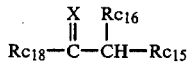

Formula (Cs-XI)

wherein $Rc_{15}$, $Rc_{16}$ and X are as defined in the $Rc_{15}$, $Rc_{16}$ and X, respectively, of Formula (Cs-X); $Rc_{18}$ is an alkyl, aryl, heterocyclic cyano, hydroxyl, alkoxy, aryloxy, heterocyclic oxy, alkylamino, dialkylamino or anilino group.

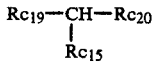

Formula (Cs-XII)

wherein $Rc_{15}$ is as defined in the $Rc_{15}$ of Formula (Cs-IX): and $Rc_{19}$ and $Rc_{20}$ are either the same or different, and each is an alkoxycarbonyl, carbamoyl, acyl, cyano, formyl, sulfonyl, sulfinyl, sulfamoyl or ammonium group or

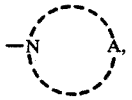

wherein A is a group of nonmetallic atoms necessary to form a 5- to 7-member heterocyclic ring (such as phthalimido, triazole, tetrazole, etc.

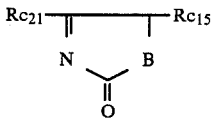

Formula (Cs-XIII)

wherein $Rc_{15}$ is as defined in the $Rc_{15}$ of Formula (Cs-IX); $Rc_{21}$ is an alkyl, aryl, anilino, alkylamino or alkoxy group; and B is an oxygen atom, a sulfur atom or a imino group.

Those compounds represented by Formulas (Cs-I) through (Cs-XIII) may be synthesized in accordance with those methods as described in Japanese Patent O.P.I. Publication Nos. 113440/1984, 171955/1984 and 82423/1977, British Pat. Nos. 914,145 and 1,284,649, U.S. Pat. Nos. 2,742,832, 3,227,550, 3,928,041, 3,958,993, 3,961,959, 4,046,574, 4,052,231, 4,149,886, and the like.

The following are examples representative of the coupling-type DP' scavenger, but the invention is not limited thereto.

Exemplified Compounds of Type (1)

Cs-1

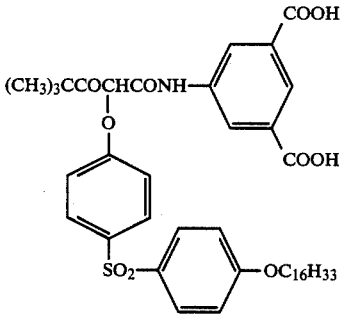

Cs-2

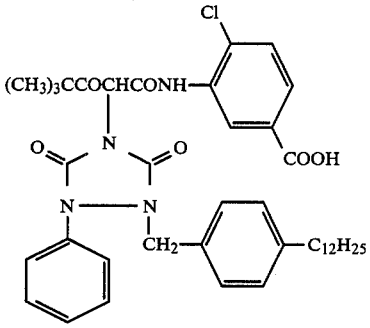

Cs-3

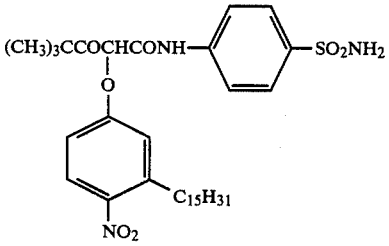

Cs-4

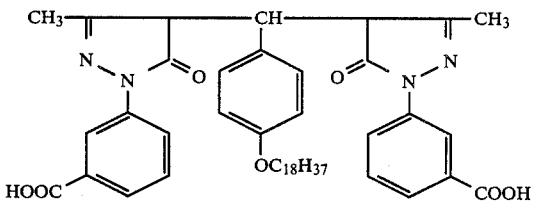

Cs-5

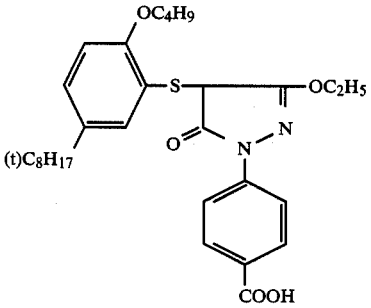

Cs-6

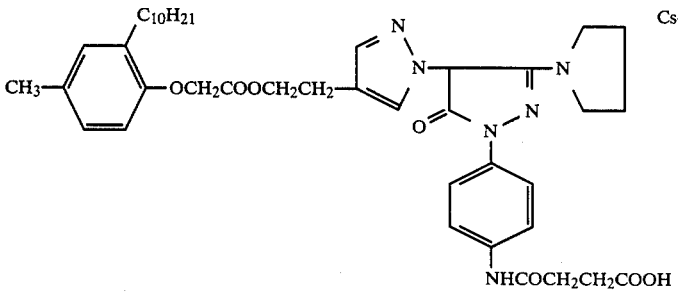

-continued
Exemplified Compounds of Type (1)
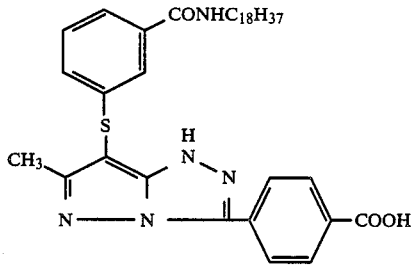
Cs-7
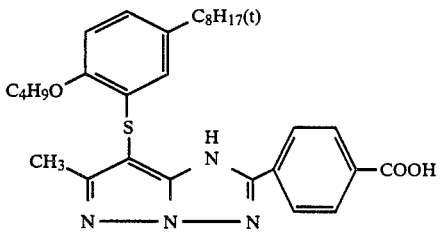
Cs-8
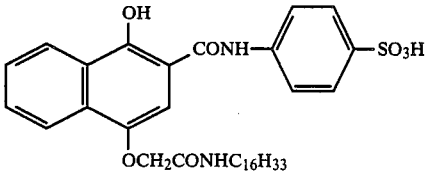
Cs-9
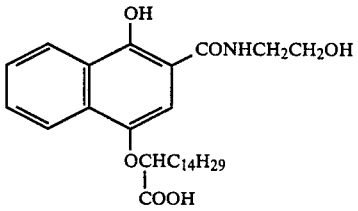
Cs-10
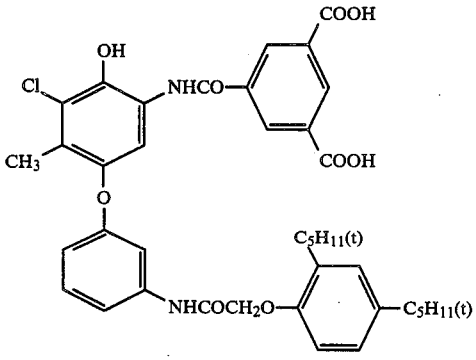
Cs-11
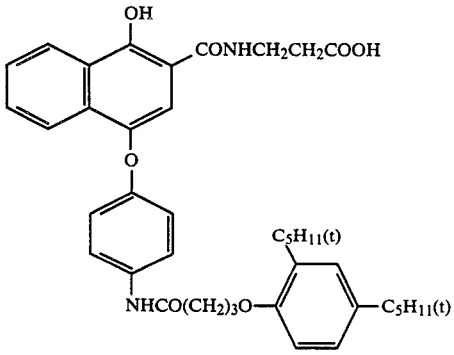
Cs-12
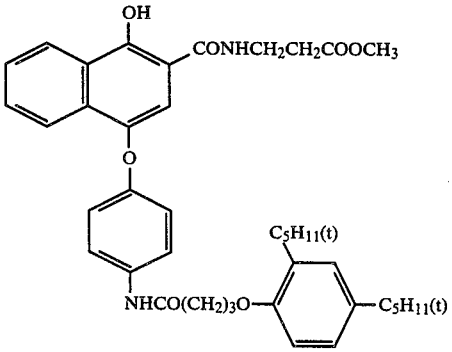
Cs-13
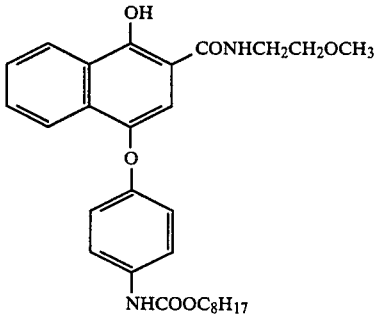
Cs-14
Exemplified Compounds of Type (2)
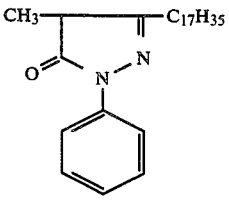
Cs-15
-continued
Exemplified Compounds of Type (2)
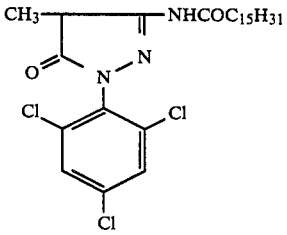
Cs-16

-continued

Exemplified Compounds of Type (2)

Cs-17

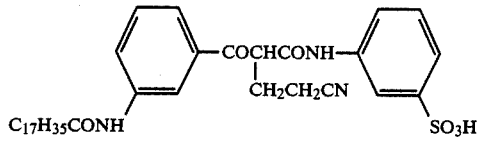

Exemplified Compounds of Type (3)

Cs-18

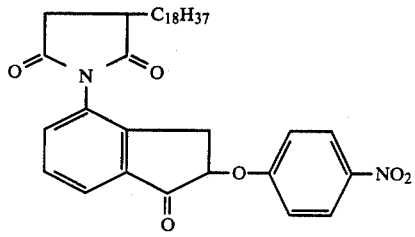

Cs-19

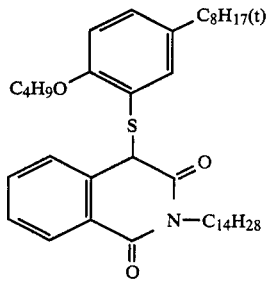

Cs-20

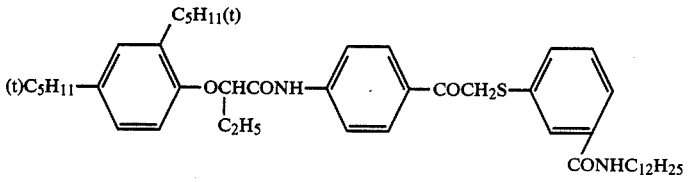

Cs-21

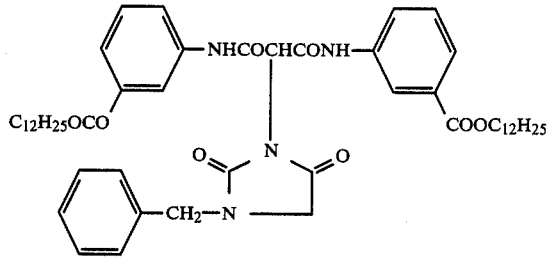

Cs-22

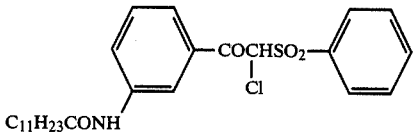

Cs-23

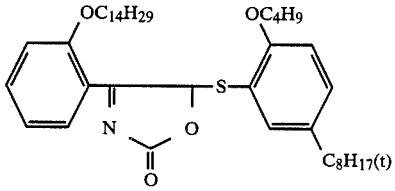

It is most desirable to directly add the DP' scavenger to a silver halide emulsion layer to thereby incorporate it into the emuslsion. The DP' scavenger may also be added to nonlight-sensitive layers such as intermediate layers, protective layer, yellow filter layer, antihalation layer, and the like.

The adding amount of the DP' scavenger, when added to a silver halide emulsion layer, is in the range of preferably from $1\times10^{-6}$ mole to $1\times10^{-1}$ mole per $m^2$, and most preferably from $1\times10^{-5}$ mole to $2\times10^{-3}$ mole. The adding amount, however, may be appropriately selected according to the type of the compound to be used. Where the DP' scavenger is applied to those layers containing no silver halide, such as intermediate layers, protective layer, yellow filter layer, antihalation layer, and the like, the adding amount range is preferably from $1\times10^{-6}$ to $1\times10^{-2}$ mole per $m^2$, and more preferably from $1\times10^{-5}$ to $1\times10^{-3}$ mole.

The incorporation of the DP' scavenger may be carried out in accordance with those known methods as described in, e.g., U.S. Pat. No. 2,322,027, and the like.

Of these dye-forming couplers, DIR couplers, DIR compounds, image stabilizers, anticolorstain agent, ultraviolet absorbing agents, brightening agents, etc., which all need not be adsorbed to the silver halide crystal surface, those hydrophobic compounds may be dispersed by use of various methods such as the solid dispersion method, latex dispersion method, oil-in-water-type emulsification dispersion method, and the like. These methods may be appropriately selected to be used according to the chemical structure, and the like, of hydrophobic compounds such as couplers. As for the oil-in-water-type emulsification dispersion method, those conventional methods of the prior art for use in dispersing hydrophobic additives such as couplers may be used, which are such that a hydrophobic compound is dissolved usually in a high-boiling solvent having a boiling point of not less that about 150° C., if necessary, in combination with a low-boiling solvent and/or water-soluble organic solvent, and then emulsifiedly dispersed into a hydrophilic binder such as an aqueous gelatin solution using a surfactant by a dispersing means such as a stirrer, homogenizer, colloid mill, flow-jet mixer, ultrasonic disperser, and the like, and after that, the dispersed product is added to an objective hydrophilic colloid. After or upon the dispersion, a process of removing the low-boiling solvent may be inserted.

As the high-boiling solvent those organic solvents having a boiling point of not less than 150° C. which do not react with the oxidized product of a developing agent, such as phenol derivatives, phthalic acid alkyl esters, phosphoric acid esters, citric acid esters, benzoic acid esters, alkylamides, fatty acid esters, trimesic acid esters, and the like, may be A low-boiling or water-soluble organic solvent may be used in combination with or in place of the high-boiling solvent. Examples of the low-boiling and substantially water-insoluble organic solvent include ethyl acetate, propyl acetate, butyl acetate, butanol, chloroform, carbon tetrachloride, nitromethane, nitroethane, benzene, and the like. And examples of the water-soluble organic solvent include acetone, methyl-isobutyl ketone, β-ethoxyethyl acetate, methoxyglycol acetate, methanol, ethanol, acetonitrile, dioxane, dimethyl formamide, dimethyl sulfoxide, hexamethyl phosphoric triamide, diethylene glycol monophenylether, phenoxy ethanol, and the like.

Where dye-forming couplers, DIR couplers, DIR compounds, image stabilizers, anticolorstain agent, ultraviolet absorbing agents, brightening agents and the like have an acid group such as carboxylic acid, sulfonic acid, etc., they may be introduced in the aqueous alkaline solution form into a hydrophilic colloid.

Those usable as the dispersion aid for use in dispersing into water a solution of a hydrophobic compound dissolved in a single low-boiling solvent or in a combined low-boiling and high-boiling solvent by mechanical or ultrasonic means include anionic surfactants, nonionic surfactants, cationic surfactants and amphoteric surfactants.

In order to prevent the light-sensitive material from producing color contamination, being deteriorated in the image sharpness and getting the graininess roughend due to the transfer of the oxidized product of a developing agent or electron transfer agent between the emulsion layers (between the same color-sensitive layers and/or between different color-sensitive layers) of the light-sensitive material, an anticolorstain agent may be used.

The anticolorstain agent may be either incorporated into the emulsion itself or into an intermediate layer provided between emulsion layers.

The preferred as the anticolorstain agent include hydroquinone derivatives, aminophenol derivatives, gallic acid derivatives, ascorbic acid derivatives, and the like.

In the light-sensitive material using the silver halide emulsion of this invention, an image stabilizer may be used for preventing the produced dye image from being deteriorated.

The preferred compounds as the image stabilizer include, e.g., hydroquinone derivatives, gallic acid derivatives, phenol derivatives and bis compounds thereof, hydroxychraman and spiro compounds thereof, hydroxychroman and spiro compounds thereof, piperidine derivatives, aromatic amine compounds, benzodioxane derivatives, benzodioxonol derivatives, silicon atom-containing compounds, thioether compounds, and the like.

The light-sensitive material of this invention may contain in the hydrophilic colloid layers thereof such as the protective layer, intermediate layers and the like an ultraviolet absorbing agent for the purpose of preventing them from producing fog due to the charging by friction or preventing the resulting dye image from being deteriorated by UV rays.

The light-sensitive material may use a formalin scavenger in order to prevent the deterioration of the magenta dye-forming coupler and the like due to formalin during the storage of the light-sensitive matrial.

Where a dye or ultraviolet absorbing agent is incorporated into the hydrophilic colloid layers of the light-sensitive material, they may be mordanted by a mordant such as a cationic polymer.

To the silver halide emulsion layers and other hydrophilic colloid layers of the light-sensitive material may be added compounds for altering the developability such as a development accelerator, development retarder, and the like, or a bleaching accelerator.

The preferred compounds suitably usable as the development accelerator are those compounds as described in RD 17643, Item XXI B-D, and usable as the development retarder are those as described in RD 17643, Item XXI E. For accelerating development or for other purposes, a black-and-white developing agent and/or the precursor thereof may also be used.

For the purpose of increasing the sensitivity and contranst and also for accelerating the development, the emulsion layers of the light-sensitive material may contain any of additives such as polyalkylene oxides or ethers or esters or derivatives such as amines, thioether compounds, thiomorpholines, quaternary ammonium compounds, urethane derivatives, urea derivatives, imidazole derivatives or the like.

A brightening agent may be used in the light-sensitive material for the purpose of emphasizing the whiteness of the white background and at the same time for making the stain in the white background inconspicuous. Those compounds suitably usable as the brightening agent are described in RD 17643, Item V.

The light-sensitive material may be provided with auxiliary layers such as filter layers, an antihalation layer, and an antiirradiation layer. These layers and/or emulsion layers may contain a dye which is to be dissolved out or bleached in the course of the processing. Examples of such the dye include oxonol dyes, hemioxonol dyes, styryl dyes, merocyanine dyes, cyanine dyes, azo dyes, and the like.

The silver halide emulsion layers and/or other hydrophilic colloid layers of the light-sensitive material may contain a matting agent for reducing the gloss of the light-sensitive material, improving the ease of retouching, preventing the stickiness of sheets of the light-sensitive material to each other, and the like.

A lubricant may be added to the light-sensitive material for the purpose of reducing the sliding friction.

To the light-sensitive material may be added an antistatic agent for the purpose of preventing static electricity. The antistatic agent may be used in the antistatic layer provided on the nonemulsion-layer side of the support of the light-sensitive material, and may also be used in the emulsion layer and/or in the nonemulsion protective colloid layer on the emulsion layer-coated side of the support. The suitably usable compounds as the antistatic agent are those as described in RD 17643, XIII.

Various surface active agents may be used in the photographic emulsion layers and/or other hydrophilic colloid layers of the light-sensitive material for the purpose of improving the coatability, preventing static electricity, and improving the sliding friction, emulsification dispersion, photographic characteristics such as development acceleration, increasing contrast, sensitization, and the like.

Materials usable as the support of the light-sensitive material of this invention include elastic reflective support materials such as paper laminated with or synthetic paper of α-olefin polymers such as polyethylene, polypropylene, ethylene/butene copolymer and the like; film made of semisynthetic or synthetic high-molecular materials such as cellulose acetate, cellulose nitrate, polystyrene, polyvinyl chloride, polyethylene terephthalate, polycarbonate, polyamides, and the like; and those elastic support materials produced by providing a reflective layer on these films, glass plates, metallic or earthenware materials, and the like.

The hydrophilic colloid layer of the light-sensitive material, after the support surface is at need subjected to a corona discharge, ultraviolet ray irradiation or frame treatment, may be coated directly on the support or coated on the support through one or more subbing layers for improving the surface adherence, property of preventing static electricity, dimensional stability, wear resistance, and/or other properties of the support.

A viscosity-increasing agent may be used in the coating of the light-sensitive material for the purpose of improving the coatability. In addition, in the coating, those additives which, if in advance added to the coating liquid, tend to cause gelling before coating because of being fast reactive, such as, for example, hardeners, are desirable to be mixed by means of a static mixer or the like into the coating liquid immediately before the coating.

As for the coating method, the extrusion coating method and curtain coating method which are capable of coating two or more layers simultaneously are particularly useful, and the packet coating method may also be used according to purposes. In these coating methods, the coatin speed may be arbitrarily selected.

The exposure of the light-sensitive material of this invention may be made by using electromagnetic waves in the spectral regions to which the emulsion layers constituting the light-sensitive material of this invention are sensitive. The light-sensitive material may be exposed to any known light sources including natural light (sunright), tungsten lamp light, fluorescent lamp light, mercury-vapor lamp light, xenon arc light, carbon arc light, xenon flash light, cathode-ray tube flying spot, various laser lights, light-emitting diode light, lights released from phosphors excited by electron beam, X rays, γ rays, α rays, and the like.

Exposure time may be in a very wide range of from much shorter exposure time than 1 microsecond such as from 100 nanosecond to 1 microsecond by use of, e.g., a cathode-ray tube or xenon flash light, not to speak of from 1 millisecond to 1 second usually used in ordinary cameras, to much longer exposure time than one second. The exposure is allowed to be made continuously or intermittently.

EXAMPLES

The present invention will be illustrated in detail by the following examples, but the embodiment of the invention is not limited to and by the examples.

EXAMPLE-1

A high-speed silver iodobromide emulsion for radiography use (containing 2.0 mole % silver iodide) was chemically ripened by the gold and sulfur sensitization method up to the time when the maximum sensitivity was obtained, and to this was added 1.0 g of 4-hydroxy-6-methyl-1,3,3a,7-tetrazaindene per mole of silver halide, and then the ripening was stopped.

Subsequently, the emulsion was divided into two equal parts. One part was reserved for comparative blank, and to the other were added compounds of this invention and comparative compounds, as shown in Table 1, to be adequately adsorbed thereinto, and appropriate amounts of saponin as a coating aid and of formalin as a hardening agent, whereby an emulsion was prepared.

The obtained emulsion was coated uniformly on a subbed polyester base support so that the coating silver amount was 3 g/m$^2$, and then dried, whereby samples (No. 1 through No. 14) were prepared.

From the thus prepared photographic materials three different groups of samples were prepared: those allowed to stand for two days at room temperature, regarded as fresh samples; those forcibly aged for two days under the condition of a temperature of 65° C. with a relative humidity of 7%; and those forcibly deteriorated by being placed under the condition of a temperature of 50° C. with a relative humidity of 80%.

After that, each sample was exposed through an ordinary sensitometric wedge, developed for 30 seconds at 35° C. in the following Processing Solution A, fixed and washed and then dried, and subsequently subjected to sensitometry tests. Processing Solution [A] (for radiographic light-sensitive materials)

| | |
|---|---|
| 1-phenyl-3-pyrazolidone | 1.5 g |
| Hydroquinone | 30.0 g |
| 5-nitroindazole | 0.25 g |
| Potassium bromide | 5.0 g |
| Anhydrous sodium sulfite | 55.0 g |
| Potassium hydroxide | 30.0 g |
| Boric acid | 10.0 g |
| Glutaraldehyde (25%) | 5.0 g |
| Add water to made 1 liter. | |

The obtained results are shown in the following Table 1, wherein each fog value is a base density-deducted value, and each sensitivity value is a relative speed value to the speed of Comparative Blank Sample 1 regarded as 100, based on the sensitivity found in the position of fog+0.5, and each gamma value is the inclination of the straight line portion of a characteristic curve.

TABLE 1

| Sample No. | Antifoggant | Adding amt. (mg/mol AgX) | Left for 2 days | | | 65° C./RH 7% 2 days | | | 50° C./RH 80% 2 days | | |
|---|---|---|---|---|---|---|---|---|---|---|---|
| | | | Fog | Speed | Gamma | Fog | Speed | Gamma | Fog | Speed | Gamma |
| 1 (Comp.) | — | — | 0.18 | 100 | 2.7 | 0.28 | 83 | 2.4 | 0.25 | 85 | 2.5 |
| 2 (Inv.) | Ex. cpd. 2 | 500 | 0.16 | 100 | 2.8 | 0.18 | 102 | 2.7 | 0.17 | 100 | 2.8 |
| 3 (Inv.) | Ex. cpd. 7 | 500 | 0.15 | 103 | 2.8 | 0.17 | 100 | 2.7 | 0.17 | 102 | 2.7 |
| 4 (Inv.) | Ex. cpd. 14 | 500 | 0.15 | 104 | 2.7 | 0.16 | 103 | 2.7 | 0.15 | 103 | 2.7 |

TABLE 1-continued

| Sample No. | Antifoggant | Adding amt. (mg/mol AgX) | Left for 2 days | | | 65° C./RH 7% 2 days | | | 50° C./RH 80% 2 days | | |
|---|---|---|---|---|---|---|---|---|---|---|---|
| | | | Fog | Speed | Gamma | Fog | Speed | Gamma | Fog | Speed | Gamma |
| 5 (Inv.) | Ex. cpd. 15 | 500 | 0.16 | 100 | 2.8 | 0.17 | 100 | 2.8 | 0.17 | 100 | 2.8 |
| 6 (Inv.) | Ex. cpd. 16 | 500 | 0.15 | 102 | 2.7 | 0.16 | 100 | 2.7 | 0.16 | 102 | 2.7 |
| 7 (Inv.) | Ex. cpd. 17 | 500 | 0.15 | 100 | 2.8 | 0.15 | 102 | 2.7 | 0.15 | 100 | 2.7 |
| 8 (Inv.) | Ex. cpd. 23 | 500 | 0.16 | 100 | 2.8 | 0.17 | 100 | 2.8 | 0.16 | 100 | 2.8 |
| 9 (Inv.) | Ex. cpd. 29 | 500 | 0.16 | 103 | 2.7 | 0.17 | 100 | 2.7 | 0.17 | 102 | 2.7 |
| 10 (Inv.) | Ex. cpd. 33 | 500 | 0.15 | 102 | 2.8 | 0.16 | 100 | 2.8 | 0.16 | 101 | 2.8 |
| 11 (Comp.) | Comp. a* | 30 | 0.16 | 100 | 2.6 | 0.26 | 80 | 2.5 | 0.23 | 87 | 2.5 |
| 12 (Comp.) | Comp. a | 500 | 0.15 | 65 | 2.3 | 0.20 | 67 | 2.3 | 0.18 | 65 | 2.2 |
| 13 (Comp.) | Comp. b* | 30 | 0.17 | 98 | 2.6 | 0.27 | 85 | 2.6 | 0.24 | 89 | 2.6 |
| 14 (Comp.) | Comp. b | 500 | 0.16 | 75 | 2.4 | 0.24 | 73 | 2.5 | 0.20 | 75 | 2.4 |

Note: 'Comp.': comparative, 'Inv.': this invention, 'Ex. cpd.': exemplified compound.
*Comparative Compound a and Comparative Compound b:
*Comparative Compound a

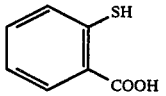

*Comparative Compound b

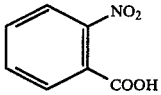

As is apparent from Table 1, Samples 2 through 10 for this invention, although they were aged under the severe conditions, are restrained from producing a fog and from deterioration of the gamma as compared to the comparative samples, and thus it is understood that the samples of this invention in improved in the stability in preservation.

EXAMPLE-2

On a cellulose triacetate film support were provided layers of the following compositions in the described order, whereby a multicolor light-sensitive material sample (comparative) was prepared.

Layer 1: Antihalation layer
A black colloidal silver-containing gelatin layer.
Layer 2: Intermediate layer
A gelatin layer
Layer 3: Red-sensitive low-speed emulsion layer
Silver iodobromide emulsion
Silver iodide: 5 mole %
Mean grain size: 0.5 μm
Coating amount of silver: 1.79 g/m$^2$
Sensitizing Dye I . . . $6\times10^{-5}$ mole per mole of silver
Sensitizing Dye II . . . $3\times10^{-3}$ mole per mole of silver
Cyan Coupler C-1 . . . 0.06 mole per mole of silver
Colored Cyan Coupler CC-1 . . . 0.003 mole per mole of silver
DIR Compound D-1 . . . 0.003 mole per mole of silver
Coating amount of tricresyl phosphate . . . 0.3 ml/m$^2$
Layer 4: Red-sensitive high-speed emulsion layer
Silver iodobromide emulsion
Silver iodide: 4 mole %
Mean grain size: 0.7 μm
Coating amount of silver: 1.4 g/m$^2$
Sensitizing Dye I . . . $3\times10^{-5}$ mole per mole of silver
Sensitizing Dye II . . . $1.2\times10^{-5}$ mole per mole of silver
Cyan Coupler C-1 . . . 0.0125 mole per mole of silver
Colored Cyan Coupler CC-1 . . . 0.0016 mole per mole of silver
Coating amount of tricresyl phosphate . . . 0.2 ml/m$^2$
Layer 5: Intermediate layer
The same as Layer 2
Layer 6: Green-sensitive low-speed emulsion layer
Silver iodobromide emulsion
Silver iodide: 4 mole %
Mean grain size: 0.5 μm
Coating amount of silver: 1.0 g/m$^2$
Sensitizing Dye III . . . $3\times10^{-5}$ mole per mole of silver
Sensitizing Dye IV . . . $1\times10^{-5}$ mole per mole of silver
Magenta Coupler M-1 . . . 0.08 mole per mole of silver
Colored Magenta Coupler CM-1 . . . 0.008 mole per mole of silver
DIR Compound D-1 . . . 0.0015 mole per mole of silver
Coating amount of tricresyl phosphate . . . 1.4 ml/m$^2$
Layer 7: Green-sensitive high-speed emulsion layer
Silver iodobromide emulsion
Silver iodide: 5 mole %
Mean grain size: 0.75 μm
Coating amount of silver: 1.6 g/m$^2$
Sensitizing Dye III . . . $2.5\times10^{-5}$ mole per mole of silver
Sensitizing Dye IV . . . $0.8\times10^{-5}$ mole per mole of silver
Magenta Coupler M-1 . . . 0.02 mole per mole of silver
Colored Magenta Coupler CM-1 . . . 0.003 mole per mole of silver
Coating amount of tricresyl phosphate . . . 0.8 ml/m$^2$
Layer 8: Yellow filter layer
An yellow colloidal silver-containing gelatin layer
Layer 9: Blue-sensitive low-speed emulsion layer
Silver iodobromide emulsion
Silver iodide: 6 mole %
Mean grain size: 0.7 μm
Coating amount of silver: 0.5 g/m$^2$
Yellow Coupler Y-1 . . . 0.125 mole per mole of silver
Coating amount of tricresyl phosphate . . . 0.3 ml/m$^2$
Layer 10: Blue-sensitive high-speed emulsion layer
Silver iodobromide emulsion
Silver iodide: 6 mole %
Mean grain size: 0.8 μm
Coating amount of silver: 0.6 g/m$^2$
Yellow Coupler Y-1 . . . 0.04 mole per mole of silver Coating amount of tricresyl phosphate . . . 0.1 ml/m$^2$ Layer 11: Protective layer A gelatin layer containing polymethyl methacrylate particles (diameter 1.5 μm).

The coupler in each layer was used in the emulsified form, which was prepared in the manner that the coupler was added to a solution of tricresyl phosphate and ethyl acetate, and to this was added sodium p-dodecylbenzenesulfonate as an emulsifier, and the mixture was heated to thereby dissolve the coupler, and mixed with a heated 10% gelatin solution and then emulsified by a colloid mill.

To each layer were added a gelatin hardener and a surfactant in addition to the above compositions.

The thus prepared sample was regarded as Sample 15. The compounds which were used in preparing the sameple:

Sensitizing Dye I: Anhydro-5,5'-dichloro-3,3'-di(γ-sulfopropyl)-9-ethyl-thiacarbocyanine-hydroxide pyridium salt.

Sensitizing Dye II: Anhydro-9-ethyl-3,3'-di(γ-sulfopropyl)-4,5,4'5'-dibenzothiacarbocyanine-hydroxide triethylamine salt.

Sensitizing Dye III: Anhydro-9-ethyl-5,5'-dichloro-3,3-di-(γ-sulfopropyl)oxacarbcyaninehydroxide sodium salt.

Sensitizing Dye IV: Anhydro-5,6,5'6'-tetrachloro-1,1'-diethyl-3,3'-di-(β-[β-(γ-sulfopropoxy)ethoxy]ethylimidazolocarbocyaninehydroxide sodium salt.

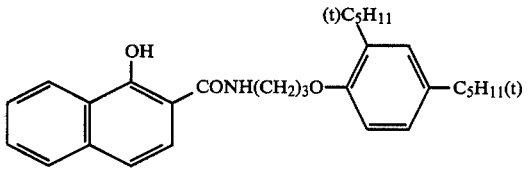

Cyan Coupler C-1

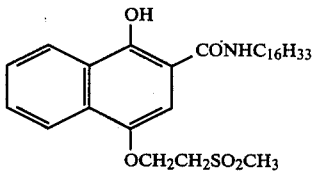

Cyan Coupler C-2

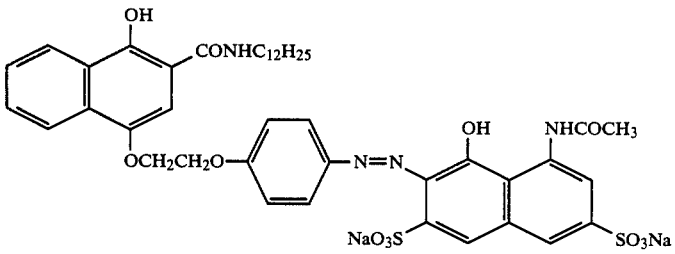

Colored Cyan Coupler CC-1

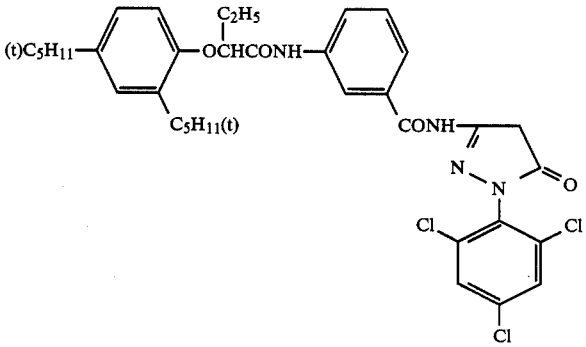

Magenta Coupler M-1

-continued

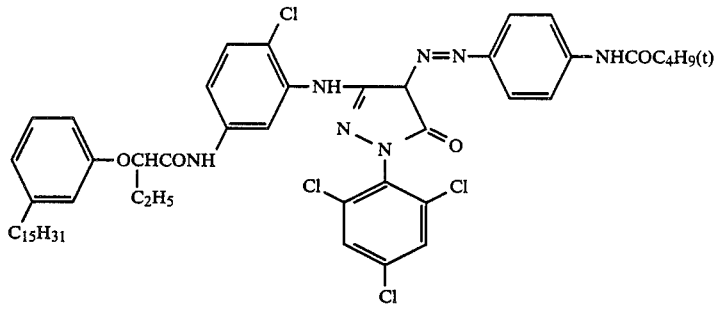

Colored Magent Coupler CM-1

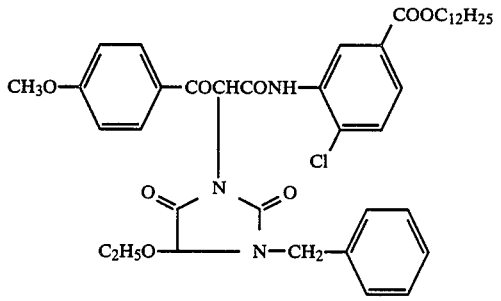

Yellow Coupler Y-1

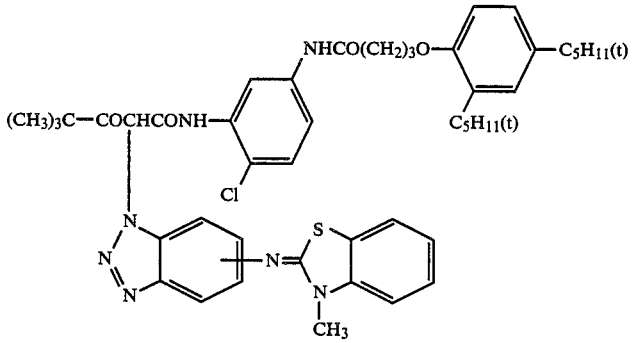

DIR Compound D-1

The emulsion of each of the foregoing blank sample emulsion layers is one, to which, after the addition thereto of the foregoing sensitizing dye, was added a known ripening stop agent 4-hydroxy-6-methyl-1,3,3a,7-tetrazaindene in a quantity of 1 g per mole of silver halide, and which was regarded as a blank emulsion.

Subsequently, the invention's or comparative antifoggant was added to Layers 3, 4, 6, 7, 9 and 10 as shown in Table 2 and, after having the agent adequately adsorbed thereto, the coupler and tricresyl phosphate were added thereto as previously mentioned. After that, an appropriate amount of a hardener 2-hydroxy-4,6-dichlorotriazine sodium salt was added, whereby ten multicoated samples (No. 16 to No. 25) were prepared.

These obtained film samples each was subjected to an incubation (forced deterioration) test in which each sample was aged for two days under the atmospheric condition of a temperature of 65° C. with a humidity of 7, and then was exposed through an optical wedge, and subsequently color-developed in accordance with the following color processing procedure.

The color sensitometric results found from these obtained film pieces are shown in the following Table 2.

In the table, each fog value is a base density-deducted value, and the sensitivity of each sample is a relative speed value to that of Comparative Sample No. 15 (which was left as it was at room temperature for two days) being regarded as 100.

| Processing Steps (at 38° C.) | Processing Time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in the processing steps are as follows:

| | |
|---|---|
| [Color Developer Solution] | |
| 4-amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Add water to make 1 liter. Use sodium hydroxide to adjust the pH to 10.6. | |
| [Bleacher Solution] | |
| Iron-ammonium ethylenediaminetetraacetate | 100.0 g |
| Diammonium ethylenediaminetetraacetate | 10.0 g |

-continued

| | |
|---|---|
| Ammonium bromide | 150.0 g |
| Glacial acetic acid | 10.0 g |
| Add water to make 1 liter. Use aqueous ammonia to adjust the pH to 6.0. | |
| [Fixer Solution] | |
| Ammonium thiosulfate | 175.0 g |
| Anhydrous sodium sulfite | 8.6 g |
| Sodium metasulfite | 2.3 g |
| Add water to make 1 liter. Use acetic acid to adjust the pH to 6.0. | |
| [Stabilizer Solution] | |
| Formalin (aqueous 37% solution) | 1.5 ml |
| Koniducks (product of Konishiroku Photo Ind. Co., Ltd.) | 7.5 ml |
| Add water to make 1 liter. | |

TABLE 2

| Sample No. | Antifoggant Cpd. No. | Adding amount (mg/mol AgX) | Blue-sensitive layer Left at room temp. Fog | Speed | 65° C./RH 7% Fog | speed | Green-sensitive layer Left at room temp. Fog | Speed | 65° C./RH 7% Fog | Speed | Red-sensitive layer Left at room temp. Fog | Speed | 65° C./RH 7% Fog | Speed |
|---|---|---|---|---|---|---|---|---|---|---|---|---|---|---|
| 15 (Comp.) | — | — | 0.17 | 100 | 0.26 | 90 | 0,17 | 100 | 0.24 | 94 | 0.13 | 100 | 0.23 | 94 |
| | Ex. | | | | | | | | | | | | | |
| 16 (Inv.) | 16 | 300 | 0.09 | 100 | 0.10 | 102 | 0.10 | 102 | 0.11 | 100 | 0.09 | 100 | 0.10 | 100 |
| 17 (Inv.) | 22 | 300 | 0.09 | 100 | 0.12 | 102 | 0.10 | 101 | 0.12 | 100 | 0.10 | 101 | 0.12 | 100 |
| 18 (Inv.) | 26 | 300 | 0.09 | 102 | 0.12 | 100 | 0.09 | 103 | 0.10 | 101 | 0.09 | 100 | 0.12 | 102 |
| 19 (Inv.) | 29 | 300 | 0.09 | 103 | 0.12 | 103 | 0.10 | 102 | 0.11 | 101 | 0.09 | 100 | 0.11 | 100 |
| 20 (Inv.) | 33 | 300 | 0.10 | 100 | 0.12 | 102 | 0.10 | 103 | 0.11 | 102 | 0.09 | 102 | 0.12 | 101 |
| 21 (Inv.) | 3 | 150 | 0.10 | 103 | 0.11 | 101 | 0.10 | 102 | 0.11 | 100 | 0.09 | 103 | 0.10 | 100 |
| | 17 | 150 | | | | | | | | | | | | |
| 22 (Inv.) | 12 | 100 | 0.09 | 100 | 0.11 | 103 | 0.10 | 100 | 0.11 | 100 | 0.09 | 100 | 0.11 | 100 |
| | 34 | 200 | | | | | | | | | | | | |
| | Comp. | | | | | | | | | | | | | |
| 23 (Comp.) | a* | 30 | 0.13 | 98 | 0.22 | 86 | 0.13 | 98 | 0.21 | 86 | 0.10 | 97 | 0.20 | 87 |
| 24 (Comp.) | b* | 30 | 0.16 | 98 | 0.24 | 82 | 0.15 | 100 | 0.22 | 84 | 0.11 | 100 | 0.21 | 88 |
| 25 (Comp.) | c* | 10 | 0.12 | 97 | 0.22 | 92 | 0.10 | 96 | 0.20 | 93 | 0.09 | 98 | 0.20 | 92 |

Note:
*Comparative Compound a: As defined in Table 1.
*Comparative Compound c:

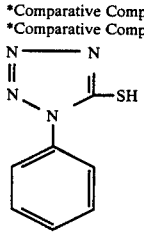

From Table 2 it is apparent that, with the samples of this invention, even in the multicolor light-sensitive material form, even under the severe conditions, satisfactory fog restrainability can be obtained with no deterioration of the sensitivity.

EXAMPLE-3

A high-speed silver iodobromide emulsion for radiography use similar to the one that was used in Example-1 was chemically ripened up to the time when the maximum sensitivity is obtained by the sulfur sensitization method, and after that to this was added 1.0 g of 4-hydroxy-6-methyl-1,3,3a,7-tetrazaindene per mole of silver halide and an appropriate amount of saponin as a coating aid, thus preparing an objective emulsion.

The obtained emulsion was coated uniformly on a subbed polyester base so that the coating amount of silver is 3 g/m$^2$, whereby a film sample was obtained.

This sample was exposed through an ordinary sensitometric wedge, ans then subjected to a high-temperature rapid processing that took place at 35° C. for 60 seconds in Processing Solution [A] that was used in Example-1 into which were incorporated separately antifoggants of this invention and comparative antifoggants as shown in Table 3. The obtained results are shown in Table 3, wherein each fog value is a base density-deducted value; and each speed value is a relative value to the one obtained when processed in a developer solution containing no antifoggant; and each gamma value represents the inclination of the straight-line portion of a characteristic curve.

TABLE 3

| Processing No. | Antifoggant Cpd. No. | Adding** amount | Photographic characteristics Fog | Speed | Gamma |
|---|---|---|---|---|---|
| 1 (Comp.) | — | — | 0.21 | 100 | 2.72 |
| 2 (Inv.) | Ex. 6 | 3.0 | 0.16 | 102 | 2.75 |
| 3 (Inv.) | Ex. 8 | 2.0 | 0.17 | 100 | 2.81 |
| 4 (Inv.) | Ex. 9 | 3.0 | 0.16 | 103 | 2.80 |
| 5 (Inv.) | Ex. 14 | 3.0 | 0.16 | 101 | 2.74 |
| 6 (Inv.) | Ex. 15 | 3.0 | 0.15 | 102 | 2.72 |
| 7 (Inv.) | Ex. 16 | 2.0 | 0.17 | 100 | 2.80 |
| 8 (Inv.) | Ex. 17 | 2.0 | 0.15 | 100 | 2.78 |
| 9 (Inv.) | Ex. 26 | 3.0 | 0.17 | 103 | 2.76 |
| 10 (Inv.) | Ex. 27 | 3.0 | 0.16 | 102 | 2.73 |
| 11 (Inv.) | Ex. 30 | 3.0 | 0.15 | 100 | 2.80 |
| 12 (Inv.) | Ex. 31 | 2.0 | 0.16 | 104 | 2.72 |
| 13 (Inv.) | Ex. 33 | 3.0 | 0.17 | 102 | 1.74 |
| 14 (Inv.) | Ex. 34 | 3.0 | 0.16 | 100 | 2.73 |
| 15 (Comp.) | Comp. a* | 1.0 | 0.17 | 87 | 2.67 |
| 16 (Comp.) | Comp. b* | 2.0 | 0.17 | 90 | 2.68 |
| 17 (Comp.) | Comp. c* | 1.0 | 0.16 | 89 | 2.66 |

Note:
*The above comparative compounds are the same as those in Table 1 and Table 2.
**Adding amount is in mg/liter of developer solution.

From the results shown in Table 3 it is apparent that the antifoggants of this invention, even when added to a developer solution, prevent the production of a fog in such high-temperature rapid processing and thus do not deteriorate the sensitivity unlike those conventional antifoggants.

EXAMPLE-4

A 7 mol% silver iodide-containing silver iodobromide emulsion whose mean silver halide grain size is 1.2μ was chemically ripened up to the time when the maximum sensitivity was obtained by using a gold and sulfur sensitizers.

Subsequently, an appropriate amount of a green-sensitizing dye anhydro-5,5'-diphenyl-9-ethyl-3,3'-di-γ-sulfopropyloxacarbocyanine sodium salt was added to the emulsion, whereby a green-sensitive silver halide emulsion was prepared.

After that, to the obtained emulsion was added a coupler-dispersed liquid which was prepared in the manner that a solution obtained by mixing 80 g per mole of silver halide of a magenta coupler 1-(2,4,6-trichlorophenyl)-3-[3-(2,4-di-t-amylphenoxyacetamido)benzamido]-5-pyrazolone and 2.5 g of a colored magenta coupler 1-(2,4,6-trichlorophenyl)-4-(1-naphthylazo)-3-(2-chloro-5-octadecenylsuccinimidoanilino)-5-pyrazolone with 120 g of tricresyl phosphate and 240 ml of ethyl acetate and dissolved by heating was emulsifiedly dispersed into a solution of 5 g of sodium triisopropylnaphthalenesulfonate dissolved in 550 ml of an aqueous 7.5% gelatin solution.

To the thus obtained emulsion was equaly added an appropriate amount of a gelatin hardening agent sodium 2-hydroxy-4,6-dichlorotriazine to thereby obtain an objective silver halide emulsion. This emulsion was uniformly coated on a subbed triacetate film base so that the coating amount of silver is 3.0 g/m$^2$ and then dried, whereby a monochromatic color film sample was obtained.

The film sample, after being exposed through an optical wedge in usual manner, was color-developed in accordance with the processing steps in Example-1, provided that to the color developer solution were added compounds of this invention and comparative compounds as shown in Table 4.

The color-sensitometric results found from the obtained pieces are as shown in Table 4, wherein each speed value is a relative value to the speed regarded as 100 of a film sample when processed in the color developer solution containing no antifoggant, and the fog and gamma values are as defined in Example-3.

TABLE 4

| Processing No. | Antifoggant Cpd. No. | Antifoggant Adding** amount | Photographic characteristics Fog | Speed | Gamma |
|---|---|---|---|---|---|
| 18 (Comp.) | — | — | 0.22 | 100 | 0.97 |
| 19 (Inv.) | Ex. 7 | 500 | 0.10 | 102 | 1.02 |
| 20 (Inv.) | Ex. 7 | 1000 | 0.08 | 100 | 1.00 |
| 21 (Inv.) | Ex. 14 | 500 | 0.11 | 100 | 1.00 |
| 22 (Inv.) | Ex. 14 | 1000 | 0.08 | 98 | 1.03 |
| 23 (Inv.) | Ex. 17 | 100 | 0.09 | 100 | 1.02 |
| 24 (Inv.) | Ex. 17 | 500 | 0.08 | 100 | 1.00 |

TABLE 4-continued

| Processing No. | Antifoggant Cpd. No. | Antifoggant Adding** amount | Photographic characteristics Fog | Speed | Gamma |
|---|---|---|---|---|---|
| 25 (Inv.) | Ex. 34 | 100 | 0.08 | 100 | 1.00 |
| 26 (Inv.) | Ex. 34 | 500 | 0.07 | 99 | 1.02 |
| 27 (Comp.) | Comp. d* | 10 | 0.10 | 89 | 0.92 |
| 28 (Comp.) | Comp. d | 50 | 0.07 | 77 | 0.85 |
| 29 (Comp.) | Comp. e* | 10 | 0.10 | 83 | 0.89 |
| 30 (Comp.) | Comp. e | 50 | 0.08 | 75 | 0.73 |

Note:
*Comparative Compound d and Comparative Compound e:
Comparative Compound d

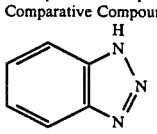

*Comparative Compound e

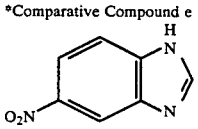

**Adding amount is in mg/litter of color developer solution.

From the above table it is apparent that the antifoggants of the present invention, even when added to the color developer solution, show their effects satisfactorily.

EXAMPLE-5

A 2.0 mole% silver iodide-containing silver iodobromide emulsion was chemically ripened by the gold-sulfur sensitization method up to the time when the maximum sensitivity was obtained, whereby a high-speed silver iodobromide emulsion was obtained.

The emulsion was divided into two equal parts, and to these parts of the emulsion were added compounds of this invention (by single use and combined use of those compounds of [I] or [II]) and comparative compounds and further appropriate amounts of formalin as a hardening agent and saponin as a coating aid.

These prepared emulsions each was coated uniformly on a subbed polyester support so that the coating amount of silver is 3 g/m$^2$, and then dried, whereby 22 different samples (No. 31 to No. 52) were obtained.

From the thus obtained photographic materials those samples allowed to stand for three days at room temperature as fresh samples, those aged at a temperature of 55° C. for three days, and those forcibly deteriorated under the condition of a temperature of 50° C. with a relative humidity of 80% for three days were prepared.

Each sample was exposed through an ordinary sensitometric wedge, then developed and fixed in the same manner as in Example-1, washed and then dried, and subsequently measured with respect to the sensitivity and fog in the same manner as in Example-1.

The obtained results are shown in Table 5, wherein each speed is a relative value to the speed regarded as 100 of Comparative Sample No. 31 that was allowed to stand for three days at room temperature.

TABLE 5

| Sample No. | Antifoggant [I] Adding amt. (mg/mole Ag) | | Antifoggant [II] Adding amt. (mg/mol Ag) | | Left for 3 days Fog | Speed | Gamma | 55° C. for 3 days Fog | Speed | Gamma | 50° C./RH 80% for 3 days Fog | Speed | Gamma |
|---|---|---|---|---|---|---|---|---|---|---|---|---|---|
| 31 (Comp.) | — | — | — | — | 0.21 | 100 | 2.7 | 0.30 | 82 | 2.4 | 0.29 | 86 | 2.5 |
| 32 (Inv.) | I-6 | 200 | — | — | 0.20 | 100 | 2.7 | 0.23 | 98 | 2.6 | 0.21 | 100 | 2.7 |
| 33 (Inv.) | " | 500 | — | — | 0.17 | 102 | 2.8 | 0.21 | 100 | 2.7 | 0.19 | 100 | 2.8 |
| 34 (Inv.) | I-7 | 200 | — | — | 0.17 | 102 | 2.8 | 0.22 | 100 | 2.7 | 0.16 | 102 | 2.7 |

TABLE 5-continued

| Sample No. | Antifoggant [I] Adding amt. (mg/mole Ag) | | [II] Adding amt. (mg/mol Ag) | | Left for 3 days Fog | Speed | Gamma | 55° C. for 3 days Fog | Speed | Gamma | 50° C./RH 80% for 3 days Fog | Speed | Gamma |
|---|---|---|---|---|---|---|---|---|---|---|---|---|---|
| 35 (Inv.) | " | 500 | — | — | 0.15 | 101 | 2.8 | 0.19 | 102 | 2.8 | 0.16 | 101 | 2.7 |
| 36 (Inv.) | I-26 | 200 | — | — | 0.19 | 100 | 2.7 | 0.21 | 98 | 2.7 | 0.20 | 100 | 2.7 |
| 37 (Inv.) | " | 500 | — | — | 0.15 | 102 | 2.8 | 0.20 | 100 | 2.7 | 0.16 | 102 | 2.8 |
| 38 (Comp.) | — | — | II-9 | 100 | 0.18 | 100 | 2.8 | 0.19 | 100 | 2.8 | 0.21 | 100 | 2.7 |
| 39 (Comp.) | — | — | " | 300 | 0.16 | 100 | 2.8 | 0.18 | 100 | 2.7 | 0.19 | 102 | 2.7 |
| 40 (Comp.) | — | — | II-16 | 100 | 0.18 | 102 | 2.7 | 0.18 | 102 | 2.7 | 0.19 | 101 | 2.7 |
| 41 (Comp.) | — | — | " | 300 | 0.16 | 100 | 2.8 | 0.17 | 101 | 2.7 | 0.18 | 100 | 2.8 |
| 42 (Inv.) | I-6 | 300 | II-9 | 150 | 0.17 | 100 | 2.8 | 0.18 | 100 | 2.7 | 0.17 | 100 | 2.8 |
| 43 (Inv.) | I-17 | 300 | " | 150 | 0.16 | 102 | 2.8 | 0.16 | 102 | 2.7 | 0.16 | 101 | 2.7 |
| 44 (Inv.) | I-26 | 300 | " | 150 | 0.16 | 101 | 2.7 | 0.17 | 101 | 2.7 | 0.18 | 100 | 2.7 |
| 45 (Inv.) | I-6 | 300 | II-16 | 150 | 0.17 | 100 | 2.7 | 0.18 | 100 | 2.8 | 0.17 | 101 | 2.7 |
| 46 (Inv.) | I-17 | 300 | " | 150 | 0.16 | 100 | 2.7 | 0.16 | 102 | 2.7 | 0.16 | 103 | 2.8 |
| 47 (Inv.) | I-26 | 300 | " | 150 | 0.16 | 100 | 2.8 | 0.17 | 102 | 2.7 | 0.17 | 101 | 2.7 |
| 48 (Comp.) | Comp a* | 5 | — | — | 0.19 | 97 | 2.8 | 0.30 | 82 | 2.4 | 0.28 | 87 | 2.5 |
| 49 (Comp.) | " | 10 | — | — | 0.15 | 88 | 2.7 | 0.26 | 84 | 2.3 | 0.26 | 89 | 2.4 |
| 50 (Comp.) | — | — | Comp. f* | 100 | 0.18 | 100 | 2.8 | 0.29 | 88 | 2.4 | 0.27 | 89 | 2.5 |
| 51 (Comp.) | — | — | " | 200 | 0.17 | 96 | 2.8 | 0.25 | 86 | 2.4 | 0.24 | 87 | 2.5 |
| 52 (Comp.) | Comp. a | 7 | " | 100 | 0.17 | 98 | 2.7 | 0.29 | 87 | 2.4 | 0.27 | 88 | 2.5 |

Note:
*Comparative Compound f

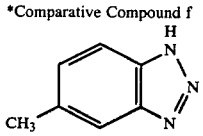

As is apparent from Table 5, the samples of this invention, even though they were placed under the severe conditions, they were restrained from producing a fog as well as from being deteriorated in the gamma, thus being improved in the stability in preservation. This effect is very significant particularly in the case where the compound of [II] is used in combination.

EXAMPLE-6

A high-speed silver iodobromide emulsion for negative use (containing 6.0 mole% silver iodide) having a mean grain size of 1.2μ was chemically ripened by the gold-sulfur sensitization method up to the time when the maximum sensitivity was obtained.

To this emulsion was added an appropriate amount of a green-sensitizing dye 5,5'-diphenyl-9-ethyl-3,3'-di-γ-sulfopropyloxacarbocyanine sodium salt, whereby a green-sensitive silver halide emulsion was prepared.

Subsequently, 80 g per mole of silver halide of a magenta coupler 1-(2,4,6-trichlorophenyl)-3-[3-(2,4-di-t-amylphenoxyacetamido)benzamido]-5-pyrazolone and 2.5 g of a colored magenta coupler 1-(2,4,6-trichlorophenyl)-4-(1-naphthylazo)-3-(2-chloro-5-octadecenylsuccinimidoanilino)-5-pyrazolone were mixed with 120 g of tricresyl phosphate and 240 mg of ethyl acetate, and the mixture was heated to dissolve the couplers, and this solution was emulsifiedly dispersed into a solution of 5 g of sodium triisopropylnaphthalenesulfonate dissolved in an aqueous 7.5% gelatin solution, and then the obtained coupler-dispersed liquid was added to the foregoing emulsion.

The above-prepared emulsion was divided into 18 parts, and one part of them was taken as a blank. To the other parts were added the comparative compounds and compounds of this invention, respectively, as shown in Table 2, and, after they were sufficiently adsorbed, to each of these parts was added equaly an appropriate amount of a gelatin hardening agent sodium 2-hydroxy-4,6-dichlorotriazine, whereby silver halide emulsion samples were obtained.

Each emulsion was coated uniformly on a subbed triacetate film so that the coating amount of silver is 3.0 g/m$^2$, and then dried, whereby Samples No. 53 to No. 70 were prepared.

The obtained film samples, after being subjected to the same forced deterioration tests as in Example-5, were each exposed through an optical wedge in usual manner, and then processed under the same conditions as in Example-1.

The obtained color-sensitometric results found from the obtained pieces are shown in Table 6, wherein each fog value is a base density-deducted value, and each speed value is a relative value to the speed regarded as 100 of the blank sample that was allowed to stand at room temperature for three days, and each gamma value represents the inclination of the straight-line portion of a characteristic curve.

TABLE 6

| Sample No. | Antifoggant [I] Adding amt. (mg/mole Ag) | | [II] Adding amt. (mg/mol Ag) | | Left for 3 days Fog | Speed | Gamma | 55° C. for 3 days Fog | Speed | Gamma | 50° C./RH 80% for 3 days Fog | Speed | Gamma |
|---|---|---|---|---|---|---|---|---|---|---|---|---|---|
| 53(Comp.) | — | — | — | — | 0.20 | 100 | 1.2 | 0.28 | 96 | 1.1 | 0.26 | 97 | 1.1 |
| 54(Inv.) | I-15 | 200 | — | — | 0.19 | 100 | 1.2 | 0.24 | 100 | 1.1 | 0.21 | 100 | 1.2 |
| 55(Inv.) | " | 500 | — | — | 0.19 | 100 | 1.2 | 0.23 | 102 | 1.1 | 0.20 | 101 | 1.1 |
| 56(Inv.) | I-29 | 150 | — | — | 0.18 | 103 | 1.2 | 0.20 | 102 | 1.2 | 0.19 | 102 | 1.2 |
| 57(Inv.) | " | 300 | — | — | 0.18 | 102 | 1.3 | 0.19 | 101 | 1.3 | 0.18 | 101 | 1.3 |
| 58(Inv.) | I-33 | 200 | — | — | 0.19 | 100 | 1.2 | 0.22 | 100 | 1.2 | 0.20 | 100 | 1.2 |
| 59(Inv.) | " | 500 | — | — | 0.19 | 101 | 1.3 | 0.20 | 100 | 1.3 | 0.19 | 100 | 1.3 |
| 60(Comp.) | — | — | II-11 | 100 | 0.20 | 100 | 1.2 | 0.20 | 101 | 1.2 | 0.22 | 102 | 1.2 |
| 61(Comp.) | — | — | " | 300 | 0.19 | 102 | 1.2 | 0.20 | 100 | 1.2 | 0.21 | 100 | 1.2 |

TABLE 6-continued

| Sample No. | Antifoggant [I] Adding amt. (mg/mole Ag) | | [II] Adding amt. (mg/mol Ag) | | Left for 3 days Fog | Speed | Gamma | 55° C. for 3 days Fog | Speed | Gamma | 50° C./RH 80% for 3 days Fog | Speed | Gamma |
|---|---|---|---|---|---|---|---|---|---|---|---|---|---|
| 62(Comp.) | — | — | II-17 | 100 | 0.19 | 100 | 1.2 | 0.20 | 100 | 1.2 | 0.21 | 100 | 1.2 |
| 63(Comp.) | — | — | " | 300 | 0.18 | 100 | 1.2 | 0.18 | 101 | 1.3 | 0.19 | 100 | 1.2 |
| 64(Inv.) | I-15 | 200 | II-11 | 200 | 0.19 | 100 | 1.2 | 0.20 | 100 | 1.2 | 0.19 | 102 | 1.2 |
| 65(Inv.) | " | 400 | II-17 | 200 | 0.18 | 100 | 1.3 | 0.19 | 100 | 1.3 | 0.18 | 101 | 1.3 |
| 66(Inv.) | I-29 | 100 | II-11 | 200 | 0.19 | 102 | 1.3 | 0.19 | 101 | 1.3 | 0.19 | 100 | 1.2 |
| 67(Inv.) | " | 100 | II-17 | 100 | 0.18 | 101 | 1.3 | 0.18 | 101 | 1.3 | 0.18 | 101 | 1.2 |
| 68(Inv.) | I-33 | 200 | II-11 | 200 | 0.19 | 101 | 1.2 | 0.19 | 102 | 1.2 | 0.19 | 101 | 1.2 |
| 69(Inv.) | " | 400 | II-17 | 200 | 0.19 | 103 | 1.2 | 0.19 | 103 | 1.2 | 0.19 | 102 | 1.3 |
| 70(Comp.) | — | — | Comp. c | 10 | 0.19 | 97 | 1.1 | 0.25 | 98 | 1.1 | 0.25 | 97 | 1.1 |

As is apparent from Table 6, the combined use of Compounds [I] and [II] of this invention enables to obtain the excellent fog restrainability in any of the high-temperature and high-temperature/high-humidity forced deterioration tests as compared to those conventionally known compounds and the single use of Compounds [I] and [II] of this invention.

EXAMPLE-7

Multilayer color light-sensitive material samples (No. 71 to No. 87) were prepared by use of the same materials and the same method as in Example-2. Sample 71 is a comparative sample containing no antifoggant. Samples 72 through 87 are ones to which were added Compounds [I], [II] of this invention or comparative compounds as antifoggants as shown in Table 7. The addition of these antifoggants was made to Emulsion Layers 3, 4, 6, 7, 9 and 10 of each sample.

Each of the obtained multilayer color light-sensitive material samples, after being subjected to the same preservability test treatment as in Example-1, was exposed through an optical wedge in usual manner, and then color-processed in the same manner as in Example-2.

The obtained color-sensitometric results are shown in the following Table 7, wherein each fog value is a base density-deducted value, each speed value is a relative value to the speed regarded as 100 of the blank sample (No. 71) that was allowed to stand at room temperature for three days.

TABLE 7

| Sample No. | Antifoggant [I] Adding amt. (mg/mole Ag) | | [II] Adding amt. (mg/mol Ag) | | Red-Sensitive layer Room temp. Fog | Speed | 55° C. Fog | Speed | 50° C./RH 80% Fog | Speed |
|---|---|---|---|---|---|---|---|---|---|---|
| 71 (Comp.) | — | — | — | — | 0.13 | 100 | 0.21 | 96 | 0.20 | 96 |
| 72 (Comp.) | Comp. g* | 5 | — | — | 0.13 | 100 | 0.19 | 95 | 0.20 | 96 |
| 73 (Comp.) | — | 10 | | — | 0.12 | 97 | 0.17 | 86 | 0.18 | 92 |
| 74 (Comp.) | — | — | Comp. c* | 5 | 0.12 | 100 | 0.21 | 96 | 0.20 | 96 |
| 75 (Comp.) | — | — | " | 10 | 0.11 | 98 | 0.19 | 95 | 0.18 | 95 |
| 76 (Comp.) | Comp. g | 5 | " | 2.5 | 0.12 | 100 | 0.19 | 96 | 0.20 | 96 |
| 77 (Comp.) | " | 5 | " | 5 | 0.11 | 97 | 0.18 | 96 | 0.19 | 94 |
| 78 (Inv.) | I-29 | 50 | — | — | 0.13 | 100 | 0.19 | 100 | 0.18 | 100 |
| 79 (Inv.) | " | 100 | — | — | 0.13 | 100 | 0.17 | 100 | 0.15 | 100 |
| 80 (Inv.) | " | 200 | — | — | 0.13 | 98 | 0.15 | 100 | 0.16 | 99 |
| 81 (Comp.) | — | — | II-17 | 50 | 0.13 | 100 | 0.18 | 96 | 0.17 | 97 |
| 82 (Comp.) | — | — | " | 100 | 0.13 | 103 | 0.16 | 100 | 0.16 | 102 |
| 83 (Comp.) | — | — | " | 200 | 0.12 | 102 | 0.15 | 101 | 0.15 | 101 |
| 84 (Inv.) | I-29 | 50 | " | 50 | 0.12 | 104 | 0.14 | 103 | 0.13 | 103 |
| 85 (Inv.) | " | 50 | " | 100 | 0.12 | 103 | 0.13 | 102 | 0.13 | 102 |
| 86 (Inv.) | " | 50 | " | 100 | 0.12 | 102 | 0.12 | 102 | 0.12 | 102 |
| 87 (Inv.) | " | 100 | " | 100 | 0.12 | 102 | 0.12 | 102 | 0.12 | 101 |

| Sample No. | Green-sensitive layer Room temp. Fog | Speed | 55° C. Fog | Speed | 50° C./RH 80% Fog | Speed | Blue-sensitive layer Room temp. Fog | Speed | 55° C. Fog | Speed | 50° C./RH 80% Fog | Speed |
|---|---|---|---|---|---|---|---|---|---|---|---|---|
| 71 (Comp.) | 0.20 | 97 | 0.29 | 95 | 0.26 | 96 | 0.19 | 95 | 0.28 | 93 | 0.26 | 94 |
| 72 (Comp.) | 0.18 | 96 | 0.26 | 94 | 0.24 | 96 | 0.29 | 96 | 0.26 | 94 | 0.25 | 95 |
| 73 (Comp.) | 0.17 | 96 | 0.23 | 93 | 0.19 | 95 | 0.17 | 94 | 0.23 | 93 | 0.19 | 94 |
| 74 (Comp.) | 0.19 | 98 | 0.28 | 95 | 0.25 | 97 | 0.18 | 95 | 0.28 | 94 | 0.24 | 95 |
| 75 (Comp.) | 0.17 | 96 | 0.26 | 94 | 0.22 | 94 | 0.17 | 94 | 0.26 | 92 | 0.22 | 93 |
| 76 (Comp.) | 0.20 | 96 | 0.23 | 95 | 0.25 | 94 | 0.19 | 95 | 0.27 | 93 | 0.24 | 94 |
| 77 (Comp.) | 0.18 | 95 | 0.26 | 93 | 0.24 | 94 | 0.18 | 94 | 0.24 | 92 | 0.24 | 95 |
| 78 (Inv.) | 0.18 | 98 | 0.21 | 97 | 0.21 | 97 | 0.19 | 96 | 0.20 | 96 | 0.20 | 96 |
| 79 (Inv.) | 0.17 | 98 | 0.19 | 98 | 0.20 | 98 | 0.19 | 97 | 0.20 | 97 | 0.19 | 97 |
| 80 (Inv.) | 0.16 | 99 | 0.18 | 99 | 0.19 | 99 | 0.18 | 98 | 0.19 | 97 | 0.18 | 98 |
| 81 (Comp.) | 0.19 | 99 | 0.20 | 100 | 0.19 | 101 | 0.19 | 99 | 0.20 | 100 | 0.18 | 99 |
| 82 (Comp.) | 0.17 | 98 | 0.17 | 99 | 0.17 | 100 | 0.18 | 99 | 0.20 | 100 | 0.18 | 98 |
| 83 (Inv.) | 0.15 | 98 | 0.17 | 98 | 0.16 | 99 | 0.17 | 98 | 0.18 | 99 | 0.17 | 98 |
| 84 (Inv.) | 0.15 | 102 | 0.15 | 101 | 0.15 | 102 | 0.15 | 98 | 0.15 | 97 | 0.15 | 98 |
| 85 (Inv.) | 0.14 | 101 | 0.14 | 100 | 0.14 | 100 | 0.15 | 97 | 0.15 | 99 | 0.15 | 98 |
| 86 (Inv.) | 0.14 | 100 | 0.14 | 100 | 0.14 | 100 | 0.14 | 99 | 0.14 | 100 | 0.14 | 100 |

TABLE 7-continued

| | | | | | | | | | | | | |
|---|---|---|---|---|---|---|---|---|---|---|---|---|
| 87 (Inv.) | 0.13 | 100 | 0.13 | 100 | 0.13 | 100 | 0.14 | 100 | 0.14 | 101 | 0.14 | 100 |

Note:
*Comparative Compound c is as defined in Table 2.
*Comparative compound g:

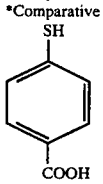

From the results in Table 7 it is apparent that the samples of this invention, even in the multilayer color light-sensitive material form, are excellent in the balance of the respective light-sensitive layers and provide the fog restrainability with no deterioration of the sensitivity despite of the treatment under the severe conditions.

EXAMPLE-8

In specific component layers of the following Sample 91 (comparative) prepared by incorporating the pyrazoloazole-type magenta coupler of this invention therein, exemplified magenta couplers and Compounds [I] or [II] were used in combination, whereby Samples 92 through 104 were prepared, and they were compared with respect to the characteristics thereof.

On a triacetylcellulose film support were formed the following composition-having layers in order from the support side, whereby a multilayer color light-sensitive material Sample 91 was prepared.

Sample-91 (Reference)

Layer 1: Antihalation layer (HC-1):
A black-colloidal silver-containing gelatin layer Layer 2: Intermediate layer (I.L.):
A gelatin layer containing an emulsified dispersion product of 2,5-di-t-octylhydroquinone.

Layer 3: Low-speed red-sensitive silver halide emulsion layer (RL-1):
AgBrI monodisperse emulsion (Emulsion I), mean grain size ($\bar{r}$) 0.40 μm, containing 6 mole% AgI . . . .
Coating amount of silver: 1.8 g/m$^2$
Sensitizing Dye I . . .
$5.0\times10^{-4}$ mole per mole of silver
Sensitizind Dye II . . .
$0.8\times10^{-4}$ mole per mole of silver
Cyan Coupler (C-3) . . .
0.085 mole per mole of silver
Colored Cyan Coupler (CC-2) . . .
0.005 mole per mole of silver
DIR Compound (D-2) . . .
0.0015 mole per mole of silver
DIR Compound (D-3) . . .
0.002 mole per mole of silver Layer 4: High-speed red-sensitive silver halide emulsion layer (RH-1):
AgBrI monodisperse emulsion (Emulsion II), mean grain size ($\bar{r}$) 0.8 μm, containing 6.0 mole% AgI . . . .
Coating amount of silver: 1.3 g/m$^2$
Sensitizing Dye I . . .
$2.5\times10^{-4}$ mole per mole of silver
Sensitizing Dye II . . .
$0.8\times10^{-4}$ mole per mole of silver
Cyan Coupler (C-4) . . .
0.007 mole per mole of silver
Cyan Coupler (C-5) . . .
0.027 mole per mole of silver
Colored Cyan Coupler (CC-2)
0.0015 mole per mole of silver
DIR Compound (D-3) . . .
0.001 mole per mole of silver Layer 5: Intermediate Layer (I.L.):
A gelatin layer, the same as Layer 2.

Layer 6: Low-speed green-sensitive silver halide emulsion layer (GL-1):
Emulsion-I . . . Coating amount of silver: 1.5 g/m$^2$
Sensitizing Dye V . . .
$2.0\times10^{-4}$ mole per mole of silver
Sensitizing Dye VI . . .
$1.0\times10^{-4}$ mole per mole of silver
Magenta coupler (Exemplified Compound 4) . . .
0.090 mole per mole of silver
Colored Magenta Coupler (CM-2)
0.004 mole per mole of silver
DIR Compound (D-2) . . .
0.0010 mole per mole of silver
DIR Compound (D-4) . . .
0.0030 mole per mole of silver Layer 7: High-speed green-sensitive silver halide emulsion layer (GH-1):
Emulsion-II . . . Coating amount of silver: 1.4 g/m$^2$
Sensitizing Dye V . . .
$1.2\times10^{-4}$ mole per mole of silver
Sensitizing Dye VI . . .
$0.8\times10^{-4}$ mole per mole of silver
Magenta coupler (Exemplified Compound 4) . . .
0.015 mole per mole of silver
Colored Magenta Coupler (CM-2) . . .
0.002 mole per mole of silver
DIR Compound (D-4) . . .
0.0010 mole per mole of silver Layer 8: Yellow filter layer (YC-1):
A gelatin layer containing an emulsified dispersion produced of yellow colloidal silver and 2,5-di-octylhydroquinone.

Layer 9: Low-speed blue-sensitive silver halide emulsion layer (BL-1):
AgBrI monodisperse emulsion (Emulsion III), mean grain size 0.48 μm, containing 6 mole% AgI . . . .
Coating amount of silver: 0.9 g/m$^2$
Sensitizing Dye VII . . .
$1.3\times10^{-4}$ mole per mole of silver
Yellow Coupler (Y-2) . . .
0.29 mole per mole of silver Layer 10: High-speed blue-sensitive silver halide emulsion layer (BH-1)
AgBrI monodisperse emulsion (Emulsion IV), mean grain size 0.8 μm, containing 7 mole% AgI . . . .
Coating amount of silver: 0.5 g/m$^2$
Sensitizing Dye VII . . .
$1.0\times10^{-4}$ mole per mole of silver
Yellow Coupler (Y-2) . . .

0.08 mole per mole of silver
DIR Compound (D-3) . . .
0.0030 mole per mole of silver
Layer 11: First protective layer (Pro-1):
A gelatin layer containing silver iodobromide (1 mole% AgI, mean grain size 0.07 μm) . . .
Coating amount of silver: 0.5 g/m², and
Ultraviolet Absorbing Agents UV-1 and UV-2.
Layer 12: Second protective layer (Pro-2):
A gelatin layer containing polymethacrylate particles (diameter 1.5 μm) and formalin scavenger (HS-1).

Further, in addition to the above compositions, gelatin hardening agents (H-1) and (H-2) and a surface active agent were added to each of the above layers.

The above-mentioned compounds added to the respective layers are as follows:

Sensitizind Dye I: the same as the Sensitizing Dye I used in Examle-2.
Sensitizing Dye II: the same as the Sensitizing Dye II used in Example-2.
Sensitizing Dye V: Anhydro-5,5'-diphenyl-9-ethyl-3,3'-di-(3-sulfopropyl)oxacarbocyanine hydroxide.
Sensitizing Dye VI: Anhydro-9-ethyl-3,3'-di-(3-sulfopropyl)-5,6,5'6'-dibenzoxacarbocyanine hydroxide.
Sensitizing Dye VII: Anhydro-3,3'-di-(3-sulfopropyl)-4,5-benzo-5'-methoxycyanine hydroxide.

Cyan Coupler C-3:

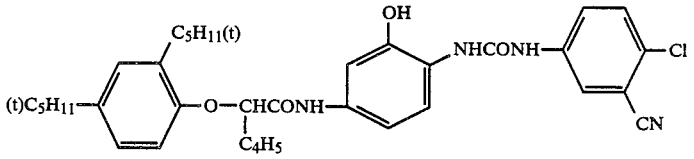

Cyan Coupler C-4

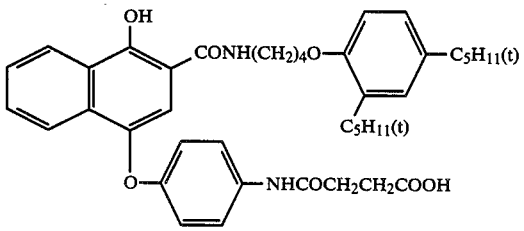

Cyan Coupler C-5

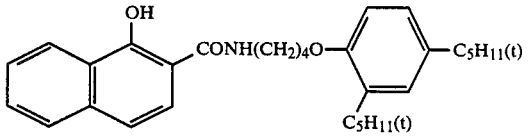

Colored Cyan Coupler CC-2

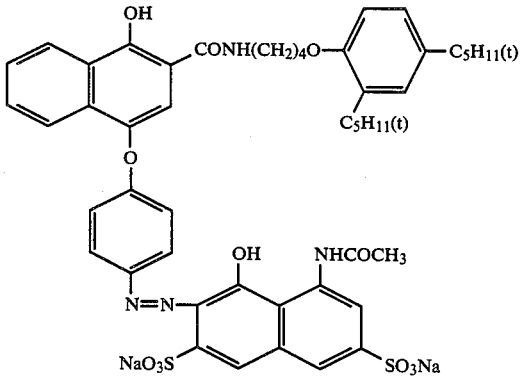

DIR Compound D-2

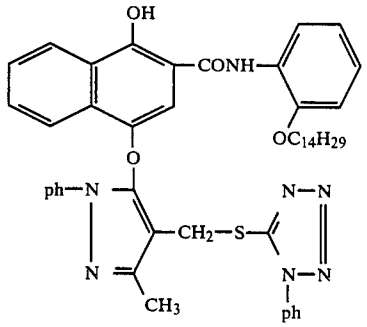

DIR Compound D-3

DIR Compound D-4

-continued

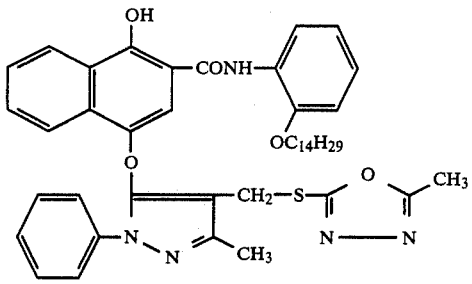

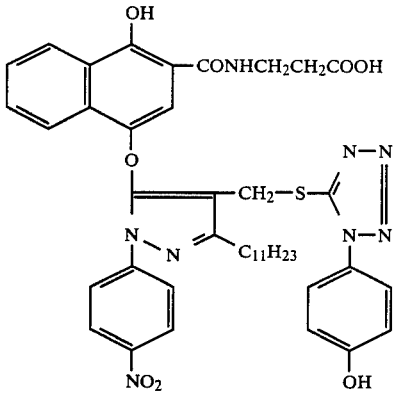

Colored Magenta Coupler CM-2

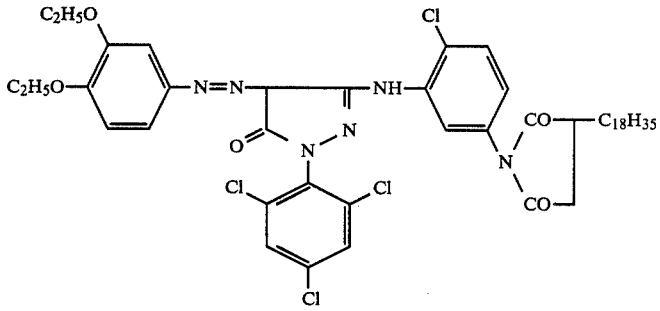

Yellow Coupler Y-2

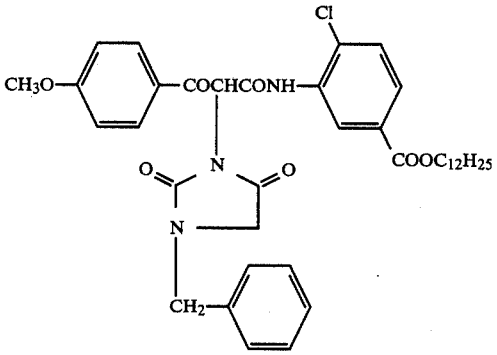

UV Absorbing Agent UV-1

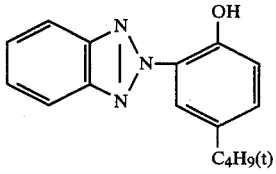

UV Absorbing Agent UV-2

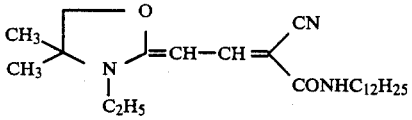

Formalin Scavenger HS-1

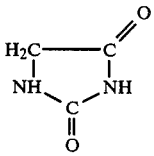

Gelatin Hardening Agent H-1

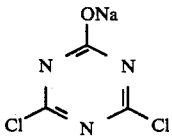

Gelatin Hardening Agent H-2

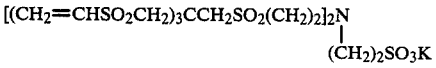

Sample 91 was prepared in the above manner, and further Samples No. 92 through No. 104 were prepared in similar manner except that the coupler-dispersed product in the Layer 7 of Sample 91 was replaced as given in Table 8 or Compounds [I] were newly added for the fog-prevention purpose to Layers 6 to 8.

As for the adding amount, the coupler-dispersed liquid was added in the same amount, and Compound [I] in an amount of $1\times10^{-4}$ mole/mole of AgX to Layer 7 and $4\times10^{-3}$/mole AgX to Layers 6 to 8, and Compound [II] in an amount of $2\times10^{-3}$ mole/mole of AgX.

In addition, the adding amount of the following antifoggant to Sample 91 (comparative) is 20 mg/mole of AgX.

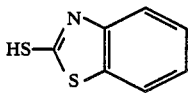

One part of each of the thus prepared Samples No. 91 to No. 104 was allowed to stand for 4 days under the atmospheric condition of 55° C./22%RH, and the other was subjected to no treatment, and they were each exposed through a wedge to a white light and then processed in the same manner as in Example-2.

The color image formed on each of the above-processed Samples No. 91 to No. 104 was measured by means of a densitometer to find the green fog value and green color sensitivity thereof. The sensitivity of each sample was found in terms of a relative speed to the speed of the non-treated Sample 91 regarded as 100, provided however that, in each 55° C./22%RH-treated sample, its fog value was expressed in terms of Δfog value (55° C./22%RH-nontreatment) and the relative speed was expressed in variation percent, [(55° C./22%RH treatment/nontreatment)-1]×100.

TABLE 8

| Sample No. | Magenta coupler | Compound [I] Ex. No. | Compound [I] Layer | Nontreatment G fog | Nontreatment G speed | 55° C./22% RH 4 days G speed | 55° C./22% RH 4 days Variation % | Remarks |
|---|---|---|---|---|---|---|---|---|
| 91 | Ex. 4 | Comp-1 | Layer 7 | 0.47 | 100 | +0.23 | −25.0 | Noninvention |
| 92 | " | I-17 | " | 0.45 | 125 | +0.23 | −10.3 | Invention |
| 93 | " | I-29 | " | 0.45 | 125 | +0.09 | −10.5 | " |
| 94 | " | I-35 | " | 0.46 | 120 | +0.10 | −11.2 | " |
| 95 | " | I-17 | Layer 6 | 0.45 | 125 | +0.09 | −10.8 | " |
| 96 | " | I-29 | " | 0.46 | 120 | +0.10 | −12.0 | " |
| 97 | " | I-35 | " | 0.46 | 120 | +0.10 | −11.8 | " |
| 98 | " | I-17 | Layer 8 | 0.46 | 125 | +0.10 | −10.5 | " |
| 99 | " | I-17<br>II-17 | Layer 7 | 0.44 | 130 | +0.07 | −8.7 | " |
| 100 | " | I-29<br>II-17 | " | 0.45 | 130 | +0.07 | −8.5 | " |
| 101 | Ex. 45 | I-17 | " | 0.45 | 120 | +0.09 | −10.9 | " |
| 102 | " | I-29 | " | 0.48 | 125 | +0.09 | −11.5 | " |
| 103 | Ex. 8 | I-17 | " | 0.46 | 120 | +0.09 | −10.7 | — |
| 104 | " | I-29 | " | 0.46 | 120 | +0.08 | −12.1 | " |

As is apparent from Table 8, the samples of this invention are highly sensitive and excellent in the preservability.

EXAMPLE-9

The following compositions-having respective layers were formed on a triacetyl cellulose film support in order from the support side to prepare a Sample 105, and multilayer color light-sensitive material Samples No. 105 through No. 117 were prepared with the Sample 105 regarded as reference as in Example-8.

Sample 105 (reference or comparative):

Layer 1: Antihalation layer (HC-2):
A black colloidal silver-containing gelatin layer Layer 2: Intermediate layer (I.L.):
A gelatin layer Layer 3: Low-speed red-sensitive silver halide emulsion layer (RL-2):
AgBrI monodisperse emulsion (Emulsion V), mean grain size ($\bar{r}$) 0.80 μm, containing 9 mole% AgI, and AgBrI monodisperse emulsion (Emulsion VI), mean grain size ($\bar{r}$) 0.4 μm, containing 8 mole% AgI . . . Coating amount of silver; 1.7 g/m².
Sensitizing Dye I . . .
$2.5\times10^{-4}$ mole per mole of silver
Sensitizing Dye II . . .
$1.3\times10^{-4}$ mole per mole of silver
Cyan Coupler (C-3) . . .
0.08 mole per mole of silver
Colored Cyan Coupler (CC-2) . . .
0.004 mole per mole of silver
DP' scavenger (Cs-13) . . .
0.0005 mole per mole of silver Layer 4: Intermediate layer (I.L.):
A gelatin layer.

Layer 5: Low-speed green-sensitive silver halide emulsion layer (GL-2):

Emulsion-V, Emulsion-VI } . . . Coating amount of silver 1.7 g/m²

Sensitizing Dye III . . .
$1.9\times10^{-4}$ mole per mole of silver
Sensitizing Dye VI . . .
$1.9\times10^{-4}$ mole per mole of silver
Magenta coupler (Exemplified Compound 4) . . .
0.06 mole per mole of silver
Colored Magenta Coupler (CM-2) . . .
0.012 mole per mole of silver Layer 6: Intermediate layer (I.L.):
A gelatin layer.

Layer 7: Low-speed blue-sensitive silver halide emulsion layer (BL-2):
Emulsion-V . . . Coating amount of silver 1.0 g/m²
Sensitizing Dye VII . . .
$4.2\times10^{-4}$ mole per mole of silver
Yellow Coupler (Y-2) . . .
0.06 mole per mole of silver
DP' scavenger (Cs-13) . . .
0.004 mole per mole of silver Layer 8: Intermediate layer (I.L.):
A gelatin layer containing an emulsified product of D-5.

Layer 9: High-speed red-sensitive silver halide emulsion layer (RH-2):
AgBrI monodisperse emulsion (Emulsion VII), mean grain size (r) 1.2 μm, containing 7.0 mole% AgI and AgBrI monodisperse emulsion (Emulsion VIII), mean grain size (r) 0.3 μm, containing 2.0 mole% AgI . . . Coating amount of silver 2.1 g/m².

Sensitizing Dye I . . .

$1.3\times10^{-4}$ mole per mole of silver

Sensitizing Dye II . . .

$6.3\times10^{-5}$ mole per mole of silver

Cyan Coupler (C-4) . . .

0.015 mole per mole of silver

Cyan Coupler (C-5) . . .

0.015 mole per mole of silver

Colored Cyan Coupler (CC-2) . . .

0.002 mole per mole of silver

DP' scavenger (Cs-13) . . .

0.004 mole per mole of silver

Layer 10: Intermediate layer (I.L.):

A gelatin layer containing emulsified dispersion products of D-5 and CM-3.

Layer 11: High-speed green-sensitive silver halide emulsion layer (GH-2):

AgBrI monodisperse emulsion (Emulsion IX), mean grain size (r) 1.6 μm, containing 9.0 mole% AgI . . .

Coating amount of silver 2.4 g/m²

Sensitizing Dye V . . .

$7.0\times10^{-5}$ mole per mole of silver

Sensitizing Dye VI . . .

$7.0\times10^{-5}$ mole per mole of silver

Magenta coupler (Exemplified Compound 4) . . .

0.020 mole per mole of silver

Colored Magenta Coupler (CM-2) . . .

0.002 mole per mole of silver

Layer 12 Gelatin layer:

A gelatin layer containing an emulsified dispersion product of D-4.

Layer 13 High-speed blue-sensitive silver halide emulsion layer (BH-2):

Emulsion-IX and Emulsion-V and AgBrI monodisperse emulsion (Emulsion-X), mean grain size 0.08 μm, containing 1.0 mole% AgI . . .

Coating amount of silver: 2.1 g/m²

Sensitizing Dye VII . . .

$1.9\times10^{-4}$ mole per mole of silver

Yellow Coupler (Y-2) . . .

0.08 mole per mole of silver

DIR Compound (D-2) . . .

0.0007 mole per mole of silver

Layer 14: First Protective Layer (Pro-3)

A gelatin layer containing AgBrI, mean grain size 0.07 μm, containing 1 mole% AgI and Ultraviolet Absorbing agents UV-1 and UV-2.

Layer 15: Second protective layer (Pro-4):

A gelatin layer containing methyl methacrylate particles (diameter 1.5 μm) and formalin scavenger (HS-1).

Further, to each of the above layers were added gelain hardening agents (H-1) and (H-2) and a surface active surfactant in addition to the above compositions.

Colored Magenta Coupler CM-3

-continued

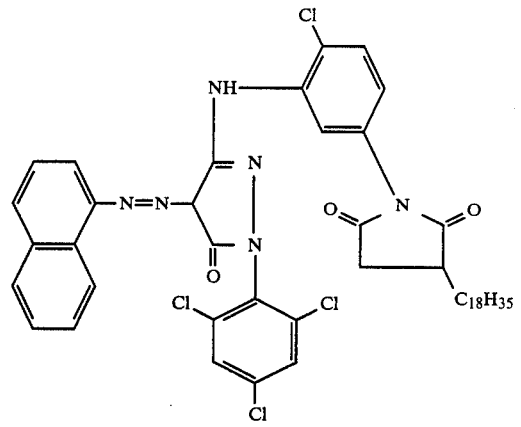

DP' scavenger Cs-13

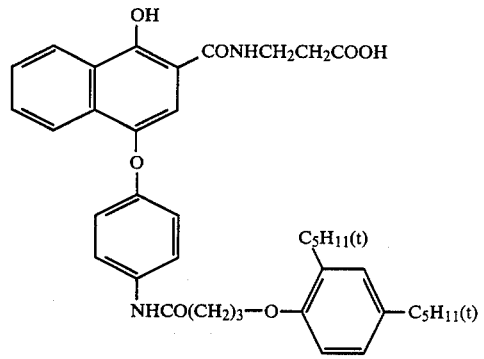

Sample No. 105 was thus prepared, and further Compounds [I] or [II] were newly combinedly added to Layers 5, 11 and 12 of the Sample No. 105 for the fog prevention purpose, whereby Samples No. 106 through No. 117 were prepared.

As for the adding amount, these antifoggants were added in an amount of $1\times10^{-3}$ mole/mole of AgX to Layers 5 and 11, and of $4\times10^{-4}$ mole/mole of AgX to Layer 12.

Where the antifoggant II-17 was combinedly used, the adding amount thereof is $2\times10^{-3}$ mole/mole of AgX, and $7\times10^{-4}$ mole/m² to Layer 12.

The adding amount of the above antifoggant used in the comparative sample was 20 mg/mole of AgX.

One part of each of the thus prepared Samples No. 105 to No. 117 was treated under the condition of 55° C./22%RH and the other was subjected to no treatment, and they were each exposed through a wedge to a white light, and then processed in the same manner as in Example-2.

The color image formed on each of the processed Samples No. 105 to No. 117 was measured by use of a densitometer to thereby find the green fog value and green sensitivity thereof, provided however that, in the 55° C./22%RH-treated sample, the fog value was expressed in terms of Δfog value (55° C./22%RH treatment-nontreatment) and the relative speed was expressed in terms of variation percent. [(55° C./22%RH treatment/nontreatment)-1]×100.

TABLE 9

| Sample No. | Compound [I], [II] Compound No. | Added Layer | Nontreatment G fog value | Relative G speed | 55° C./22% RH 4 days G Δ fog value | Variation % | Remarks |
|---|---|---|---|---|---|---|---|
| 105 | Comp.-1 | Layer 11 | 0.58 | 100 | +0.28 | −27.0 | Noninvention |
| 106 | I-17 | " | 0.56 | 125 | +0.12 | −15.1 | Invention |
| 107 | I-29 | " | 0.56 | 120 | +0.12 | −14.8 | " |
| 108 | I-35 | " | 0.57 | 120 | +0.11 | −15.4 | " |
| 109 | I-17 | Layer 12 | 0.56 | 120 | +0.11 | −14.5 | " |
| 110 | I-17 | Layers 5, 11 | 0.54 | 125 | +0.10 | −13.1 | " |
| 111 | I-29 | Layers 5, 11 | 0.54 | 120 | +0.11 | −12.8 | " |
| 112 | I-35 | Layers 5, 11 | 0.54 | 120 | +0.10 | −12.0 | " |
| 113 | I-17 II-17 | Layer 11 | 0.53 | 130 | +0.10 | −12.1 | " |
| 114 | I-29 II-17 | " | 0.54 | 130 | +0.09 | −12.0 | " |
| 115 | I-35 II-17 | " | 0.54 | 130 | +0.08 | −12.0 | " |
| 116 | I-17 II-17 | Layer 12 | 0.54 | 130 | +0.08 | −12.3 | " |
| 117 | I-17 II-17 | Layers 5, 12 | 0.52 | 125 | +0.07 | −11.7 | " |

As is apparent from Table 9, the Samples No. 106 to No. 117 of this invention are highly sensitive and excellent in restraining the possible increase in fog and deterioration of the sensitivity by heat during the storage thereof.

EXAMPLE-10

The Samples 91, 92, 96 and 99 that were used in Example-8 were each cut into 35 mm wide×120 cm long-size pieces and loaded into several film cartridges at the same time in the dark.

These loaded film samples were allowed to stand separately for three days under the atmospheric conditions of relative humidities of 45%, 53%, 57% and 62% at 25° C., and after that, these cartridge-loaded film samples were put in polypropylene cartridge cases under the respective atmospheric conditions, and the cases were hermetically sealed. These cartridge case-loaded samples were left intact for seven days at a temperature of 60° C.

On the other hand, the rest of the above-loaded samples was allowed to stand for seven days at 5° C. which does not substantially cause it to change with time.

After that, the samples that were left for 7 days at 60° C. and the one that was left for seven days at 5° C. were exposed and the color-developed in the same manner as in Example-2.

Subsequently, the respective samples measured using a red light to find their fog values, and the respective fog values' variation widths, i.e., the values obtained by deducting the fog value of the sample that was left for seven days at 5° C. from the values of the samples that were left for seven days at 60° C., are shown in Table 10.

TABLE 10

| % RH | Sample No. 91 | 92 | 96 | 99 |
|---|---|---|---|---|
| 45 | 0.35 | 0.18 | 0.18 | 0.17 |
| 53 | 0.39 | 0.21 | 0.21 | 0.21 |

TABLE 10-continued

| % RH | Sample No. 91 | 92 | 96 | 99 |
|---|---|---|---|---|
| 57 | 0.42 | 0.29 | 0.30 | 0.30 |
| 62 | 0.47 | 0.36 | 0.36 | 0.38 |

As is shown in Table 10, it is apparent that the present invention displays favorable effects even in the high humidity.

EXAMPLE-11

The following reference sample 121, as a mother material, was used, to specific layers of which were added Compounds having Formula [I] and DP' scavengers or comparative compounds as shown in Table 10, whereby Samples for this invention and Comparative Samples 121 to 141 were prepared.

The Sample 121 was prepared in the same manner as that of Sample 91 in Example-8 except that the Layer 2 and Layer 8 contain no emulsified dispersion product of 2,5-dioctyl-hydroquinone.

Each of the thus prepared Samples No. 121 to No. 141 was exposed through a wedge to a red light, and then processed in the same manner as in Example-2.

The color image formed on each of the processed Samples No. 121 to No. 141 was measured by a densitometer using a red light to find the fog value and sensitivity to red thereof. In addition, the sensitivity is a value of the reciprocal of the exposure that provides the minimum density+0.1 and is expressed in a relative value to the value of Sample 121 regarded as 100. Also, in order to evaluate the graininess, the dye image of each sample having a density of Dmin+0.6 obtained by measuring using a red light was scanned by the 250 $\mu m^2$-area circular head of a microdensitometer, and the 1000-fold value of the standard deviation of the variation of the desity values obtained by the microdensitometer scanning is shown in terms of a relative value of each sample to the value of Sample 121 as regarded as 100. The results are shown in Table 11.

TABLE 11

| Sample No. | DP' Scavenger Compound No. | Compound-added layer and adding amount | Compound [II] Compound No. | Compound-added layer and adding amount | Remarks |
|---|---|---|---|---|---|
| 121 | — | — | — | — | Reference |
| 122 | H-8 | Layer 4 ($1.5 \times 10^{-4}$ mol/m$^2$) | — | — | Comparative |

TABLE 11-continued

| Sample No. | Compound No. | DP' Scavenger Compound-added layer and adding amount | Compound [II] Compound No. | Compound-added layer and adding amount | Remarks |
|---|---|---|---|---|---|
| 123 | P-8 | Layer 4 ($1.5 \times 10^{-4}$ mol/m$^2$) | — | — | " |
| 124 | S-1 | Layer 4 ($1.5 \times 10^{-4}$ mol/m$^2$) | — | — | " |
| 125 | Cs-12 | Layer 4 ($1.5 \times 10^{-4}$ mol/m$^2$) | — | — | " |
| 126 | H-8 | Layer 4 ($1.5 \times 10^{-4}$ mol/m$^2$) | Comp. Compound-h | Layer 4 ($5 \times 10^{-4}$ mol/AgX mol) | " |
| 127 | P-8 | Layer 4 ($1.5 \times 10^{-4}$ mol/m$^2$) | Comp. Compound-h | Layer 4 ($5 \times 10^{-4}$ mol/AgX mol) | " |
| 128 | Ss-1 | Layer 4 ($1.5 \times 10^{-4}$ mol/m$^2$) | Comp. Compound-h | Layer 4 ($5 \times 10^{-4}$ mol/AgX mol) | " |
| 129 | Cs-12 | Layer 4 ($1.5 \times 10^{-4}$ mol/m$^2$) | Comp. Compound-h | Layer 4 ($5 \times 10^{-4}$ mol/AgX mol) | " |
| 130 | Cs-12 | Layer 4 ($1.5 \times 10^{-4}$ mol/m$^2$) | Comp. Compound-i | Layer 4 ($5 \times 10^{-4}$ mol/AgX mol) | " |
| 131 | Cs-12 | Layer 5 ($4 \times 10^{-4}$ mol/m$^2$) | — | — | " |
| 132 | Cs-12 | Layer 5 ($4 \times 10^{-4}$ mol/m$^2$) | Comp. Compound-h | Layer 4 ($5 \times 10^{-4}$ mol/AgX mol) | " |
| 133 | H-8 | Layer 4 ($1.5 \times 10^{-4}$ mol/m$^2$) | I-17 | Layer 4 ($1.0 \times 10^{-3}$ mol/AgX mol) | Invention |
| 134 | P-8 | Layer 4 ($1.5 \times 10^{-4}$ mol/m$^2$) | I-17 | Layer 4 ($1.0 \times 10^{-3}$ mol/AgX mol) | " |
| 135 | S-1 | Layer 4 ($1.5 \times 10^{-4}$ mol/m$^2$) | I-17 | Layer 4 ($1.0 \times 10^{-3}$ mol/AgX mol) | " |
| 136 | Cs-12 | Layer 4 ($1.5 \times 10^{-4}$ mol/m$^2$) | I-17 | Layer 4 ($1.0 \times 10^{-3}$ mol/AgX mol) | " |
| 137 | Cs-12 | Layer 4 ($1.5 \times 10^{-4}$ mol/m$^2$) | I-29 | Layer 4 ($5 \times 10^{-4}$ mol/AgX mol) | " |
| 138 | Cs-12 | Layer 4 ($1.5 \times 10^{-4}$ mol/m$^2$) | I-35 | Layer 4 ($1.0 \times 10^{-3}$ mol/AgX mol) | " |
| 139 | Cs-12 | Layer 4 ($1.5 \times 10^{-4}$ mol/m$^2$) | I-17 | Layer 4 ($1.0 \times 10^{-3}$ mol/AgX mol) | " |
| | | | II-18 | Layer 4 ($1.0 \times 10^{-3}$ mol/AgX mol) | " |
| 140 | Cs-12 | Layer 5 ($4 \times 10^{-4}$ mol/m$^2$) | I-17 | Layer 4 ($1.0 \times 10^{-3}$ mol/AgX mol) | " |
| 141 | Cs-12 | Layer 4 ($1.5 \times 10^{-4}$ mol/m$^2$) | I-17 | $1 \times 10^{-3}$ mol/AgX mol each for Layer 3 and Layer 4. $2 \times 10^{-4}$ mol/m$^2$ for Layer 5. | " |

Comparative Compound-h

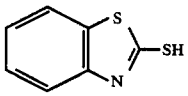

Comparative Compound-i

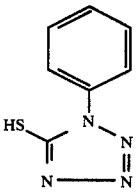

TABLE 12

| Sample No. | Untreated (R) Fog value | Untreated (R) Relative speed | Untreated (R) Relative RMS value | 55° C./20% RH 4 days (R) Fog value | 55° C./20% RH 4 days (R) Relative speed | Remarks |
|---|---|---|---|---|---|---|
| 121 | 0.15 | 100 | 100 | 0.35 | 80 | Reference |
| 122 | 0.17 | 105 | 92 | 0.44 | 65 | Comparative |
| 123 | 0.16 | 95 | 87 | 0.46 | 60 | " |
| 124 | 0.18 | 100 | 89 | 0.43 | 70 | " |
| 125 | 0.16 | 105 | 85 | 0.42 | 65 | " |
| 126 | 0.16 | 85 | 93 | 0.39 | 75 | " |
| 127 | 0.15 | 80 | 86 | 0.40 | 70 | " |
| 128 | 0.14 | 75 | 90 | 0.38 | 70 | " |
| 129 | 0.14 | 65 | 92 | 0.35 | 60 | " |
| 130 | 0.13 | 70 | 89 | 0.37 | 65 | " |
| 131 | 0.15 | 95 | 92 | 0.40 | 80 | " |
| 132 | 0.14 | 65 | 95 | 0.36 | 55 | " |
| 133 | 0.15 | 95 | 85 | 0.29 | 90 | Invention |
| 134 | 0.15 | 100 | 81 | 0.30 | 95 | " |
| 135 | 0.16 | 105 | 85 | 0.29 | 95 | " |
| 136 | 0.14 | 110 | 72 | 0.20 | 110 | " |
| 137 | 0.14 | 95 | 74 | 0.21 | 95 | " |
| 138 | 0.15 | 105 | 79 | 0.26 | 105 | " |
| 139 | 0.14 | 100 | 70 | 0.19 | 105 | " |
| 140 | 0.13 | 105 | 78 | 0.18 | 110 | " |
| 141 | 0.13 | 100 | 72 | 0.18 | 100 | " |

EXAMPLE-12

In the same manner as in Example-11, Sample 142 was used as the reference sample, the following compositions-having layers were formed on a triacetyl cellulose film support in order from the support side, whereby multilayer color light-sensitive material samples were prepared. Sample 142 (reference)

Layer 1: Antihalation layer (HC-2):
A black colloidal silver-containing gelatin layer Layer 2: Intermediate layer (I.L.)
A gelatin layer Layer 3: Low-speed red-sensitive silver halide emulsion layer (RL-2):
AgBrI monodisperse emulsion (Emulsion V), mean grain size ($\bar{r}$) 0.80 μm, containing 9 mole% AgI and AgBrI monodisperse emulsion (Emulsion VI), mean grain size ($\bar{r}$) 0.4 μm, containing 8 mole% AgI . . . Coating amount of silver 1.7 g/m$^2$.
Sensitizing Dye I . . .
$2.5\times10^{-4}$ mole per mole of silver
Sensitizing Dye II . . .
$1.3\times10^{-4}$ mole per mole of silver
Cyan Coupler (C-3) . . .
0.08 mole per mole of silver
Colored Cyan Coupler (CC-2) . . .
0.004 mole per mole of silver
DP' scavenger (Cs-13) . . .
0.0005 mole per mole of silver Layer 4: Intermediate layer (I.L.):
A gelatin layer Layer 5: Low-speed green-sensitive silver halide emulsion layer (GL-2):

Emulsion-V, Emulsion-VI . . . Coating amount of silver 1.7 g/m$^2$

Sensitizing Dye III . . .
$1.9\times10^{-4}$ mole per mole of silver
Sensitizing Dye IV . . .
$1.9\times10^{-4}$ mole per mole of silver
Magenta Coupler (M-1) . . .
0.06 mole per mole of silver
Colored Magenta Coupler (CM-2) . . .
0.012 mole per mole of silver Layer 6: Intermediate layer (I.L.):
A gelatin layer Layer 7: Low-speed blue-sensitive silver halide emulsion layer (BL-2):
Emulsion-V . . . Coating amount of silver 1.0 g/m$^2$
Sensitizing Dye V . . .
$4.2\times10^{-4}$ mole per mole of silver
Yellow Coupler (Y-2) . . .
0.06 mole per mole of silver
DP' scavenger (Cs-13) . . .
0.004 mole per mole of silver Layer 8: Intermediate layer (I.L):
A gelatin layer Layer 9: High-speed red-sensitive silver halide emulsion layer (RH-2):
AgBrI monodisperse emulsion (Emulsion VII), mean grain size (r) 1.2 μm, containing 7.0 mole% AgI and AgBrI monodisperse emulsion (Emulsion VIII), mean grain size (r) 0.3 μm, containing 2.0 mole% AgI . . . Coating amount of silver 2.1 g/m$^2$.
Sensitizing Dye I . . .
$1.3\times10^{-4}$ mole per mole of silver
Sensitizing Dye II . . .
$6.3\times10^{-5}$ mole per mole of silver
Cyan Coupler (C-3) . . .
0.015 mole per mole of silver
Cyan Coupler (C-4) . . .
0.015 mole per mole of silver
Colored Cyan Coupler (CC-2) . . .
0.002 mole per mole of silver
DP' scavenger (Cs-13) . . .
0.004 mole per mole of silver Layer 10: Intermediate layer (I.L.):
A gelatin layer containing an emulsified dispersion product of CM-3

Layer 11: High-speed green-sensitive silver halide emulsion layer (GH-2):
AgBrI monodisperse emulsion (Emulsion IX), means grain size ($\bar{r}$) 1.6 μm, containing 9.0 mole% AgI . . .
Coating amount of silver 2.4 g/m2
Sensitizing Dye III . . .
$7.0\times10^{-5}$ mole per mole of silver
Sensitizing Dye IV . . .
$7.0\times10^{-5}$ mole per mole of silver
Magenta Coupler (M-2) . . .
0.020 mole per mole of silver
Colored Magenta Coupler (CM-2) . . .
0.002 mole per mole of silver Layer 12: Gelatin layer Layer 13: High-speed blue-sensitive silver halide emulsion layer (BH-2):
Emulsion-IX and Emulsion-V and AgBrI monodisperse emulsion (Emulsion-X), means grain size 0.08 μm,
containing 1.0 mole% AgI . . . .
Coating amount of silver 2.1 g/m$^2$
Sensitizing Dye V . . .
$1.9\times10^{-4}$ mole per mole of silver
Yellow Coupler (Y-2) . . .
0.08 mole per mole of silver
DIR Compound (D-2) . . .
0.0007 mole per mole of silver Layer 14: First protective layer (Pro-3):
A gelatin layer containing AgBrI, mean grain size 0.07 μm, containing 1 mole% AgI . . . .
Coating amount of silver 0.2 g/m$^2$, and
Ultraviolet Absorbing Agents UV-1 and UV-2.

Layer 15: Second protective layer (Pro-4):
A gelatin layer containing polymethacrylate particles (diameter 1.5 μm) and formalin scavenger (HS-1).

Further, to each of the above layers were added gelatin hardening agents (H-1) and (H-2) and a surface active agent in addition to the above compositions.

Colored Magenta Coupler CM-3:

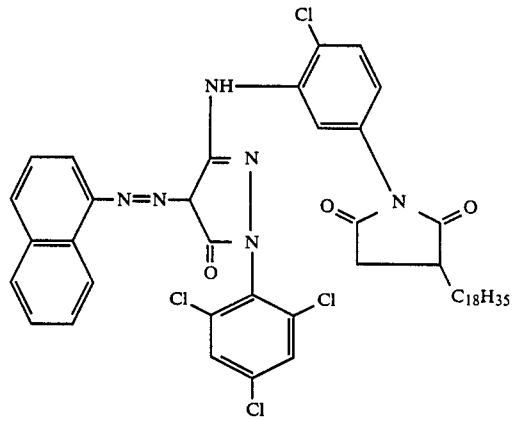

The Layers 8 through 12 of Sample 142 were altered as shown in Table 13, whereby Sample 143 to 156 were prepared.

These samples were processed in the same manner as in Example-2, and then each was evaluated with respect to the fog, relative speed and graininess thereof. The results are as given in Table 14.

TABLE 13

| Sample No. | DP' scavenger Compound No. | DP' scavenger Added (Adding amount) layer | Compound [I] Compound No. | Compound [I] Added (Adding amount) layer | Remarks |
|---|---|---|---|---|---|
| 142 | — | — | — | — | Reference |
| 143 | C-12 | Layer 9 ($3 \times 10^{-4}$ mol/m$^2$) | — | — | Comparative |
| 144 | C-15 | Layer 9 ($3 \times 10^{-4}$ mol/m$^2$) | — | — | " |
| 145 | C-21 | Layer 9 ($3 \times 10^{-4}$ mol/m$^2$) | — | — | " |
| 146 | C-12 | ($1 \times 10^{-4}$ mol/m$^2$ each for) Layer 8 Layer 10 | — | — | " |
| 147 | C-12 | Layer 9 ($3 \times 10^{-4}$ mol/m$^2$) | Comp. Compound-1 | Layer 9 ($2 \times 10^{-4}$ mol/AgX mol) | " |
| 148 | C-15 | Layer 9 ($3 \times 10^{-4}$ mol/m$^2$) | Comp. Compound-1 | Layer 9 ($2 \times 10^{-4}$ mol/AgX mol) | " |
| 149 | C-21 | Layer 9 ($3 \times 10^{-4}$ mol/m$^2$) | Comp. Compound-1 | Layer 9 ($2 \times 10^{-4}$ mol/AgX mol) | " |
| 150 | C-12 | ($1 \times 10^{-4}$ mol/m$^2$ each for) Layer 8 Layer 10 | Comp. Compound-1 | Layer 9 ($2 \times 10^{-4}$ mol/AgX mol) | " |
| 151 | C-12 | Layer 9 ($3 \times 10^{-4}$ mol/m$^2$) | I-17 | Layer 9 ($5 \times 10^{-4}$ mol/AgX mol) | Invention |
| 152 | C-12 | Layer 9 ($3 \times 10^{-4}$ mol/m$^2$) | I-29 | Layer 9 ($3 \times 10^{-4}$ mol/AgX mol) | " |
| 153 | C-15 | Layer 9 ($3 \times 10^{-4}$ mol/m$^2$) | I-17 | Layer 9 ($5 \times 10^{-4}$ mol/AgX mol) | " |
| 154 | C-21 | Layer 9 ($3 \times 10^{-4}$ mol/m$^2$) | I-29 | Layer 9 ($3 \times 10^{-4}$ mol/AgX mol) | " |
| 155 | C-12 | ($1 \times 10^{-4}$ mol/m$^2$ each for) Layer 8 Layer 10 | I-17 | Layer 9 ($5 \times 10^{-4}$ mol/AgX mol) | " |
| 156 | C-12 | ($1 \times 10^{-4}$ mol/m$^2$ each for) Layer 8 Layer 10 | I-17<br>II-18 | Layer 9 ($5 \times 10^{-4}$ mol/AgX mol)<br>($1.0 \times 10^{-3}$ mol/AgX mol) | " |

TABLE 14

| Sample No. | Untreated Fog value | Untreated Relative speed | Untreated Relative RMS value | 55° C./20% RH 3 days Fog value | 55° C./20% RH 3 days Relative RMS value | Remarks |
|---|---|---|---|---|---|---|
| 142 | 0.21 | 100 | 100 | 0.48 | 65 | Reference |
| 143 | 0.23 | 105 | 79 | 0.83 | 45 | Comparative |
| 144 | 0.22 | 95 | 85 | 0.70 | 55 | " |
| 145 | 0.24 | 95 | 82 | 0.78 | 65 | " |
| 146 | 0.22 | 100 | 85 | 0.64 | 50 | " |
| 147 | 0.27 | 55 | 83 | 0.60 | 50 | " |
| 148 | 0.21 | 65 | 92 | 0.61 | 55 | " |
| 149 | 0.23 | 70 | 83 | 0.63 | 65 | " |
| 150 | 0.23 | 75 | 80 | 0.53 | 65 | " |
| 151 | 0.20 | 110 | 65 | 0.32 | 100 | Invention |
| 152 | 0.19 | 105 | 67 | 0.30 | 95 | " |
| 153 | 0.21 | 95 | 74 | 0.38 | 95 | " |
| 154 | 0.21 | 95 | 72 | 0.36 | 90 | " |
| 155 | 0.20 | 110 | 68 | 0.29 | 105 | " |
| 156 | 0.19 | 105 | 65 | 0.27 | 105 | " |

From the results shown in Table 13 and Table 14 the following things are concluded:

(1) When the DP' scavenger is used alone, although the improvement in the graininess is recognized, the fog is increased at a high temperature. This is a serious problem for the photographic characteristics.

(2) Where an antifoggant other than the one of this invention is used in order to remove the disadvantage of (1), it causes the sensitivity to be largely deteriorated and hardly contributes to the improvement on the preservability of the light-sensitive material.

(3) We have derived such better effects than expected that, only when the DP' scavenger and compound having Formula of this invention are combinedly used, the sensitivity is retained and the preservability and graininess can be improved (and what is more, there are cases where the sensitivity is increased).

EXAMPLE-13

The Samples No. 129, 130, 138 and 140 which were used in Example-11 were each cut into several 3.5 cm wide×120 cm long size pieces, and these pieces were loaded into film cartridges at the same time in the dark.

These cartridge-loaded pieces, after being allowed to stand separately for three days under the atmospheric condition of humidities of 45%, 53%, 57% and 62% at 25° C., were put in polypropylene cartridge cases under the respective atmospheric conditions, and then hermetically sealed. These cartridge case-loaded samples were left intact for seven days at 60° C.

On the other hand, the rest of the samples were allowed to stand for seven days at 5° C. which does not substantially cause it to change with time.

Subsequently, the samples that were left for seven days at 60° C. and the one that was left for seven days at 5° C. were each imagewise exposed and the color-developed in the same manner as in Example-1.

After that, these samples each was measured with respect to the fog value thereof. The variation widths of the fog values found in the respective samples; i.e., the values obtained by deducting the fog value of the sample that was left for seven days at 5° C. from the values of the samples that were left for seven days at 60° C., are shown in the following Table 15.

TABLE 15

| Sample No.<br>% RH | 129<br>(Comp.) | 130<br>(Comp.) | 138<br>(Inv.) | 140<br>(Inv.) |
|---|---|---|---|---|
| 45 | 0.34 | 0.36 | 0.12 | 0.11 |
| 53 | 0.40 | 0.45 | 0.18 | 0.15 |
| 57 | 0.48 | 0.51 | 0.25 | 0.23 |
| 62 | 0.58 | 0.60 | 0.36 | 0.31 |

As is apparent from Table 15, the effect of Sample No. 138 and No. 140 was clearly confirmed even under the conditions much severer than those in Example-11. Particularly, when placed under the condition of a relative humidity of not more than 55%, the excellence of these samples in the preservability is significant.

EXAMPLE-14

Two different twin-crystal emulsions, as shown in Table 16, having a uniform silver iodide composition (called A-1, 2) were prepared in the following manner:

To a solution containing 1% gelain and potassium bromide, with stirring at 60 C., was added a mixture of a silver nitrate solution, potassium iodide and potassium bromide by the double-jet method. The silver iodide content was adjusted under the control of the amount of the potassium iodide, and the grain size was adjusted by changing the adding time in the range of from 20 to 90 minutes.

TABLE 16

| Emulsion sample | Silver iodide content (%) | Mean grain size (μ) | Width of distribution (%) |
|---|---|---|---|
| A-1 | 7 | 0.74 | 36 |
| A-2 | 4 | 0.77 | 38 |

Subsequently, the three different light-sensitive core/shell-type silver halide emulsions shown in Table 17 (called B-1, 2 3) were prepared in the following manner:

To a solution containing 1% gelatin and potassium bromide, with stirring at 60° C., was added a mixture solution-(1) of a silver nitrate solution with potassium iodide and potassium bromide by the double-jet method, whereby a core portion was prepared. After that, a mixture solution-(2) of a silver nitrate solution and potassium bromide with a smaller amount of potassium iodide than that of the potassium iodide in the solution-(1) or without potassium iodide was added by the double-jet method, whereby a shell portion was prepared. The produced grains were all in the twin form.

TABLE 17

| Emulsion sample | Mean grain size (μ) | Distribution width (%) | Silver iodide content (%) Core | Shell | % by vol. of shell to grain |
|---|---|---|---|---|---|
| B-1 | 0.75 | 35 | 5 | 0 | 40 |
| B-2 | 0.77 | 36 | 17 | 0 | 70 |
| B-3 | 0.76 | 36 | 11 | 2 | 40 |

The five different monodisperse core/shell-type emulsions (called B-4, 5, 6, 7 and 8) shown in Table 18 will subsequently be illustrated bellow:

Firstly, seed crystal grains having a silver iodide content of 2.0 mole% and grain sizes of 0.10μ and 0.30μ were prepared by the acid method. The seed emulsion was used to prepare, making reference to Japanese Patent O.P.I. Publication Nos. 48521/1979 and 49938/1983, core and shell by the double-jet method with the pAg and pH being controlled in the presence of ammonia. The grain size was adjusted by the selection of seed grains and the adding amount of silver, and the compositions of the core, intermediate stratum, and shell were adjusted by changing the composition of the halide solution to be added.

As for B-6 and B-8, the growth of the grains thereof was made in the presence of 4-hydroxy-6-methyl-1,3,3a,7-tetrazaindene in a quantity of 0.15 g per mole of silver halide for the purpose of raising the monodispersibility.

TABLE 18

| EM sample | Mean grain size (μ) | Distribution width (%) | Silver iodide content (%) Core | Interstratum | shell | % by vol. of shell and/or interstratum to whole grain | Form of grain |
|---|---|---|---|---|---|---|---|
| B-4 | 0.75 | 14 | 8 | | 0 | 30 | Tetradecahedron |
| B-5 | 0.75 | 13 | 11 | | 2 | 40 | Octahedron |
| B-6 | 0.75 | 10 | 14 | | 1 | 45 | Octahedron |
| B-7 | 0.75 | 13 | 15 | 5 | 2 | Inter: 30<br>Shell: 35 | Tetradecahedron |
| B-8 | 0.75 | 10 | 17 | 6 | 0.5 | Inter: 35<br>Shell: 40 | Octahetron |

Further, two other different monodisperse core/-shell-type emulsions (called B-9 and 10) were prepared in the following manner: To an aqueous solution containing gelain and potassium bromide, with stirring at 40° C., was added a silver nitrate solution to thereby prepare a nucleus emulsion comprised of multitwin crystal grains, and then the emulsion was physically ripened in the presence of ammonia and potassium bromide, whereby a monodisperse spherical-type seed grain emulsion was obtained. This seed emulsion was used to prepare a core/shell emulsion with the pAg and pH controlled in the presence of 4-hydroxy-6-methyl-1,3,3a,7-tetrazaindene by the double-jet method. The compositions of the core and shell were adjusted by changing the composition of the halide solution to be added. (Table 19)

TABLE 19

| Emulsion Sample | Grain size (μ) | Distribution width (%) | Silver iodie content (%) Core | Shell | % by vol. of shell to grain | Form of grain |
|---|---|---|---|---|---|---|
| B-9 | 0.47 | 18 | 10 | 2 | 50 | Twin |
| B-10 | 0.47 | 19 | 15 | 0 | 50 | Twin |

The thus obtained emulsions each was chemically ripened in a manner of the prior art, and also optically sensitized by using a sensitizing dye anhydro-3,3'-di-(3-sulfobutyl)-4,5-benzo-5-methoxythiocyanine, and then each emulsion was divided into several parts, and to these parts were added compounds of this invention, whereby high-speed blue-sensitive emulsions were prepare.

Then, the Emulsions B-11 and B-12 shown in Table 20 were prepared in similar manner to the above described method

TABLE 20

| Emulsion | Mean grain size (μ) | Distribution width (%) | AgI content (%) Core | Inter-stratum | Shell | Ratio by vol. of each stratum Core | Inter-stratum | Shell | Form of Grain |
|---|---|---|---|---|---|---|---|---|---|
| B-11 | 0.35 | 12 | 15 | 5 | 0.3 | 22 | 39 | 27 | Octahedron |
| B-12 | 0.68 | 10 | 15 | 5 | 0.3 | 22 | 39 | 27 | Octahedron |

On a triacetyl cellulose film support were formed the following compositions-having layers in order from the support side, whereby multilayer color photographic element Samples No. 161 to No. 187 were prepared.

Layer 1: Antihalation layer (HC-1):
A black colloidal silver-containing layer.

Layer 2: Intermediate layer (I.L.):
A gelatin layer containing an emulsified dispersion product of 2,5-di-t-octylhydroquinone.

Layer 3: Low-speed red-sensitive silver halide emulsion layer (RL-1):
Emulsion B-11 . . . Coating amount of silver 1.8 g/m$^2$
Sensitizing Dye I . . .
$6\times10^{-5}$ mole per mole of silver
Sensitizing Dye II . . .
$1.0\times10^{-5}$ mole per mole of silver
Cyan Coupler (C-3) . . .
0.006 mole per mole of silver
Colored Cyan Coupler (CC-2) . . .
0.003 mole per mole of silver
DIR Compound (D-2) . . .
0.0015 mole per mole of silver
DIR Compound (D-3) . . .
0.002 mole per mole of silver Layer 4: Emulsion B-12 . . . Coating amount of silver 1.3 g/m$^2$
Sensitizing Dye I . . .
$3\times10^{-5}$ mole per mole of silver
Sensitizing Dye II . . .
$1.0\times10^{-5}$ mole per mole of silver
Cyan Coupler (C-3) . . .
0.02 mole per mole of silver
Colored Cyan Coupler (CC-2) . . .
0.0015 mole per mole of silver
DIR Compound (D-3) . . .
0.001 mole per mole of silver Layer 5: Intermediate layer (I.L.)
A gelatin layer, the same as Layer 2.

Layer 6: Low-speed green-sensitive silver halide emulsion layer (GL-1):
Emulsion B-11 . . . Coating amount of silver 1.5 g/m$^2$
Sensitizing Dye III . . .
$2.5\times10^{-5}$ mole per mole of silver
Sensitizing Dye IV . . .
$1.2\times10^{-5}$ mole per mole of silver
Magenta Coupler (M-2) . . .
0.050 mole per mole of silver
Colored Magenta Coupler (CM-2) . . .
0.009 mole per mole of silver
DIR Compound (D-2) . . .
0.0010 mole per mole of silver
DIR Compound (D-4) . . .
0.0030 mole per mole of silver Layer 7: High-speed green-sensitive silver halide emulsion layer (GH-1):
Emulsion B-12 . . . Coating amount of silver 1.4 g/m$^2$
Sensitizing Dye III . . .
$1.5\times10^{-5}$ mole per mole of silver
Sensitizing Dye IV . . .
$1.0\times10^{-5}$ mole per mole of silver
Magenta Coupler (M-2) . . .
0.020 mole per mole of silver
Colored Magenta Coupler (CM-2) . . .
0.002 mole per mole of silver
DIR Compound (D-4)
0.0010 mole per mole of silver Layer 8: Yellow filter layer (YC-2)
A gelatin layer containing yellow colloidal silver and an emulsified dispersion product of 2,5-di-t-octylhydroquinone.

Layer 9: Low-speed blue-sensitive silver halide emulsion layer (BL-1):
Emulsion B-11 . . . Coating amount of silver 0.9 g/m$^2$
Sensitizing Dye V . . .
$1.3\times10^{-5}$ mole per mole of silver
Yellow Coupler (Y-2) . . .
0.29 mole per mole of silver Layer 10: High-speed blue-sensitive silver halide emulsion layer (BH-1):
Emulsion: An emulsion containing the emulsion shown in Table 20 and compounds of this invention . . . .
Coating amount of silver 0.5 g/m$^2$
Sensitizing Dye V . . .
$1.0\times10^{-5}$ mole per mole of silver
Yellow Coupler (Y-2) . . .
0.08 mole per mole of silver
DIR Compound (D-3) . . .
0.0015 mole per mole of silver Layer 11: First protective layer (Pro-1):
A gelatin layer containing silver iodobromide (containing 1 mole% AgI; mean grain size 0.07 μm) . . . Coating amount of silver 0.5 g/m$^2$ and Ultraviolet Absorbin Agents UV-1 and UV-2.

Layer 12: Second protective layer (Pro-2):
A gelatin layer containing polymethacrylate particles (diameter 1.5 μm) and formalin scavenger (HS-1)

Further, to each of the above layers were added gelatin hardening agents (H-1) and (H-2) and a surface active agent in addition to the above compositions.

The compounds cotained in the above respective layers of each of Samples 161 to 187 are the same as those used in Example-8 except the Magenta Coupler M-2.

Samples 161 to 187 each was exposed through an optical wedge to a white light, and then processed in the same manner as in Example-2. And those subjected to incubation treatment under the condition of 55° C./20%RH for 5 days were also processed in like manner.

-continued

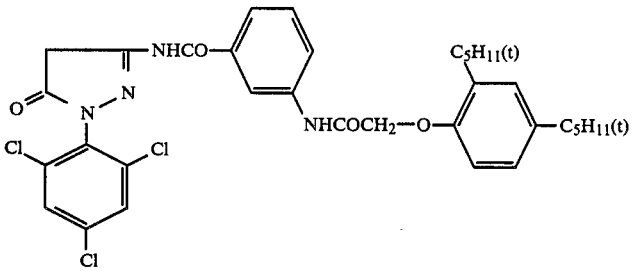

Comparative Compound (j)

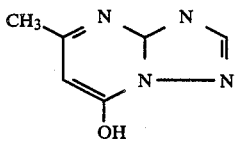

Comparative Compound (k)

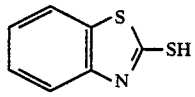

Comparative Compound (l)

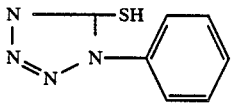

In Table 21, each relative speed is a value relative to the speed of Sample 161 regarded as 100. Also, as for the variation of the fog of each sample obtained after one part of the sample was treated for five days under the condition of 55° C./20%RH and exposed and the processed, the width of the variation of the fog of each sample is given in Table 21.

TABLE 21

| Sample No. | EM No. | Compound (Ex. No.) | Cpd adding amt (mol/mol AgX) | Relative speed | Fog | Fog variation width after 55° C. 5 days |
|---|---|---|---|---|---|---|
| 161 Comp. | A-1 | None | 0 | 100 | 0.20 | +0.23 |
| 162 Comp. | A-2 | " | " | 100 | 0.21 | +0.23 |
| 163 Comp. | B-3 | " | " | 105 | 0.23 | +0.29 |
| 164 Comp. | B-8 | " | " | 110 | 0.22 | +0.37 |
| 165 Comp. | B-9 | " | " | 105 | 0.21 | +0.35 |
| 166 Inv. | B-8 | I-17 | $1 \times 10^{-3}$ | 130 | 0.13 | +0.05 |
| 167 Inv. | " | I-29 | " | 120 | 0.11 | +0.07 |
| 168 Inv. | " | I-35 | " | 125 | 0.15 | +0.09 |
| 169 Comp. | " | j | " | 100 | 0.19 | +0.33 |
| 170 Comp. | " | k | " | 80 | 0.17 | +0.25 |
| 171 Comp. | " | l | " | 70 | 0.16 | +0.23 |
| 172 Comp. | " | II-18 | " | 115 | 0.16 | +0.12 |
| 173 Comp. | A-1 | I-17 | " | 90 | 0.18 | +0.23 |
| 174 Comp. | A-2 | " | " | 95 | 0.19 | +0.23 |
| 175 Inv. | B-1 | " | " | 110 | 0.18 | +0.12 |
| 176 Inv. | B-2 | " | " | 110 | 0.17 | +0.13 |
| 177 Inv. | B-3 | " | " | 115 | 0.17 | +0.08 |
| 178 Inv. | B-4 | " | " | 115 | 0.14 | +0.08 |
| 179 Inv. | B-5 | " | " | 115 | +0.13 | +0.13 |
| 180 Inv. | B-6 | " | " | 120 | 0.14 | +0.09 |
| 181 Inv. | B-7 | " | " | 125 | 0.13 | +0.06 |
| 182 Inv. | B-9 | " | " | 120 | 0.14 | +0.08 |
| 183 Inv. | B-10 | " | " | 120 | 0.15 | +0.08 |
| 184 Inv. | B-8 | j | $1 \times 10^{-3}$ | 130 | 0.13 | +0.05 |
| | | I-17 | $1 \times 10^{-3}$ | | | |
| 185 Inv. | " | k | $1 \times 10^{-3}$ | 100 | 0.13 | +0.03 |
| | | I-17 | $1 \times 10^{-3}$ | | | |
| 186 Inv. | " | l | $1 \times 10^{-3}$ | 95 | 0.13 | +0.03 |
| | | I-17 | $1 \times 10^{-3}$ | | | |
| 187 Inv. | " | II-18 | $1 \times 10^{-3}$ | 125 | 0.12 | +0.03 |
| | | I-17 | $1 \times 10^{-3}$ | | | |

From the results shown in Table 21 the following things can be concluded:

(1) The core/shell-type emulsion of this invention, although its fog is slightly high, has a high sensitivity as compared to the comparative emulsion. However, the variation width of the fog after the incubation treatment is large.

(2) Where Compound [I] of the present invention is added to emulsions, their fog values are lowered, and in the comparative emulsion, the sensitivity is also deteriorated, and the variation width of its fog remains unimproved.

(3) Where Compound [I] of this invention is combindly used with the core/shell-type emulsion of this invention, the fog is reduced significantly, and, to our surprise, a certain increase in the sensitivity was recognized. Further, the combined use also provides satisfactory results in the fog variation in the incubation treatment. In contrast, the use of Comparative Compounds a, b and c deteriorates the sensitivity and is ineffective in improving the incubation fog variation.

EXAMPLE-15

The compounds of this invention shown in Table 22 were added to the respective layers of a multilayer color photographic element prepared in similar manner to that of Example-14, whereby Samples 188 through 195 were prepared, provided that the emulsion of Layer 10 is Emulsion-II of Example-14.

Each of the obtained samples, after being exposed through a wedge, was processed in the same manner as in Example-1. Those incubation-treated under the condition of 55° C./20%RH also were each processed in like manner. The processed samples were evaluated, and the results thereof are as given in Table 22. In Table 22, the relative speed, as defined in Example-14, is the relative value of each sample to that of Sample 188 regarded as 100.

TABLE 22

| Sample No. | | 188 | 189 | 190 | 191 | 192 | 193 | 194 | | 195 | |
|---|---|---|---|---|---|---|---|---|---|---|---|
| Type | | Comp. | Comp. | Inv. | Inv. | Inv. | Inv. | Inv. | | Inv. | |
| Added cpd. | | j | 1 | I-17 | I-29 | I-35 | I-17 | I-17 | II-18 | I-17 | a |
| Layer Adding amount mol/mol of AgX | Blue-sensitive high-speed | $1 \times 10^{-3}$ | $0.5 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ |
| | blue-sensitive low-speed | — | — | — | — | — | $1 \times 10^{-3}$ | — | — | — | — |
| | Green-sensitive high-speed | $1 \times 10^{-3}$ | $0.5 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ |
| | Green-sensitive low-speed | — | — | — | — | — | $1 \times 10^{-3}$ | — | — | — | — |
| | Red-sensitive high-speed | $1 \times 10^{-3}$ | $0.5 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ | $1 \times 10^{-3}$ |
| | Red-sensitive low-speed | — | — | — | — | — | $1 \times 10^{-3}$ | — | — | — | — |
| Relative speed | B | 100 | 70 | 130 | 120 | 120 | 130 | 125 | | 130 | |
| | G | 100 | 70 | 125 | 115 | 120 | 125 | 120 | | 125 | |
| | R | 100 | 65 | 130 | 120 | 125 | 130 | 120 | | 130 | |
| Fog | B | 0.19 | 0.16 | 0.12 | 0.13 | 0.14 | 0.11 | 0.11 | | 0.12 | |
| | G | 0.21 | 0.17 | 0.14 | 0.15 | 0.17 | 0.11 | 0.12 | | 0.14 | |
| | R | 0.20 | 0.16 | 0.12 | 0.14 | 0.16 | 0.10 | 0.10 | | 0.12 | |
| 55° C. incubation fog variation | B | +0.23 | +0.22 | +0.05 | +0.06 | +0.07 | +0.02 | +0.02 | | +0.04 | |
| | G | +0.23 | +0.23 | +0.05 | +0.06 | +0.09 | +0.03 | +0.03 | | +0.05 | |
| | R | +0.25 | +0.23 | +0.05 | +0.05 | +0.06 | +0.03 | +0.03 | | +0.05 | |

As compared with Comparative Sample 188, in each of the samples of this invention, it is recognized that the fog variation width in the incubation treatment at 55° C. is small and the sensitivity is somewhat increased.

EXAMPLE-16

The Emulsions B-13 and B-14 shown in Table 23 were prepared in the same manner as in Example-1.

TABLE 23

| EM | Mean grain size (μ) | Distribution width (%) | AgI content (%) Core | Inter-stratum | Shell | Proportion (%) by vol of each stratum Core | Inter-stratum | Shell | Form of grain |
|---|---|---|---|---|---|---|---|---|---|
| B-13 | 0.82 | 10 | 15 | 5 | 0.3 | 22 | 45 | 21 | Octahedron |
| B-14 | 1.81 | 9 | 15 | 5 | 0.3 | 22 | 50 | 16 | Octahedron |

In the same manner as in Example-14, on a triacetyl cellulose film support were formed the following compositions-having layers in order from the support side, whereby a multilayer color light-sensitive material Sample 196 was prepared. Sample 196 (Comparative):

Layer 1: Antihalation layer (HC-2):
A black colloidal silver-containing gelatin layer
Layer 2: Intermediate layer (I.L.):
A gelatin layer
Layer 3: Low-speed red-sensitive silver halide emulsion layer (RL-2):
Emulsion B-13 . . . .
Coating amount of silver 1.9 g/m$^2$
Sensitizing Dye I . . .
$2.0 \times 10^{-5}$ mole per mole of silver
Sensitizing Dye II . . .
$1.0 \times 10^{-5}$ mole per mole of silver
Cyan Coupler (C-3) . . .
0.08 mole per mole of silver
Colored Cyan Coupler (CC-2) . . .
0.004 mole per mole of silver
DIR Compound (D-2) . . .
0.0005 mole per mole of silver
Layer 4: Intermediate layer (I.L.)
A gelatin layer
Layer 5: Low-speed green-sensitive silver halide emulsion layer (GL-2):
Emulsion B-13 . . . .
Coating amount of silver 1.7 g/m$^2$
Sensitizing Dye III . . .
$1.2 \times 10^{-5}$ mole per mole of silver
Sensitizing Dye IV . . .
$1.2 \times 10^{-5}$ mole per mole of silver
Magenta Coupler (M-2) . . .
0.06 mole per mole of silver
Colored Magenta Coupler (CM-2) . . .
0.012 mole per mole of silver
Layer 6: Intermediate layer (I.L.):
A gelatin layer
Layer 7: Low-speed blue-sensitive silver halide emulsion layer (BL-2):
Emulsion B-13 . . . .
Coating amount of silver 1.0 g/m$^2$
Sensitizing Dye V . . .
$1.0 \times 10^{-5}$ mole per mole of silver
Yellow Coupler (Y-2) . . .
0.35 mole per mole of silver DIR Compound (D-2) . . .
0.001 mole per mole of silver Layer 8: Intermediate layer (I.L.)
A gelatin layer containing an emulsified dispersion product of 2,5-di-t-octylhydroquinone.

Layer 9: High-speed red-sensitive silver halide emulsion layer (RH-2):
Emulsion B-14 . . . .
Coating amount of silver 2.4 g/m$^2$
Sensitizing Dye I . . .
$1.1\times10^{-5}$ mole per mole of silver
Sensitizing II . . .
$5.0\times10^{-6}$ mole per mole of silver
Cyan Coupler (C-3) . . .
0.03 mole per mole of silver
Colored Cyan Coupler (CC-2) . . .
0.002 mole per mole of silver
DIR Compound (D-2) . . .
0.0004 mole per mole of silver Layer 10: Intermediate layer (I.L.)
A gelatin layer containing an emulsified dispersion product of 2,5-di-t-octylhydroquinone.

Layer 11: High-speed green-sensitive silver halide emulsion layer (GH-2):
Emulsion B-14 . . . .
Coating amount of silver 2.0 g/m$^2$
Sensitizing Dye III . . .
$4.0\times10^{-6}$ mole per mole of silver
Sensitizing Dye IV . . .
$4.0\times10^{-6}$ mole per mole of silver
Magenta Coupler (M-2) . . .
0.020 mole per mole of silver
Colored Magenta Coupler (CM-2) . . .
0.002 mole per mole of silver Layer 12: Gelatin layer containing an emulsified product of 2,4-di-t-octylhydroquinone Layer 13: High-speed blue-sensitive silver halide emulsion layer (BH-2) :
Mixture emulsion comprising Emulsion B-13 and AgBrI monodisperse emulsion (Emulsion B-15), mean grain size 0.27 μm, containing 2 mole% AgI . . . Coating amount of silver 2.1 g/m$^2$
Sensitizing Dye V . . .
$7.0\times10^{-6}$ mole per mole of silver
Yellow Coupler (Y-2) . . .
0.08 mole per mole of silver
DIR Compound (D-2) . . .
0.0007 mole per mole of silver Layer 14: First protective layer (Pro-3):
A gelatin layer containing AgBrI, mean grain size 0.07 μm, containing 1 mole% AgI . . .
coating amount of silver 0.2 g/m$^2$, and
Ultraviolet Absorbing Agents UV-1 and UV-2.

Layer 15: Second protective layer (Pro-4):
A gelatin layer containing methyl methacrylate particles (diameter 1.5 μm) and Formalin Scavenger (HS-1).

Further, to each of the above layers were added gelatin hardening agents (H-1) and (H-2) and a surface active agent in addition to the above compositions.

To each of the above Layers 9, 11 and 13 were added the compounds given in Table 23, whereby Samples 196 to 199 were prepared.

These obtained samples were evaluated in the same manner as in Example-15. The results are shown in Table 23, wherein the relative speed is shown in the same way as in Example-15.

TABLE 23

| Sample No. | | 196 | 197 | 198 | 199 | |
|---|---|---|---|---|---|---|
| Type | | Comp. | Inv. | Inv. | Inv. | |
| Compound added | | i | I-17 | I-29 | I-17 | II-18 |
| Layer Adding amount (mol/mol of AgX) | Layer 9 | $1\times10^{-3}$ | $1\times10^{-3}$ | $1\times10^{-3}$ | $1\times10^{-3}$ | $1\times10^{-3}$ |
| | Layer 11 | $1\times10^{-3}$ | $1\times10^{-3}$ | $1\times10^{-3}$ | $1\times10^{-3}$ | $1\times10^{-3}$ |
| | Layer 13 | $1\times10^{-3}$ | $1\times10^{-3}$ | $1\times10^{-3}$ | $1\times10^{-3}$ | $1\times10^{-3}$ |
| Relative speed | B | 100 | 120 | 120 | 115 | |
| | G | 100 | 120 | 115 | 120 | |
| | R | 100 | 125 | 120 | 120 | |
| Fog | B | 0.19 | 0.11 | 0.13 | 0.10 | |
| | G | 0.20 | 0.12 | 0.13 | 0.10 | |
| | R | 0.21 | 0.13 | 0.14 | 0.11 | |
| 55° C. incubation fog variation | B | +0.20 | +0.05 | +0.05 | +0.03 | |
| | G | +0.22 | +0.06 | +0.09 | +0.04 | |
| | R | +0.20 | +0.05 | +0.05 | +0.03 | |

It is recognized that, in the samples of this invention, the fog variation in the incubation treatment at 55° C. is small, and at the same time, the sensitivity is somewhat increased as compared to Comparative Sample No. 196.

What is claimed is:

1. A method for processing silver halide photographic light-sensitive materials which comprises a process in which a silver halide photographic light-sensitive material having a silver halide emulsion layer is developed by a developer in the presence of at least one compound represented by the following Formula [I a]or [I b]:

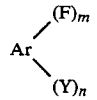

Formula [Ia]

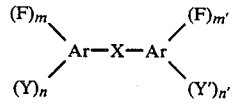

Formula [Ib]

wherein, Ar is a benzene ring or a naphthalene ring, each being allowed to be in the quinone form, F is a fluorine atom, Y and Y' are each a substituent substitutable to the benzene ring or naphthalene ring, X is a bivalent atom or a bivalent linkage group, m and m' are each an integer of 1 to 5 and n and n' are each an integer of 1 to 3.

2. The method of claim 1, wherein said substituent represented by Y or Y' is a halogen atom other than fluorine, a hydroxy group, a mercapto group, a carboxy group or the salt thereof, a sulfo group or the salt thereof, an amino group, an acylamino group, an alkylamino group, a nitro group, a cyano group, an alkyl group, an alkenyl group, a cycloalkyl group, an aryl group, an alkoxy group, an aryloxy group, an alkylthio group, an arylthio group, an alkoxycarbonyl group, a carbamoyl group, a sulfamoyl group, an alkoxyalkyl group, an aminoalkyl group, an acylaminoalkyl group, a hydroxyalkyl group, a carboxyalkyl group, a sulfoalkyl group or an alkylsufonamidoalkyl group.

3. The method of claim 2, wherein said substituent represented by Y or Y' is a hydroxy group, a mercapto group, a carboxy group or the salt thereof, a sulfo group or the salt thereof.

4. The method of claim 1, wherein said compound represented by Formula [I a] or [I b] is contained in said developer.

5. The method of claim 4, wherein said compound represented by Formula [I a]or [I b] is contained in said developer in an amount within the range of from $10^{-5}$ to $10^{-1}$ mol/l.

6. The method of claim 5, wherein said compound represented by Formula [I a] or [I b] is contained in said developer in an amount within the range of from $10^{-4}$ to $10^{-2}$ mol/l.

7. The method of claim 1, wherein said compound represented by Formula [I a] and [I b] is contained in said silver halide photographic light-sensitive material.

8. The method of claim 7, wherein said compound represented by formula [I a] or [I b] is contained in a silver halide emulsion layer of said silver halide photographic light-sensitive material.

9. The method of claim 8, wherein the substituent represented by Y or Y' of said compoun represented by Formula [I a] or [I b] contained in said silver halide emulsion layer of said silver halide photographic light-sensitive material is a hydroxy group, a mercapto group, a carboxy group or the salt thereof, sulfo group or the salt thereof.

10. The method of claim 8, wherein said compound represented by Formula [I a] or [I b] is contained in said silver halide emulsion layer in an amount within the range of from $10^{-5}$ to $10^{-1}$ mol per mol of silver contained in said silver halide emulsion layer.

11. The method of claim 7, wherein said silver halide photoraphic light-sensitive material further comprises a non-light-sensitive layer containing said compound represented by Formula [I a] or [I b].

12. The method of claim 11, wherein of said compound represented by Formula [I a] or [I b] is contained in said non-light-sensitive layer in an amount within the range of from $10^{-5}$ to 1 mol per $m^2$ of said layer.

13. The method of claim 7, wherein a compound represented by the following Formula [II] is further contained in said silver halide light-sensitive material:

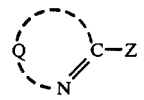

Formula [II]

wherein Q is an atomic group necessary to complete a seven or six membered ring containing a carbon, nitrogen, sulfur or oxygen atom, said ring completed by Q being allowed to be condensed with a hydrocarbon or heterocyclic ring, and Z is an aromatic group or a heterocyclic group.

14. The method of claim 13, wherein said ring completed by Q is an imidazol ring, a triazole ring or a tetrazole ring.

15. The method of claim 14, wherein said aromatic group represented by Z is a phenyl group, a tolyl group or a m-nitro-phenyl group.

16. The method of claim 14, wherein said heterocyclic group represented by Z is a 2-imidazolyl group, a 2-pirydyl group or a 2-benzo-thiazolyl group.

17. The method of claim 16, wherein the substituent represented by Y or Y' of said compound represented by Formula [I a] or [I b] contained in said silver halide emulsion layer of said silver halide photographic light-sensitive material is a hydroxy group, a mercapto group, a carboxy group or the salt thereof, sulfo group or the sult thereof.

18. The method of claim 13, wherein the ratio by weight of said compound represented by formula [I a] or [I b] to said compound represented by Formula [II] is within the range of from 1:01 to 1:50.

19. The method of claim 7, wherein said silver halide photographic light-sensitive material contains a magenta color forming coupler represensted by the following Formula [M-I]:

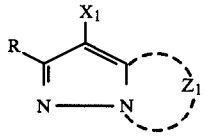

Formula [M-I]

wherein $Z_1$ is a non-metallic atomic group necessary to complete a nitrogen-containing heterocyclic ring which may have a substituent, $X_1$ is a group capable of being splitted off from the coupler residue upon the reaction of said coupler with the oxidized product of a color developing agent; and R is a hydrogen atom or a substituent.

20. The method of claim 7, wherein said silver halide photographic light-sensitive material contains a compound capable of reacting with the oxidized product of a color developing agent without producing image density.

21. The method of claim 8 or 17, wherein said silver halide emulsion layer comprises core/shell-type silver halide grains.

* * * * *